US008844241B2

(12) United States Patent
Richardson et al.

(10) Patent No.: US 8,844,241 B2
(45) Date of Patent: Sep. 30, 2014

(54) METHODS AND APPARATUS FOR PROVIDING LININGS ON CONCRETE STRUCTURES

(75) Inventors: George David Richardson, Vancouver (CA); Semion Krivulin, Richmond (CA); James Johnson, Delta (CA); Jaret Breckenridge, Vancouver (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 311 days.

(21) Appl. No.: 12/594,576

(22) PCT Filed: Apr. 2, 2008

(86) PCT No.: PCT/CA2008/000608

§ 371 (c)(1),
(2), (4) Date: Oct. 29, 2009

(87) PCT Pub. No.: WO2008/119178

PCT Pub. Date: Oct. 9, 2008

(65) Prior Publication Data

US 2010/0050552 A1 Mar. 4, 2010

Related U.S. Application Data

(60) Provisional application No. 60/909,689, filed on Apr. 2, 2007, provisional application No. 60/986,973, filed on Nov. 9, 2007, provisional application No. 61/022,505, filed on Jan. 21, 2008.

(51) Int. Cl.

| | |
|---|---|
| ***E04G 11/02*** | (2006.01) |
| ***B28B 23/02*** | (2006.01) |
| ***E04B 1/04*** | (2006.01) |
| ***E04B 1/68*** | (2006.01) |
| ***B28B 19/00*** | (2006.01) |
| *E04B 2/86* | (2006.01) |

(52) U.S. Cl.

CPC . *E04B 1/04* (2013.01); *B28B 23/02* (2013.01); *E04B 2/8605* (2013.01); *E04B 1/6803* (2013.01); *B28B 19/003* (2013.01); *E04B 2002/8688* (2013.01); *B28B 19/0046* (2013.01)

USPC ..... 52/742.14; 52/414; 52/421; 52/426

(58) Field of Classification Search

CPC ..... E04B 2/04; E04B 2/68; E04B 2/86; E04B 2/8611; E04B 2/8617; E04B 2/8635; E04B 2002/84; E04B 2002/86; E04C 3/20; E04C 3/22; E04C 3/29

USPC ..... 52/309.1, 309.4, 309.12, 421, 425, 426, 52/439, 414, 742.1, 742.13, 742.14; 249/191, 194, 195, 213, 216

See application file for complete search history.

(56) References Cited

U.S. PATENT DOCUMENTS

| | | | |
|---|---|---|---|
| 154,179 | A | 8/1874 | Hubert |
| 374,826 | A | 12/1887 | Clarke |
| 510,720 | A | 12/1893 | Stewart, Jr. |
| 820,246 | A | 5/1906 | Nidds |
| 1,035,206 | A | 8/1912 | Lewen |
| 1,080,221 | A | 12/1913 | Jester |
| 1,244,608 | A | 10/1917 | Hicks |
| 1,276,147 | A | 8/1918 | White |
| 1,345,156 | A | 6/1920 | Flynn |
| 1,423,879 | A | 7/1922 | Potter |
| 1,637,410 | A | 8/1927 | Corybell |
| 1,653,197 | A | 12/1927 | Barnes |
| 1,715,466 | A | 6/1929 | Miller |
| 1,820,897 | A | 8/1931 | White et al. |
| 1,875,242 | A | 8/1932 | Hathaway |
| 1,915,611 | A | 6/1933 | Miller |
| 2,008,162 | A | 7/1935 | Waddell |
| 2,050,258 | A | 8/1936 | Bemis |
| 2,076,472 | A | 4/1937 | London |
| 2,164,681 | A | 7/1939 | Fould |
| 2,172,052 | A | 9/1939 | Robbins |
| 2,326,361 | A | 8/1943 | Jacobsen |
| 2,861,277 | A | 11/1958 | Hermann |
| 2,892,340 | A | 6/1959 | Fort |
| 3,063,122 | A | 11/1962 | Katz |
| 3,100,677 | A | 8/1963 | Frank et al. |
| 3,184,013 | A | 5/1965 | Pavlecka |
| 3,196,990 | A | 7/1965 | Handley |
| 3,220,151 | A | 11/1965 | Goldman |

| | | | | |
|---|---|---|---|---|
| 3,288,427 | A | 11/1966 | Pluckebaum | |
| 3,291,437 | A | 12/1966 | Bowden et al. | |
| 3,468,088 | A | 9/1969 | Miller | |
| 3,555,751 | A | 1/1971 | Thorgusen | |
| 3,588,027 | A | 6/1971 | Bowden | |
| 3,769,769 | A | 11/1973 | Kohl | |
| 3,788,020 | A | 1/1974 | Gregori | |
| 3,886,705 | A | 6/1975 | Cornland | |
| 3,951,294 | A | 4/1976 | Wilson | |
| 3,991,636 | A | 11/1976 | Devillers | |
| 4,023,374 | A | 5/1977 | Colbert et al. | |
| 4,060,945 | A | 12/1977 | Wilson | |
| 4,104,837 | A | 8/1978 | Naito | |
| 4,106,233 | A | 8/1978 | Horowitz | |
| 4,180,956 | A | 1/1980 | Gross | |
| 4,276,730 | A | 7/1981 | Lewis | |
| 4,351,870 | A | 9/1982 | English | |
| 4,383,674 | A | 5/1983 | Fricker | |
| 4,430,831 | A | 2/1984 | Kemp | |
| 4,433,522 | A | 2/1984 | Yerushalmi | |
| 4,434,597 | A | 3/1984 | Fischer | |
| 4,508,310 | A | 4/1985 | Schultz | |
| 4,532,745 | A | 8/1985 | Kinard | |
| 4,543,764 | A | 10/1985 | Kozikowski | |
| 4,550,539 | A | 11/1985 | Foster | |
| 4,553,875 | A | 11/1985 | Casey | |
| 4,575,985 | A | 3/1986 | Eckenrodt | |
| 4,581,864 | A | 4/1986 | Shvakhman et al. | |
| 4,606,167 | A | 8/1986 | Thorne | |
| 4,695,033 | A | 9/1987 | Imaeda et al. | |
| 4,703,602 | A | 11/1987 | Pardo | |
| 4,731,964 | A | 3/1988 | Phillips | |
| 4,731,971 | A | 3/1988 | Terkl | |
| 4,742,665 | A | 5/1988 | Baierl | |
| 4,856,754 | A | 8/1989 | Yokota et al. | |
| 4,866,891 | A | 9/1989 | Young | |
| 4,946,056 | A | 8/1990 | Stannard | |
| 4,995,191 | A | 2/1991 | Davis | |
| 5,014,480 | A | 5/1991 | Guarriello et al. | |
| 5,028,368 | A | 7/1991 | Grau | |
| 5,124,102 | A | 6/1992 | Serafini | |
| 5,216,863 | A | 6/1993 | Nessa et al. | |
| 5,243,805 | A | 9/1993 | Fricker | |
| 5,265,750 | A | 11/1993 | Whiteley | |
| 5,311,718 | A | 5/1994 | Trousilek | |
| 5,465,545 | A | 11/1995 | Trousilek | |
| 5,489,468 | A | 2/1996 | Davidson | |
| 5,491,947 | A | 2/1996 | Kim | |
| 5,513,474 | A | 5/1996 | Scharkowski | |
| 5,516,863 | A | 5/1996 | Abusleme et al. | |
| 5,553,430 | A | 9/1996 | Majnaric et al. | |
| 5,591,265 | A | 1/1997 | Tusch | |
| 5,608,999 | A | 3/1997 | McNamara | |
| 5,625,989 | A | 5/1997 | Brubaker et al. | |
| 5,714,045 | A | 2/1998 | Lasa et al. | |
| 5,729,944 | A * | 3/1998 | De Zen | 52/439 |
| 5,740,648 | A | 4/1998 | Piccone | |
| 5,747,134 | A | 5/1998 | Mohammed et al. | |
| 5,791,103 | A | 8/1998 | Coolman | |
| 5,824,347 | A | 10/1998 | Serafini | |
| 5,860,262 | A | 1/1999 | Johnson | |
| 5,953,880 | A | 9/1999 | De Zen | |
| 5,987,830 | A | 11/1999 | Worley | |
| 6,161,989 | A | 12/2000 | Kotani et al. | |
| 6,167,669 | B1 | 1/2001 | Lanc | |
| 6,167,672 | B1 | 1/2001 | Okitomo | |
| 6,185,884 | B1 | 2/2001 | Myers et al. | |
| 6,189,269 | B1 | 2/2001 | De Zen | |
| 6,212,845 | B1 | 4/2001 | De Zen | |
| 6,219,984 | B1 | 4/2001 | Piccone | |
| 6,220,779 | B1 | 4/2001 | Warner et al. | |
| 6,247,280 | B1 | 6/2001 | Grinshpun et al. | |
| 6,387,309 | B1 | 5/2002 | Kojima | |
| 6,435,470 | B1 | 8/2002 | Lahham et al. | |
| 6,435,471 | B1 | 8/2002 | Piccone | |
| 6,530,185 | B1 | 3/2003 | Scott et al. | |
| 6,550,194 | B2 | 4/2003 | Jackson et al. | |
| 6,622,452 | B2 | 9/2003 | Alvaro | |
| 6,694,692 | B2 * | 2/2004 | Piccone | 52/426 |
| 6,832,456 | B1 | 12/2004 | Bilowol | |
| 6,866,445 | B2 | 3/2005 | Semler | |
| 6,935,081 | B2 | 8/2005 | Dunn et al. | |
| 7,320,201 | B2 | 1/2008 | Kitchen et al. | |
| 7,444,788 | B2 | 11/2008 | Morin et al. | |
| 2003/0005659 | A1 | 1/2003 | Moore, Jr. | |
| 2003/0085482 | A1 | 5/2003 | Sincock et al. | |
| 2003/0155683 | A1 | 8/2003 | Pietrobon | |
| 2004/0010994 | A1 | 1/2004 | Piccone | |
| 2004/0093817 | A1 | 5/2004 | Pujol Barcons | |
| 2005/0016083 | A1 | 1/2005 | Morin et al. | |
| 2005/0016103 | A1 * | 1/2005 | Piccone | 52/481.1 |
| 2006/0213140 | A1 | 9/2006 | Morin et al. | |
| 2007/0193169 | A1 | 8/2007 | Emblin | |
| 2009/0229214 | A1 | 9/2009 | Nelson | |
| 2010/0050552 | A1 | 3/2010 | David et al. | |

FOREIGN PATENT DOCUMENTS

| | | |
|---|---|---|
| CA | 0574720 | 4/1959 |
| CA | 0957816 | 11/1974 |
| CA | 1316366 | 4/1993 |
| CA | 2097226 | 11/1994 |
| CA | 2141463 | 8/1996 |
| CA | 2070079 | 6/1997 |
| CA | 2170681 | 8/1997 |
| CA | 2218600 | 6/1998 |
| CA | 2215939 | 8/1999 |
| CA | 2226497 | 10/1999 |
| CA | 2243905 | 1/2000 |
| CA | 2255256 | 1/2000 |
| CA | 2244537 | 2/2000 |
| CA | 2418885 | 8/2003 |
| CA | 2502343 | 5/2004 |
| CA | 2502392 | 5/2004 |
| CA | 2499450 | 9/2005 |
| CA | 2577217 | 1/2006 |
| CA | 2629202 | 4/2008 |
| CA | 2681963 | 10/2008 |
| CH | 317758 | 1/1957 |
| CN | 2529936 | 1/2003 |
| DE | 1684357 | 4/1967 |
| DE | 1812590 | 6/1970 |
| DE | 2062723 | 8/1972 |
| DE | 3003446 | 8/1981 |
| DE | 3234489 | 3/1984 |
| DE | 3727956 | 5/1988 |
| DE | 29803155 | 6/1998 |
| EP | 0025420 | 3/1981 |
| EP | 0055504 | 7/1982 |
| EP | 0141782 | 5/1985 |
| EP | 0757137 | 2/1997 |
| FR | 0507787 | 7/1920 |
| FR | 1381945 | 11/1964 |
| FR | 1603005 | 4/1971 |
| FR | 2535417 | 5/1984 |
| FR | 2721054 | 6/1994 |
| FR | 2717848 | 9/1995 |
| GB | 779916 | 7/1957 |
| GB | 2141661 | 1/1985 |
| GB | 2205624 | 12/1988 |
| JP | 05133028 | 5/1993 |
| JP | 09041612 | 2/1997 |
| JP | 2008223335 | 9/2008 |
| SE | 206538 | 8/1966 |
| WO | 8204088 | 11/1982 |
| WO | 9500724 | 1/1995 |
| WO | 9607799 | 3/1996 |
| WO | 9635845 | 11/1996 |
| WO | 9743496 | 11/1997 |
| WO | 0163066 | 8/2001 |
| WO | 0173240 | 10/2001 |
| WO | 03006760 | 1/2003 |
| WO | 2004088064 | 10/2004 |

OTHER PUBLICATIONS

Vector Corrosion Technologies Marketing Materials, 2007.
Vector Corrosion Technologies Marketing Materials, 2008.

Vector Corrosion Technologies Marketing Materials, 2005.
The Digigraph System, http://www.digigraph-housing.com/web/system.ht, accessed online Jan. 2012.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.

* cited by examiner

*Primary Examiner* — William Gilbert
(74) *Attorney, Agent, or Firm* — Oyens Wiggs Green & Mutala LLP

(57) ABSTRACT

Methods and apparatus are provided for lining one or more surfaces of concrete structures during fabrication thereof. A structure-lining apparatus comprises a plurality of structure-lining panels and a plurality of concrete-anchoring components. The panels, which may extend in longitudinal and transverse directions, are interconnected to one another in edge-to-edge relationship at their transverse edges to line at least a portion of the interior of the structural form. The concrete-anchoring components extend in an inward/outward direction from the panels. The concrete-anchoring components may: be integrally formed with the panels; connect to the panels via suitably configured connector components; and/or connect edge-adjacent panels to one another. The concrete-anchoring components may comprise concrete-anchoring features which may extend in the longitudinal and transverse directions (e.g. in a plane parallel to the panels) to provide concrete-anchoring surfaces. In particular embodiments, the concrete-anchoring features comprise a stem which extends in the inward/outward and longitudinal directions and, at a distance spaced apart from the panels in the inward/outward direction, one or more leaves which extend in the longitudinal and transverse directions to provide anchoring surfaces. Concrete is then poured into the form on an interior of the lining panels and allowed to solidify in the form. As the concrete solidifies, the concrete-anchoring components bond the lining panels to the resultant concrete structure.

35 Claims, 29 Drawing Sheets

METHODS AND APPARATUS FOR PROVIDING LININGS ON CONCRETE STRUCTURES

RELATED APPLICATIONS

This application claims the benefit of the priority of U.S. application No. 60/909,689 filed 2 Apr. 2007, U.S. application No. 60/986,973 filed 9 Nov. 2007 and U.S. application No. 61/022,505 filed 21 Jan. 2008. These applications are hereby incorporated herein by reference in their entirety.

TECHNICAL FIELD

The invention disclosed herein relates to fabricating structures from concrete and similar curable materials. Particular embodiments of the invention provide methods and apparatus for providing linings on the surfaces of concrete structures during fabrication thereof. Such concrete structures may include, without limitation, walls for building structures or the like.

BACKGROUND

It is known to make a wide variety of structures from concrete. By way of non-limiting example, such structures may include walls (e.g. for buildings, tanks or other storage containers), structural components (e.g. supports for bridges, buildings or elevated transportation systems), tunnels or the like.

In many applications, the concrete used to make such structures is unsuitable or undesirable as a surface of the structure or it is otherwise desired to line one or more surfaces of the structure with material other than concrete.

By way of non-limiting example, consider the use of concrete to form tilt-up walls. Concrete tilt-up walls are typically formed in a generally horizontal plane (e.g. on a horizontal table) and then tilted to a generally vertical plane. A form is created on the table by suitably fastening form-work members to the table such that the form-work members extend upwardly from the horizontal surface of the table. Concrete is then poured into the form. The form-work members (including the horizontal surface of the table) retain the liquid concrete in the desired shape. Some tables are configured to vibrate to assist with an even distribution of liquid concrete. When the concrete solidifies, the concrete structure is hoisted from the form and tilted from the generally horizontal orientation of the table into a generally vertical orientation by a crane, a suitably configured winching apparatus or the like.

A drawback with prior art tilt-up walls is that all of the surfaces of the wall are bare concrete. Bare concrete surfaces have a number of limitations. Bare concrete may be aesthetically unpleasing. Consequently, prior tilt-up walls may not be suitable for certain applications where there is a desire to have an aesthetically pleasing finished surface on the walls. In addition, bare concrete typically has a somewhat porous or otherwise non-smooth surface which is difficult to clean and which provides spaces for dirt to accumulate and bacteria and other organisms to grow. Consequently, prior art tilt-up walls may not be suitable for certain applications where there is a desire to provide a sanitary environment. Bare concrete may be susceptible to degradation or damage from exposure to various chemicals or conditions, such as, by way of non-limiting example, salt, various acids, animal excrement and whey. Consequently, prior art tilt-up walls may not be suitable for certain applications where the wall might be exposed to such chemicals.

There is a desire to provide methods and apparatus for lining one or more surfaces of concrete structures with material other than concrete.

BRIEF DESCRIPTION OF THE DRAWINGS

In drawings which depict non-limiting embodiments of the invention:

FIGS. 17A and 17B are cross-sectional and partially exploded cross-sectional views of a connector-type insulation-anchoring component according to a particular embodiment together with partial views of the panels which they connect to one another in edge-adjacent relationship;

DETAILED DESCRIPTION

Figure 1A:
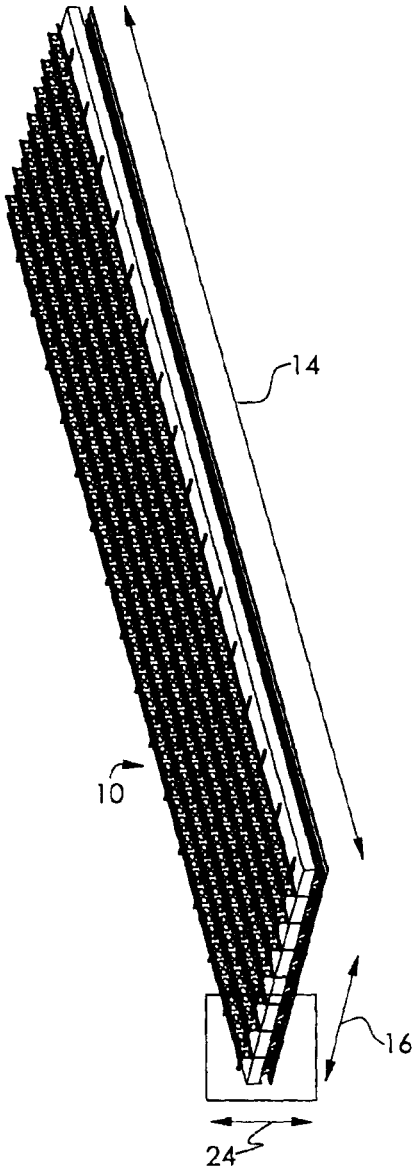
FIGS. 1A, 1B, 1C and 1D respectively depict an isometric view, an enlarged partial isometric view, a front plan view and an enlarged partial front plan view of a structure-lining apparatus suitable for use in lining a wall segment during fabrication according to a particular embodiment of the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Particular aspects of the invention provide methods and apparatus for lining one or more surfaces of concrete structures during fabrication thereof. In particular embodiments, a portion of a structural form is lined with a structure-lining apparatus comprising a plurality of structure-lining panels and a plurality of concrete-anchoring components. The panels which may extend in longitudinal and transverse directions are interconnected to one another in edge-to-edge relationship at their transverse edges to line at least a portion of the interior of the structural form. The concrete-anchoring components extend in an inward/outward direction from the panels. The concrete-anchoring components may: be integrally formed with the panels; connect to the panels via suitably configured connector components; and/or connect edge-adjacent panels to one another. The concrete-anchoring components extend in the inward/outward direction and may comprise concrete-anchoring features which may extend in the longitudinal and transverse directions (e.g. in a plane parallel to the panels) to provide concrete-anchoring surfaces. In particular embodiments, the concrete-anchoring features comprise a stem which extends in the inward/outward and longitudinal directions and, at a distance spaced apart from the panels in the inward/outward direction, one or more leaves which extend in the longitudinal and transverse directions to provide anchoring surfaces. Concrete is then poured into the form on an interior of the lining panels and allowed to solidify in the form. As the concrete solidifies, the concrete-anchoring components bond the lining panels to the resultant concrete structure.

One particular non-limiting example of a concrete structure which may be lined in accordance with the invention is a wall structure—e.g. a tilt-up wall structure. A structural form may be assembled on a table or a similar horizontal surface. In particular embodiments, a structure-lining apparatus (e.g. wall-lining apparatus) is assembled and placed within the form to cover at least a portion of the table surface. The wall-lining apparatus comprises a plurality of longitudinally and transversely extending panels connected to one another at their transverse edges to form a wall-lining surface. Before or after interconnection with one another, the panels may be laid atop the generally horizontal table surface. In some embodiments, the wall-lining apparatus may be made to cover other surface(s) of the form as well. The wall-lining apparatus also comprises a plurality of concrete-anchoring components which may comprise concrete-anchoring features for bonding the panels to the concrete. Such concrete-anchoring features may extend from the panels in the inward/outward direction (e.g. on a stem) and then, at locations spaced apart from the panels, may extend in the longitudinal and transverse directions to provide anchoring surfaces. One or more layers of concrete are poured over top of the panels. As the concrete solidifies, the concrete-anchoring components bond the lining panels to the resultant wall segment which may then be tilted from the generally horizontal table surface into a generally vertical orientation.

In particular structures and/or applications, such as exterior building walls for example, it may be desirable to provide insulation as part of the structure. For such structures and/or applications, structure-lining apparatus according to various embodiments of the invention may also comprise insulation-anchoring components which connect panel(s) to the insulation. Such insulation anchoring components may: be integrally formed with the panels; connect to the panels via suitably configured connector components; and/or connect edge-adjacent panels to one another.

Structure-lining apparatus according to the invention may generally be used to line any structure formed from concrete or similar curable materials. Without limiting the generality of the invention, the first part of this description presents structure-lining apparatus according to particular embodiments of the invention which are used in the fabrication of wall structures—e.g. wall-lining apparatus for tilt-up walls.

FIGS. 1A-1D show various views of a structure-lining apparatus 10 according to a particular non-limiting embodiment of the invention. In the illustrated embodiment, structure-lining apparatus 10 is a wall-lining apparatus used to cover one surface of a concrete wall structure. Wall-lining apparatus 10 comprises a plurality of generally planar panels 12 which extend in a longitudinal dimension (shown by double-headed arrow 14) and in a transverse dimension (shown by double-headed arrow 16). Panels 12 are disposed in edge-to-edge relationship with one another along their transverse edges 20, 22. The edge-to-edge configuration of panels 12 provides a structure-lining surface 26 as described in more detail below.

Wall-lining apparatus 10 of the illustrated embodiment also comprises a plurality of connector-type concrete-anchoring components 18. Connector-type concrete-anchoring components 18 also extend in the longitudinal direction 14 and project away from structure-lining surface 26 in the general direction shown by arrow 24. Direction 24 is referred to herein as "inward/outward direction" 24. Connector-type concrete-anchoring components 18 connect transverse edges 20, 22 of adjacent panels 12 to one another and may also help to bond panels 12 to the concrete and/or insulation of the resultant wall as described in more detail below. For brevity, connector-type concrete-anchoring components 18 and other connector-type anchoring components described herein may occasionally be referred to in this description as "connectors".

In the illustrated embodiment, wall-lining apparatus 10 also comprises a plurality of braces 28 which extend in longitudinal direction 14 and between connectors 18 and panels 12 in transverse direction 16 and inward/outward direction 24. Braces 28 may help to reinforce the edge-to-edge connection between transversely adjacent panels 12 and may also help to prevent deformation of panels 12 under the weight of concrete. Braces 28 may also help to bond wall-lining apparatus 10 to the concrete used to form a wall segment as described in more detail below.

In particular embodiments, panels 12, connectors 18 and braces 28 are fabricated from suitable plastic as a monolithic unit using an extrusion process. By way of non-limiting example, suitable plastics include: poly-vinyl chloride (PVC), acrylonitrile butadiene styrene (ABS) or the like. In other embodiments, panels 12, connectors 18 and/or braces 28 may be fabricated from other suitable materials, such as steel or other suitable alloys or composite materials (e.g. a combination of one or more resins and natural and/or synthetic materials), for example. Although extrusion is one particular technique for fabricating panels 12, connectors 18 and braces 28, other suitable fabrication techniques, such as injection molding, stamping, sheet metal fabrication techniques or the like may additionally or alternatively be used.

Figure 1D:
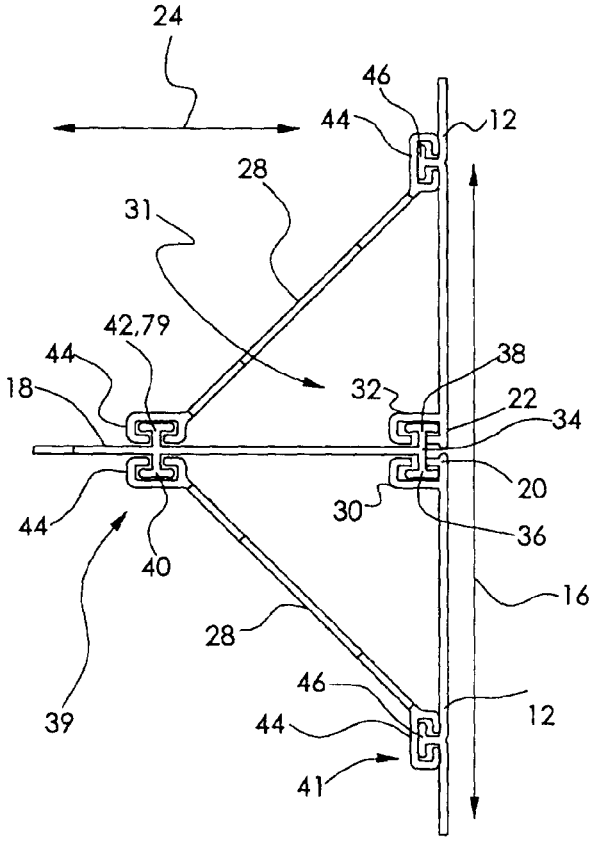

FIG. 1D shows detail of an edge-to-edge connection 31 of transversely adjacent panels 12 of wall-lining apparatus 10. In the illustrated embodiment, transverse edge 20 of a first wall panel 12 comprises a C-shaped female connector component 30 and opposing transverse edge 22 of a transversely adjacent wall panel 12 comprises a similar C-shaped female connector component 32. In the illustrated embodiment, edge 34 of connector 18 incorporates a corresponding pair of T-shaped male connector components 36, 38. In the illustrated embodiment, each of T-shaped male connector components 36, 38 is slidably received in a corresponding one of C-shaped female connector components 30, 32 by sliding panels 12 and connector 18 relative to one another in longitudinal direction 14. It will be appreciated that connector components 36, 38, 30, 32 represent only one set of suitable connector components which could be used to connect panels 12 in edge-adjacent relationship using connector 18 and that many other types of connector components could be used in place of connector components 36, 38, 30, 32. By way of non-limiting example, such connector components may be used to form slidable connections, deformable "snap-together" connections, pivotable connections, or connections incorporating any combination of these actions. In other embodiments, edges 20, 22 of panels 12 may comprise male connector components and edge 34 of connector 18 may comprise corresponding female connector components.

FIG. 1D also shows detail of a connection 39 between connector 18 and braces 28 and a connection 41 between braces 28 and panels 12. In the illustrated embodiment, connector 18 comprises an additional pair of T-shaped male connector components 40, 42 at a location that is spaced apart from edge 34 (and from panels 12 and structure-lining surface 26) in inward/outward direction 24. Braces 28 may comprise corresponding C-shaped female connector components 44 at their edges. Braces 28 connect to connector 18 when each of T-shaped male connector components 40, 42 is slidably received in a corresponding one of C-shaped female connector components 44 by sliding braces 28 and connector 18 relative to one another in longitudinal direction 14. Similarly, in the illustrated embodiment, panels 12 each comprise T-shaped male connector components 46 at locations spaced apart from their edges 20, 22 (and from connector 18) in the transverse direction 16. Braces 28 may connect to panels 12 when each of the T-shaped male connector components 46 is slidably received in a corresponding one of C-shaped female connector components 44 by sliding braces 28 and panels 12 relative to one another in longitudinal direction 14. It will be appreciated that connector components 40, 42, 44, 46 represent only one set of suitable connector components which could be used to connect panels 12 to braces 28 and that many other types of connector components could be used in place of connector components 40, 42, 44, 46. By way of non-limiting example, such connector components may be used to form slidable connections, deformable "snap-together" connections, pivotable connections, or connections incorporating any combination of these actions. In alternative embodiments, braces 28 may comprise one or more male connector components and panels 12 and/or connectors 18 may comprise one or more corresponding female connector components.

Figure 1B:
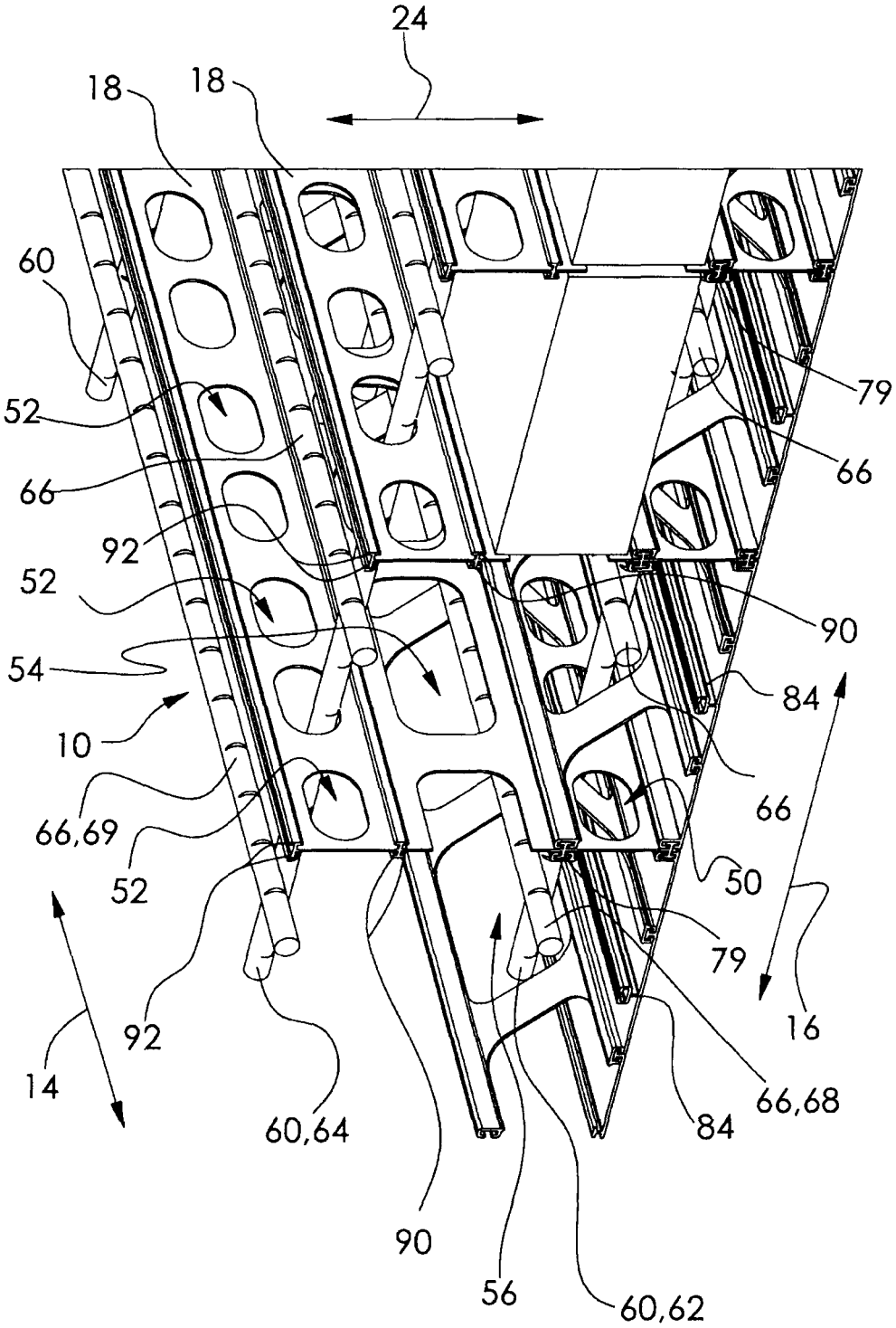

In the illustrated embodiment, connectors 18 and braces 28 are apertured to allow liquid concrete to flow between opposing transverse sides thereof (see FIG. 1B). In the illustrated embodiment, connectors 18 comprise: a plurality of proximate apertures 50 which are spaced apart from one another in longitudinal direction 14 and which are located relatively proximate to panels 12; a plurality of distal apertures 52 which are spaced apart from one another in longitudinal direction 14 and which are located relatively far from panels 12 (i.e. in inward/outward direction 24); and a plurality of intermediate apertures 54 which are spaced apart from one another in longitudinal direction 14 and which are located between proximate apertures 50 and distal apertures 52. Braces 28 comprise brace apertures 56 which are spaced apart from one another in longitudinal direction 14.

An optional additional function of apertures 50, 52, 54 in connectors 18 and brace apertures 56 in braces 28 is to receive reinforcing bars 60 which may extend in transverse direction 16 through apertures 50, 52, 54, 56. In the illustrated embodiment, a proximate set 62 of longitudinally spaced apart, transversely extending reinforcing bars 60 is shown extending through proximate apertures 50 of connectors 18 and through brace apertures 56 in braces 28 and a distal set 64 of longitudinally spaced apart, transversely-extending reinforcing bars 60 is shown extending through distal apertures 52 of connectors 18. In the illustrated embodiment, transversely extending reinforcing bars 60 abut against edges of proximate apertures 50 and distal apertures 52, which hold transversely-extending reinforcing bars 60 in place until the concrete is cast.

In the illustrated embodiment, a proximate set 68 of transversely spaced apart, longitudinally-extending reinforcement bars 66 rests atop proximate set 62 of transversely-extending reinforcement bars 60 and a distal set 69 of transversely spaced apart, longitudinally-extending reinforcement bars 66 rests atop distal set 64 of transversely-extending reinforcement bars 60. Longitudinally-extending reinforcement bars 66 may be fastened to transversely-extending reinforcement bars by tie-straps, wound wire or other suitable fastening mechanisms. In the illustrated embodiment, there is one longitudinally-extending reinforcement bar 66 between each transversely neighboring pair of connectors 18. This spacing is not necessary. Depending on the transverse dimension of panels 12 and the strength requirements of the structure to be constructed, there may be a different number of longitudinally-extending reinforcement bars 66 between each transversely neighboring pair of connectors 18. In some embodiments, transversely-extending reinforcement bars 60 and/or longitudinally-extending reinforcement bars 66 are not required, depending on wall strength requirements.

Figure 2:
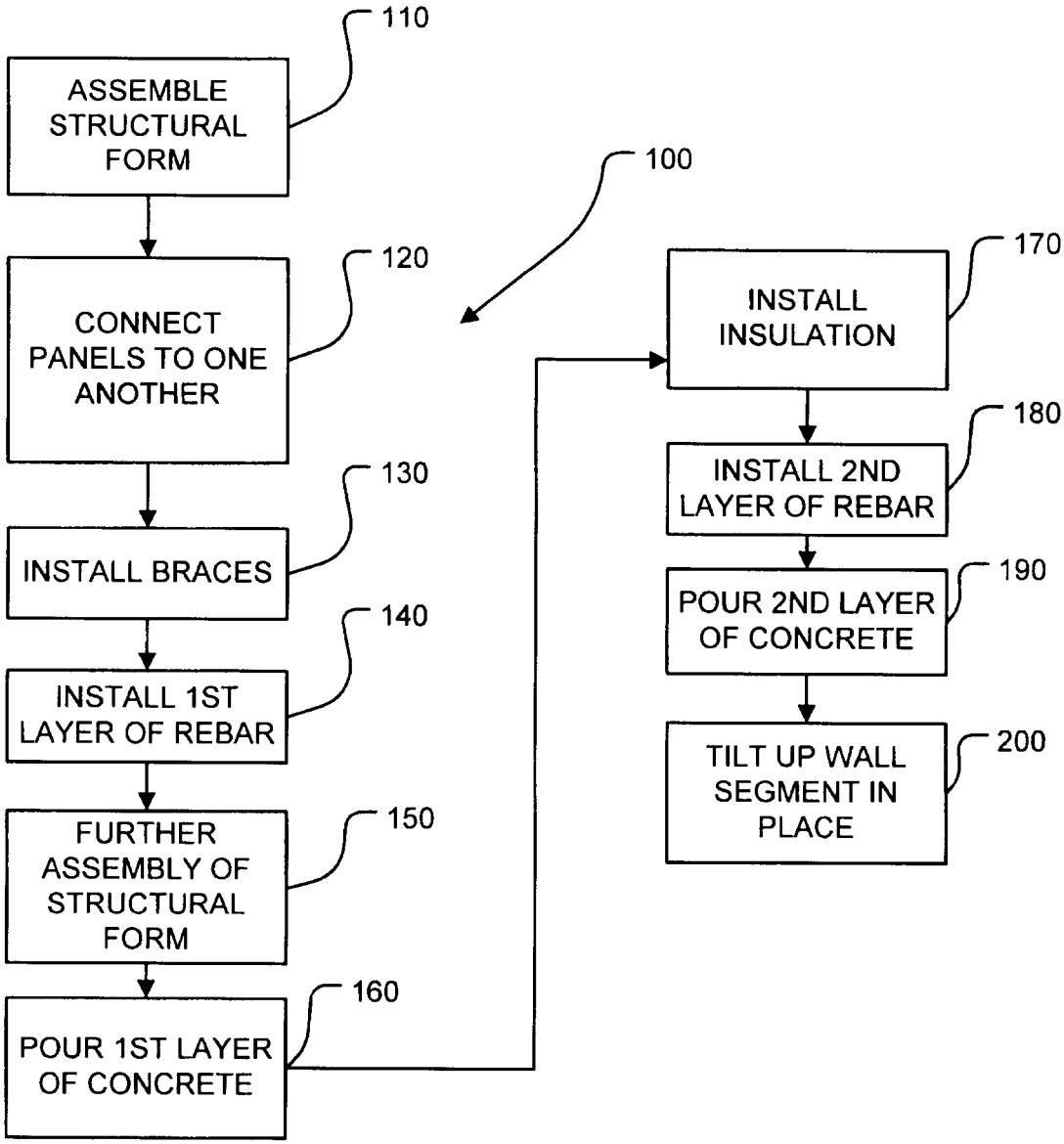
FIG. 2 schematically illustrates a method for using the structure-lining apparatus of FIGS. 1A-1D to form one or more wall segment(s) in accordance with a particular embodiment of the invention.

FIG. 2 schematically illustrates a method 100 of using wall-lining apparatus 10 to provide a lining on a surface of wall segments 94 during fabrication thereof (e.g. before the wall-forming liquid concrete is permitted to solidify). In the illustrated embodiment, method 100 commences in block 110 which involves partially or completely assembling a structural form-work in which the concrete structure (wall segment 94) will be formed. In particular embodiments, wall segments 94 are tilt-up wall segments which may be fabricated on a horizontally oriented table or similar horizontally oriented surface and then tilted into a vertical orientation as required. In such embodiments, the horizontal surface of the table may be considered to be part of the structural form-work.

Figure 1C:
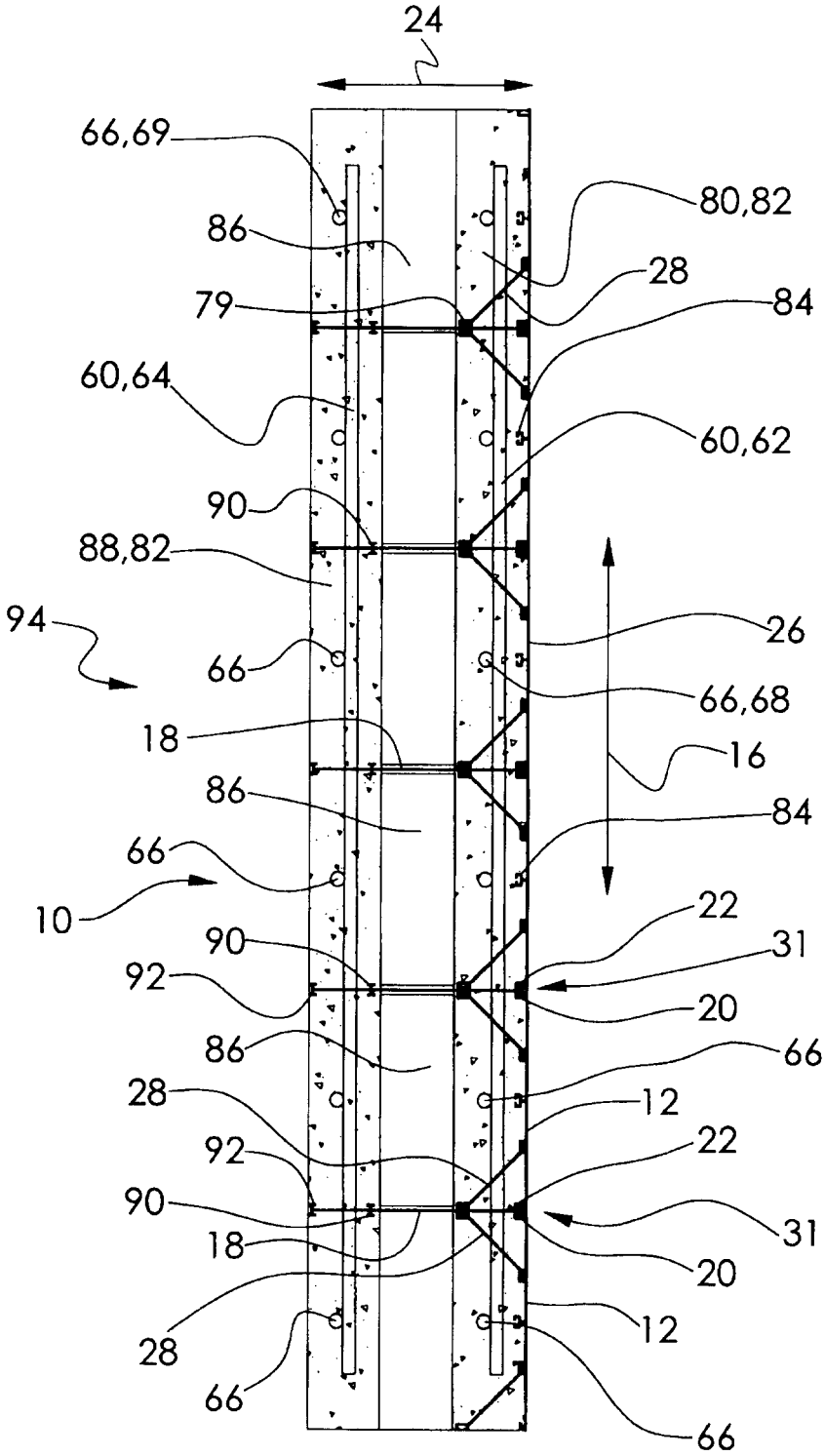
Figure 1E:
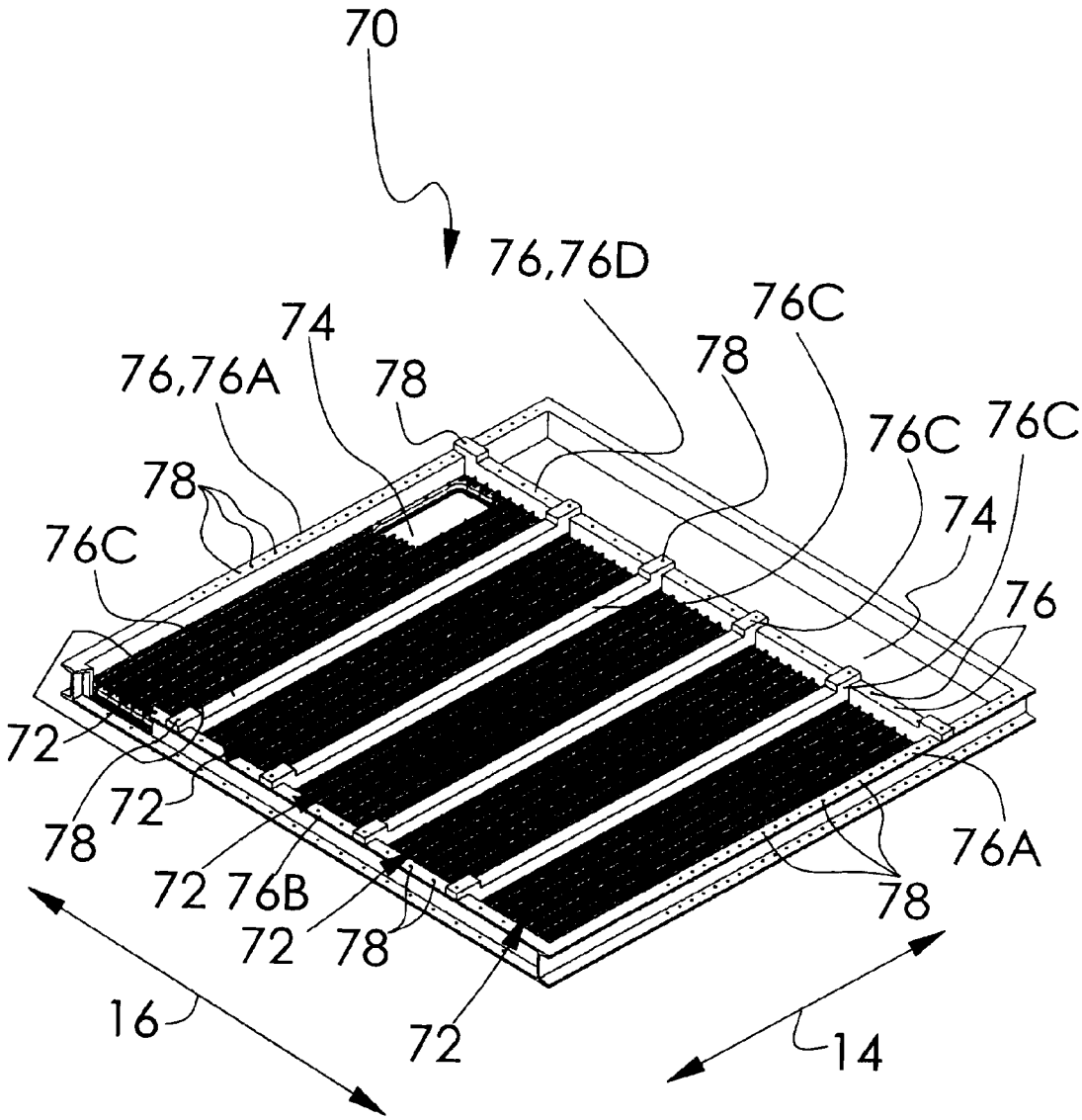
FIG. 1E is an isometric view of a table on which a plurality of wall segments are fabricated using the structure-lining apparatus of FIGS. 1A-1D.
Figure 1I:
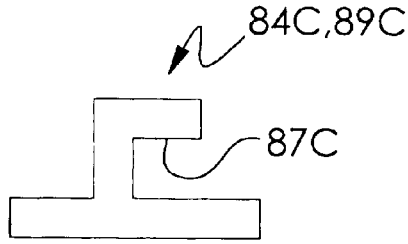
FIGS. 1I-1Q are enlarged plan views of other different concrete-anchoring components suitable for use with the structure-lining apparatus of FIGS. 1A-1D.

A non-limiting example of a suitable structural form-work 70 (including horizontal table surface 74) is shown in FIG. 1E. In the illustrated embodiment, structural form-work 70 comprises a plurality of bays 72 in which a wall-lining apparatus 10 and a corresponding tilt-up wall segment 94 may be constructed. In the illustrated embodiment, each bay 72 is defined by table surface 74 and a set of vertically extending form members 76. Form members 76 may comprise materials of sufficient strength to withstand the pressure of concrete formed therein. Some of form members 76 may be integrally formed with or otherwise connected to table surface 74. Form members 76 may also additionally or alternatively be integrally formed with or connected to one another. Form members 76 and horizontal table surface 74 may be apertured at various locations 78 to facilitate adjustment of the size of bays 72 using suitable fasteners (not explicitly shown) and to facilitate adjustment of the corresponding dimensions of the resultant wall segments 94.

In some embodiments, some or all of the components of structural form-work 70 are assembled on table surface 74 after some or all of the elements of wall-lining apparatus 10 are assembled as discussed in more detail below (see block 150). For example, in the illustrated embodiment, form members 76C and 76D may be assembled after the assembly of wall-lining apparatus 10. This connection of form members 76C, 76D after assembly of wall-lining apparatus 10 may make it easier to connect the components of wall-lining apparatus 10 to one another.

In the illustrated embodiment of method 100, wall-lining apparatus 10 is assembled in blocks 120 and 130. Block 120 involves connecting panels 12 to one another using connectors 18. Block 120 may involve laying panels 12 on horizontal table surface 74 within a bay of structural form-work 70. In the FIG. 1E illustration, panels 12 are set down in a transverse (double-headed arrow 16) edge-to-edge relationship onto generally horizontal surface 74, such that their longitudinal dimension extends in the direction of double-headed arrow 14. Although not shown in the illustrated embodiment, panels 12 may be made in a number of different sizes such that they can be made to fit in bays 72 of any suitable dimension.

In particular embodiments, wall-lining apparatus 10 may comprise prefabricated panels 12 having different transverse dimensions (i.e. in the direction of double-headed arrow 16). Panels 12 may be modular in the transverse direction, such that panels 12 of various transverse sizes may be interconnected to one another using connector-type anchoring components 18 and optionally braces 28. This modularity entails that connector components 30, 32 on edges 20, 22 of panels 12 be standardized and that connector components 46 and the distance between edges 20, 22 and connector components 46 be standardized. In order to precisely fit the transverse dimension of bays 72, some panels 12 may be cut to a desired transverse width. In some panels 12, where the transverse dimension is less than the spacing between edges 20, 22 and connector components 46, panels 12 may be fabricated without connector components 46.

In some embodiments, panels 12 are prefabricated to have different longitudinal dimensions (double-headed arrow 14 of FIG. 1E). In other embodiments, the longitudinal dimensions of panels 12 may be cut to length. Panels 12 may be relatively thin in the inward/outward direction (double-headed arrow 24) in comparison to the inward/outward dimension of the resultant wall segments 94 fabricated using wall-lining apparatus 10. In some embodiments, the ratio of the inward/outward dimension of a wall segment 94 to the inward/outward dimension of a panel 12 is in a range of 10-600. In some embodiments, the ratio of the inward/outward dimension of a wall segment 94 to the inward/outward dimension of a panel 12 is in a range of 20-300.

Block 120 also involves connecting panels 12 to one another using connectors 18. Connectors 18 may be slid in a longitudinal direction 14 between edge-adjacent pairs of panels 12 such that connector components 36, 38 of connectors 18 engage corresponding connector components 30, 32 of panels 12 as discussed above. In block 130 of the illustrated embodiment, braces 28 are connected to connectors 18 and to panels 12. Braces 28 may be slid in the longitudinal direction 14A between corresponding panels 12 and connectors 18 such that connector components 44 of braces 28 engage connector components 40, 42 of connectors 18 and connector components 46 of panels 12.

In the illustrated embodiment of method 100, block 140 involves installation of the proximate sets 62, 68 of reinforcement bars 60, 66. The proximate set 62 of transversely extending reinforcement bars 60 may be slid through proximate apertures 50 in connectors 18 and through apertures 56 in braces 28. The proximate set 64 of longitudinally extending reinforcement bars 66 may then be laid atop the proximate set of 62 of transversely extending reinforcement bars 60. In some embodiments, longitudinally extending reinforcement bars 66 may be fastened to transversely extending reinforcement bars 60 using various fastening techniques as discussed above.

In the illustrated embodiment of method 100, block 150 involves further assembly of form-work 70 (if required) to prepare bays 72 for receiving liquid concrete. For example, block 150 may involve connecting form members 76C and 76D to form members 76A, 76B and/or to one another and/or to table 70. In some embodiments, which involve multiple layers of concrete, block 150 may involve assembling sufficient form members 76 to accommodate a first, proximate concrete layer 80. Additional form members can be added subsequently for receiving liquid concrete intended for subsequent, distal concrete layers.

Block 160 involves pouring concrete into structural form-work 70 over top of wall-lining apparatus 10. At some point prior to pouring concrete in block 160, wall-lining apparatus 10 is placed inside form-work 70 such that panels 12 extend along horizontal table surface 74 in longitudinal direction 14 and transverse direction 16 as shown in FIG. 1E. In the illustrated embodiment described above, blocks 120 and 130 involve assembling wall-lining apparatus 10 directly within form-work 70 such that panels 12 extend along horizontal table surface 74 as they are connected to one another. It will be appreciated that in other embodiments, wall-lining apparatus 10 may be partially or completely assembled at some other location and placed within form-work 70 such that panels 12 extend along horizontal table surface 74; and/or wall-lining assembly 10 may be partially or completely assembled and then moved to table surface 74 such that form-work 70 may be assembled around wall-lining assembly 10.

In block 160, a first, proximate layer 80 of concrete 82 (FIG. 1C) is poured into bays 72 of structural form 70. Liquid concrete 82 flows through proximate apertures 50 in connectors 18 and through apertures 56 in braces 28 to spread throughout each bay 72 as defined by form members 76. In some embodiments, the table on which wall segment 94 is formed may comprise means for vibration which can be used to help distribute liquid concrete 82 within bays 72. As shown best in FIG. 1C, proximate sets 62, 68 of reinforcing bars 60, 66 are covered by proximate concrete layer 80. Liquid concrete 82 is then allowed to solidify to form proximate concrete layer 80.

Once proximate concrete layer 80 cures, method 100 proceeds to block 170 which involves installing insulation 86. In particular embodiments, insulation 86 is provided in the form of rigid foam insulation. Non-limiting examples of suitable materials for rigid foam insulation include: expanded polystyrene, poly-urethane, poly-isocyanurate or any other suitable moisture resistant material. Pieces of insulation 86 may be installed between transversely space apart connectors 18 as shown in FIG. 1C.

In the illustrated embodiment, block 180 involves installing distal sets 64, 69 of reinforcement bars 60, 66. Distal set 64 of transversely extending reinforcement bars 60 may project through distal apertures 52 in connectors 18. Distal set 69 of longitudinally extending reinforcement bars 66 may be laid atop the distal set of 64 of transversely extending reinforcement bars 60. In some embodiments, longitudinally extending reinforcement bars 66 may be fastened to transversely extending reinforcement bars 60 using various fastening techniques as discussed above.

In block 190, a second, distal layer 88 of concrete 82 (FIG. 1C) is poured into bays 72. Liquid concrete 82 spreads through distal apertures 52 in connectors 18 to occupy bays 72 as defined by form members 76. As discussed above, the table may comprise means for vibration which can be used to help distribute liquid concrete 82 within bays 72. As shown best in FIG. 1C, distal sets 64, 69 of reinforcing bars 60, 66 are covered by distal concrete layer 88. Liquid concrete 82 is then allowed to solidify to form distal concrete layer 88.

Wall-lining apparatus 10 comprises a number of features which facilitate the bonding of wall-lining apparatus 10, and in particular structure-lining surface 26 defined by panels 12, to proximate and distal concrete layers 80, 88. These features may be referred to herein as concrete-anchoring components or, more generally, anchoring components.

One concrete-anchoring component of wall-lining apparatus 10 is connector-type concrete-anchoring component 18. Connector-type concrete-anchoring components 18 are referred to as "connector-type" because they are also used to connect edge-adjacent panels 12 to one another. More particularly, in the illustrated embodiment connector-type concrete-anchoring components comprise connector components 36, 38 for connecting to corresponding connector components 30, 32 of panels 12 and thereby connecting edge-adjacent panels 12 to one another. Each connector-type concrete-anchoring component 18 extends in inward/outward direction 24 from panels 12 into proximate concrete layer 80. Each connector-type concrete-anchoring component 18 may also extend in the longitudinal direction 14 (see FIG. 1B) and may comprise concrete-anchoring features. Such concrete-anchoring features may comprise leaves with extension in longitudinal direction 14 and transverse direction 16 (e.g. in a plane parallel to the plane panels 12) of at one or more locations spaced apart from panels 12. When liquid concrete 82 solidifies, connector-type concrete-anchoring components 18 are partially encased in the solid concrete 82 of proximate layer 80. Through connections 31 between connector-type concrete-anchoring components 18 and transversely adjacent panels 12, the encasement of connector-type concrete-anchoring components 18 helps to bond panels 12 and structure-lining surface 26 to proximate concrete layer 80.

Connector-type concrete-anchoring components 18 may comprise one or more concrete-anchoring features. In the illustrated embodiment, connector-type concrete-anchoring components 18 comprise concrete-anchoring features 79 for bonding to proximal concrete layer 80 and one or more concrete-anchoring features 90, 92 for bonding to distal concrete layer 88. In the illustrated embodiment, each of anchoring features 79, 90, 92 comprises one or more T-shaped members which have stems that extend in longitudinal direction 14 and transverse direction 16 and leaves that extend in the inward/outward directions 24. In the illustrated embodiment, concrete-anchoring features 79, 90, 92 are co-extensive with connector-type anchoring components 18 in the longitudinal direction 14, although this amount of longitudinal extension is not necessary. In the illustrated embodiment, concrete-anchoring features 79 comprise T-shaped connector components 40, 42, which, as discussed above, are also used to connect to braces 28.

Concrete-anchoring features 79, 90, 92 are encased in concrete 82 as concrete 82 cures in proximate and distal concrete layers 80, 88, thereby helping to bond connector-type anchoring components 18 and panels 12 to proximate and distal concrete layers 80, 88.

Braces 28 represent another concrete-anchoring component of wall-lining apparatus 10. Braces 28 extend from panels 12 in inward/outward direction 24 and in transverse direction 16. Braces 28 also extend in longitudinal direction 14 (see FIG. 1B). Through connections 39 (between braces 28 and connectors 18) and connections 41 (between braces 28 and panels 12), the encasement of braces 28 in concrete 82 helps to bond panels 12 and structure-lining surface 26 to proximate concrete layer 80. Braces 28 may be referred to as "connectable-type" concrete-anchoring components because they are connectable to panels 12. In the illustrated embodiment, braces 28 comprise connector components 44 for connecting to corresponding connector components 46 of panels 12 at connections 41 (see FIG. 1D). It will be appreciated that a "connector-type" concrete-anchoring component (e.g. connector-type concrete-anchoring components 18 described above) represent a special case of a "connectable-type" concrete-anchoring component, wherein the connector-type anchoring component connects a pair of edge-adjacent panels 12 to one another.

Figure 1F:
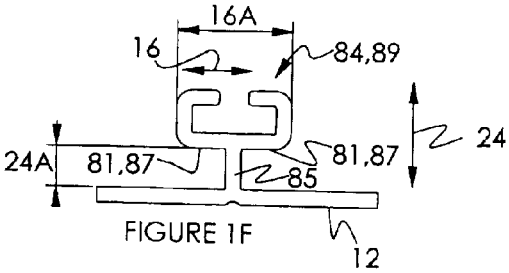
FIG. 1F is an enlarged front plan view of a concrete-anchoring component of the structure-lining apparatus of FIGS. 1A-1D.
Figure 1J:
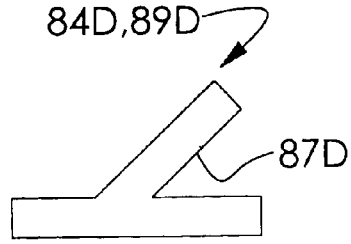

A third concrete-anchoring component of wall-lining apparatus 10 is integral-type concrete-anchoring components 84 which are referred to as "integral-type" because they are integrally formed on panels 12 between their transverse edges 20, 22 (see FIG. 1C). FIG. 1F shows a detailed front plan view of an integral-type concrete-anchoring component 84 according to a particular embodiment of the invention. Integral-type concrete-anchoring component 84 comprises one or more concrete-anchoring features 89. Concrete-anchoring features 89 may comprise concrete-anchoring surfaces 87. In the illustrated embodiment, concrete-anchoring feature 89 comprises: a stem 85 which extends from panel 12 in inward/outward direction 24 and longitudinal direction 14; and leaves 81 which extend in longitudinal direction 14 and in opposing transverse directions 16 from stem 85 at a location spaced apart from panel 12 in the inward/outward direction 24 to provide concrete-anchoring surfaces 87. In the illustrated embodiment, integral-type concrete-anchoring components 84 and their concrete-anchoring features 89 extend the entire length of panels 12 in longitudinal direction 14, although this amount of longitudinal extension is not necessary. Encasement of integral-type concrete-anchoring components 84 and their concrete-anchoring features 89 in concrete 82 helps to bond panels 12 and structure-lining surface 26 to proximate concrete layer 80.

In some embodiments, it is desirable that concrete-anchoring features 89 have a number of characteristics which assist with bonding panels 12 and structure-lining surface 26 to proximate concrete layer 80. In particular embodiments, anchoring surfaces 87 of concrete-anchoring features 89 extend in both the transverse direction 16 and the longitudinal direction 14 (e.g. in a plane parallel to the plane of panels 12) and are spaced apart from panels 12 in the inward/outward direction 24. In some embodiments, the ratio of the transverse dimension 16A of anchoring surfaces 87 to the spacing 24A of anchoring surfaces 87 from panels 12 in the inward/outward direction 24 is in a range of 0.1-10.0. In other embodiments, it is not necessary that the plane of surfaces 87 be parallel to panels 12. In such embodiments, anchoring surfaces 87 may also extend in inward/outward direction 24 and may form an angle in a range of 15°-75° with the plane of panels 12. Advantageously, concrete-anchoring features 89 may also be used as C-shaped female slidable connector components as described above.

Returning to method 100 (FIG. 2), after distal concrete layer 88 is cured, block 200 involves removing wall segment 94 from structural form-work 70 and tilting up wall segment 94 in its desired location. In particular embodiments, wall segment 94 is tilted from the generally horizontal orientation of table surface 74 into a generally vertical orientation (i.e. where longitudinal dimension 14 of wall segment 94 is oriented generally vertically) using a crane, a suitably configured hoist or the like. In some embodiments, a sling or the like may be wrapped around wall segment 94 and then hoisted to tilt wall segment 94 into its vertical orientation. In other embodiments, lifting members (not shown) may be installed into wall segment 94 for connection to a crane to facilitate tilting of wall segment into its vertical orientation. A variety of such lifting members are known in the art and may be installed in wall segment 94 during fabrication (i.e. before the concrete is permitted to solidify) or after fabrication (i.e. using a suitable drill or the like). In some embodiments, the table may itself be tiltable to tilt wall segment into its generally vertical orientation. When wall segment 94 is tilted up into its generally vertical orientation, one surface of wall segment 94 is covered by wall-lining surface 26 of stay-in-place panels 12 which are bonded to wall segment 94 as discussed above.

A wall of a building structure may be formed by tilting up a plurality of wall segments 94 in place. In the illustrated embodiment structure-lining surface 26 of stay-in-place panels 12 covers one surface of the resultant building wall formed from wall segments 94. Structure-lining surface 26 provided by panels 12 may be a finished wall surface. In some applications, such as in warehouses and box stores for example, it may be desirable to have an aesthetically pleasing finished surface 26 on the exterior of a building, whereas the finish of the interior wall surface is relatively less important. In such applications, wall segments 94 can be tilted up such that panels 12 are oriented toward the exterior of the building. In other applications, such as where hygiene of the interior of a structure is important (e.g. food storage) or for storage of liquids (e.g. in tanks), it may be desirable to have a non-porous structure-lining surface 26 on the interior of the walls of a structure, whereas the finish of the exterior wall surface is relatively less important. In such applications, wall segments 94 can be tilted up such that panels 12 are oriented toward the interior of the structure.

Both wall-lining apparatus 10 and method 100 described above represent a particular embodiment of the invention. There can be many variations to wall-lining apparatus 10 and to method 100 for using a wall-lining apparatus 10 to line wall segments 94 during fabrication which should be considered to form part of the invention. A number of these variations are described in more detail below.

The use of reinforcement bars 60, 66 in wall-lining apparatus 10, wall segments 94 and method 100 is optional. In some applications, there is no need for any reinforcement bars 60, 66. Reinforcement bars 60, 66 can have spacings different than those shown and described above. In some applications, only proximate sets 62, 68 of reinforcement bars may be required. In other applications, only distal sets 64, 49 of reinforcement bars may be required. In still other embodiments, transversely extending reinforcement bars 60 may be used in one or both of proximate and distal concrete layers 80, 88. Longitudinally extending reinforcement bars 66 may additionally or alternatively be used in one or both of proximate and distal concrete layers 80, 88. In some applications, where the layers of concrete 80, 88 and insulation 86 are ordered differently (i.e. relative to panels 12), reinforcement bars 60, 66 may have still other configurations.

The inclusion of insulation 86 and the use of multiple concrete layers 80, 88 in wall segments 94 and method 100 are optional. In some applications, insulation 86 is not used. In such applications, distal and proximate sets 62, 64, 68, 69 of reinforcement bars 60, 66 (if present) may be installed in a single step and liquid concrete 82 can be poured in a single layer. In some embodiments, insulation 86 may be provided at a different location within wall segments 94. For example, insulation 86 may be installed in the location of distal concrete layer 88 shown in FIGS. 1A-1C. In such applications, proximate concrete layer 80 may extend in the inward/outward direction from panels 12 to the level of occupied by insulation 86 in FIGS. 1A-1C. In still other embodiments, described in more detail below, insulation 86 may be provided at a location proximate to panels 12 and structure-lining surface 26 and concrete 82 may be poured atop insulation 86 (i.e. insulation may be located between panels 12 and the proximate layer of concrete).

Figure 1G:
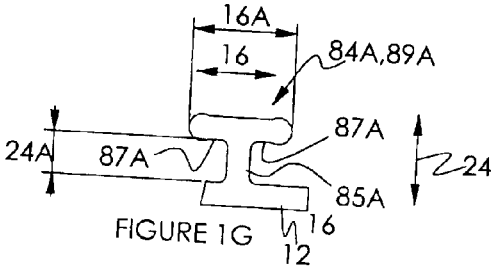
FIG. 1G is an enlarged front plan view of a different concrete-anchoring component suitable for use with the structure-lining apparatus of FIGS. 1A-1D.

As discussed above, integral-type concrete-anchoring components 84 comprise concrete-anchoring features 89 (see FIG. 1F). A large number of modifications are possible in relation to these concrete-anchoring features 89. FIG. 1G shows an integral-type anchoring component 84A according to another embodiment of the invention. Concrete-anchoring component 84A comprises T-shaped concrete-anchoring features 89A similar to concrete-anchoring features 79, 90, 92 on connectors 18. Concrete-anchoring features 89A extend from panels 12 in longitudinal direction 14 and inward/outward direction 24 on stem 85A and then, at a location spaced apart from panels 12 in the inward/outward direction 24, concrete-anchoring features 89A extend in longitudinal direction 14 and transverse direction 16 from stem 85A to provide leaves having anchoring surfaces 87A. Concrete-anchoring surfaces 87A may be substantially parallel with panels 12, although this is not necessary. In the illustrated embodiment, concrete-anchoring features 89A are co-extensive with panels 12 in the longitudinal direction 14, although this amount of longitudinal extension is not necessary. As with anchoring features 89 described above (FIG. 1F), concrete-anchoring features 89A may be shaped such that the ratio of the transverse dimension 16A of anchoring surfaces 87A to the spacing 24A of anchoring surfaces 87A from panels 12 in the inward/outward direction 24 is in a range of 0.1-10. Advantageously, concrete-anchoring features 89A may also be used as T-shaped male slidable connector components as described above.

In some applications, the concrete-anchoring features of integral-type concrete-anchoring components may have other shapes. In particular embodiments, the concrete-anchoring features of integral-type concrete-anchoring components extend from panels 12 in longitudinal direction 14 and inward/outward direction 24 and then, at a location spaced apart from panel 12, the concrete-anchoring features extend in the longitudinal and transverse directions 14, 16 so as to provide one or more anchoring surface(s) which help to bond panels 12 to proximate concrete layer 80. That is, the anchoring surfaces extend in the transverse direction 16 and the longitudinal direction 14 at locations spaced apart from panels 12 in the inward/outward direction 24. The anchoring surfaces may be generally parallel to the longitudinal and transverse plane of panels 12, although this is not necessary. In other embodiments, anchoring surfaces 87 may also extend in inward/outward direction 24 and may form an angle in a range of 15°-75° with the plane of panels 12.

Figure 1H:
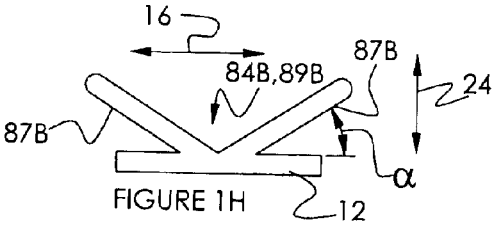
FIG. 1H is an enlarged front plan view of a different concrete-anchoring component suitable for use with the structure-lining apparatus of FIGS. 1A-1D.
Figure 1K:
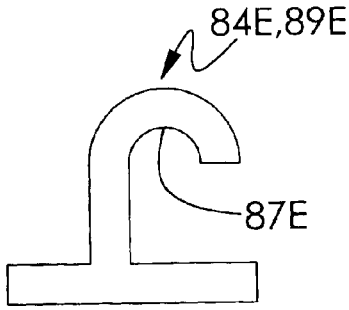
Figure 1L:
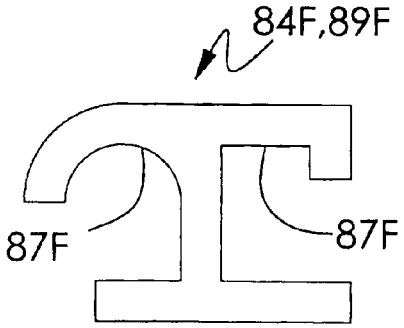
Figure 1O:
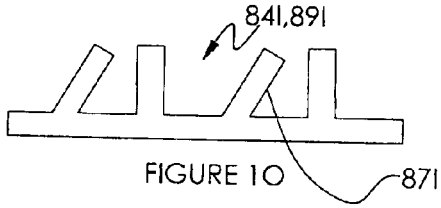
Figure 1M:
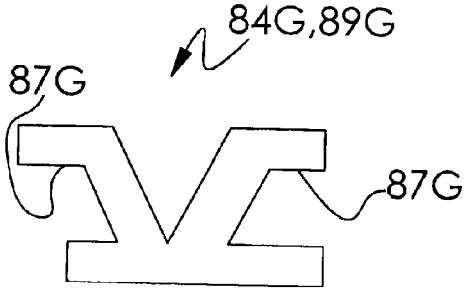
Figure 1P:
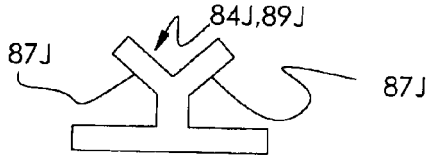
Figure 1Q:
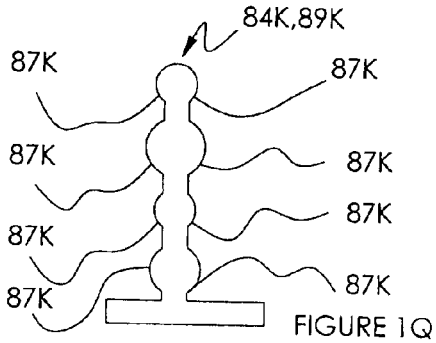
Figure 1N:
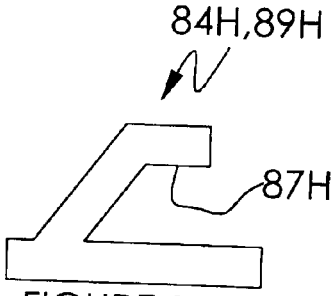

In some embodiments, it is not necessary that the entirety of the anchoring surfaces be spaced apart from panels 12. FIG. 1H schematically depicts an integral-type concrete-anchoring component 84B according to another embodiment of the invention having concrete-anchoring features 89B. Concrete-anchoring features 89B incorporate anchoring surfaces 87B which simultaneously extend in transverse directions 16, in inward/outward direction 24 and in longitudinal direction 27. Concrete-anchoring features 89B may be shaped such that the angle α between anchoring surfaces 87B and panel 12 is in a range of 15°-75°.

FIGS. 1I-1Q schematically depict further embodiments of integral-type concrete-anchoring components 84C-84K and their corresponding concrete-anchoring features 89C-89K and anchoring surfaces 87C-87K suitable for use with the structure-lining apparatus disclosed herein. Those skilled in the art will appreciate that there are many further variations which could be made to integral-type concrete-anchoring components 84 and their corresponding concrete-anchoring features 89.

In some embodiments, each panel 12 may be provided with a plurality of transversely spaced apart integral-type concrete-anchoring components 84. In some applications, integral-type concrete-anchoring components 84 are not necessary on panels 12, where the bonding action between proximate concrete layer 80 and panels 12 may be provided by connector-type anchoring components 18 (and anchoring features 90, 92 on connector-type anchoring components 18) and/or connectable-type concrete-anchoring components which are connected to panels 12 (e.g. braces 28 which are connected to panels 12 at connections 31, 41).

In the illustrated embodiment of FIGS. 1A-1D, concrete-anchoring features 79, 90, 92 on connector-type anchoring components 18 are substantially similar to concrete-anchoring features 89A (FIG. 1G), except that concrete-anchoring features 79, 90, 92 are rotated by 90° and extend from the transverse sides of connector-type anchoring components 18 rather than panels 12. In general, connector-type concrete-anchoring components 18 may comprise one or more concrete-anchoring features which are similar to (and include the characteristics of) any of the concrete-anchoring features 89 described herein for integral-type concrete-anchoring components 84. For example, the concrete-anchoring features 79, 90, 92 of connector-type concrete-anchoring components 18 may be substantially similar to any of concrete-anchoring features 89-89K shown in FIG. 1F-1Q. The rotation of the concrete-anchoring features on connector-type concrete-anchoring components 18 is not necessary. In other embodiments, the concrete-anchoring features on connector-type concrete-anchoring components 18 may be oriented in the same direction as the concrete-anchoring features 89 of integral-type concrete-anchoring components 84 and may extend, for example, from an innermost extent of connector-type concrete-anchoring components 18 in the inward/outward direction 24. In some applications, connectors 18 do not require concrete-anchoring components.

Although not shown in the illustrated embodiment of FIGS. 1A-1D, connectable-type concrete-anchoring components (e.g. braces 28) may also be provided with concrete-anchoring features similar to any of concrete-anchoring features 89 of integral-type concrete-anchoring components 84 described herein (e.g. concrete-anchoring features 89-89K shown in FIG. 1F-1Q). The concrete-anchoring features on connectable-type concrete-anchoring components may have the same orientations as the concrete-anchoring features of integral-type concrete-anchoring components or may be suitably rotated.

The inclusion of braces 28 in wall segments 94 of method 100 is optional. In some embodiments, braces 28 may be excluded completely. In other embodiments, braces 28 may be used, but need not be used for every connector 18. In some embodiments, braces 28 may be used on one side of particular connectors 18 and, optionally, on the other side of other particular connectors 18. In embodiments where braces 28 are not used, connector components 40, 42 on connectors 18 and connector components 46 on panels 12 may also be removed or may be maintained to act as additional concrete-anchoring features to bond connector-type anchoring components 18 and panels 12 to proximate concrete layer 80.

Figure 3A:
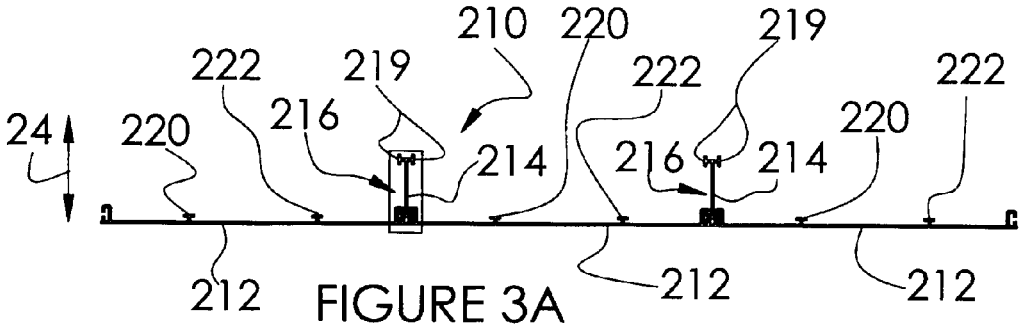
FIGS. 3A, 3B and 3C respectively depict a front plan view, an isometric view and an enlarged partial front plan view of a structure-lining apparatus suitable for use in lining a wall segment during fabrication according to a particular embodiment of the invention.
Figure 3B:
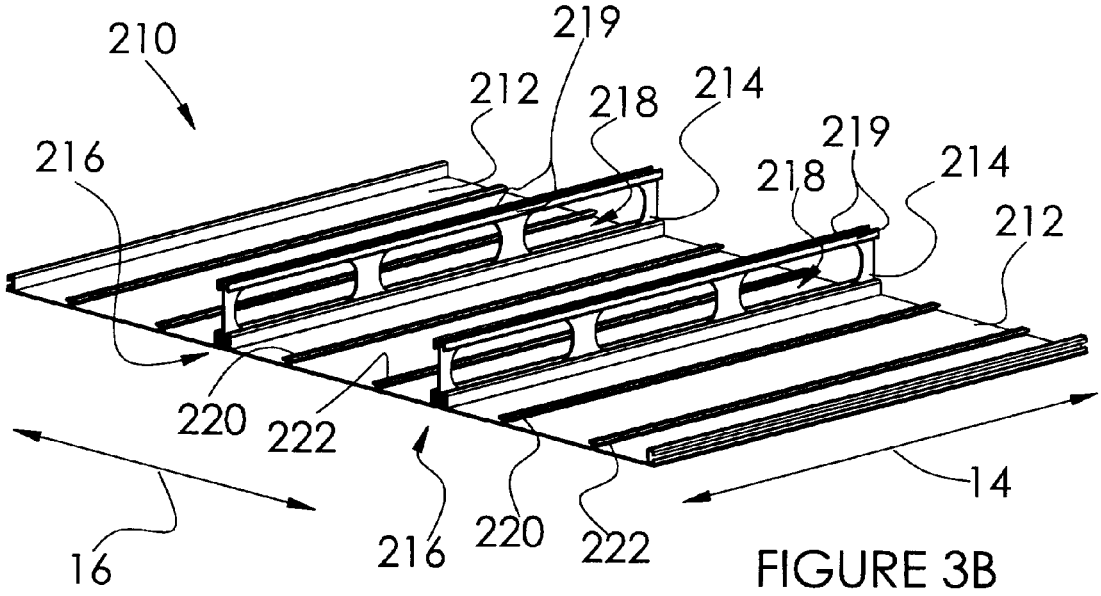
Figure 3C:
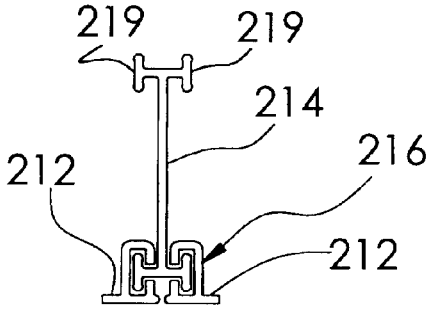

FIGS. 3A, 3B and 3C respectively depict a side plan view, an isometric view and an enlarged partial side plan view of a wall-lining apparatus 210 suitable for use to line a wall segment during fabrication according to another embodiment of the invention. In many respects, wall-lining apparatus 210 is similar to wall-lining apparatus 10 described above. Wall-lining apparatus 210 comprises panels 212 and connector-type concrete-anchoring components 214 (also referred to occasionally herein as connectors 214). Like wall-lining apparatus 10 described above, panels 212 line are used to line at least one surface of a structural form prior to the application of concrete and connectors 214 are used to connect transversely adjacent panels 212 at connections 216 which are substantially similar to connections 31 of wall-lining apparatus 10. Connector-type concrete-anchoring components 214 differ from connector-type concrete-anchoring components 18 of wall-lining apparatus 10 in that connector-type concrete-anchoring components 214 do not extend as far into the wall segment in the inward/outward direction 24 and connectors 214 only comprises one set of apertures 218 and one set of concrete-anchoring features 219. Concrete-anchoring features 219 on connectors 214 are similar to concrete-anchoring features 79, 90, 92 on connectors 18 of wall-lining apparatus 10 and may be varied or modified in any of the manners described herein for such concrete-anchoring features.

Panels 212 of FIGS. 3A, 3B, 3C differ from panels 12 of wall-lining apparatus 10 in that each panel 212 comprises a plurality of transversely spaced apart integral-type concrete-anchoring components 220, 222. Each integral-type concrete-anchoring component 220, 222 of panels 212 has a T-shaped concrete-anchoring features similar to concrete-anchoring features 89A of concrete-anchoring component 84A of FIG. 1G. In general, integral-type concrete-anchoring components 220, 222 and their corresponding concrete-anchoring features may be varied or modified in any of the manners described herein for integral-type concrete-anchoring components (e.g. integral-type concrete-anchoring components 84-84K of FIGS. 1F-1Q) and their corresponding concrete-anchoring features (e.g. concrete-anchoring features 89-89K of FIGS. 1F-1Q).

In the illustrated embodiment, wall-lining apparatus 210 does not include braces. However, it will be appreciated that integral-type concrete-anchoring components 220, 222 of panels 212 and concrete-anchoring features 219 of connectors 214 provide connector components to which braces similar to braces 28 of wall-lining apparatus 10 could be connected. In some embodiments, other forms of connectable concrete-anchoring components (described in more detail below) could be connected to integral-type concrete-anchoring components 220, 222 of panels 212.

The use of wall-lining apparatus 210 to line a wall segment during fabrication is similar in many respects to method 100 for wall-lining apparatus 10. In particular embodiments, panels 212 are laid into a structural form-work 70 (so as to line form-work 70) and are connected to one another using connectors 214 in a manner similar to that of blocks 110 and 120 of method 100. If braces and/or reinforcement bars are used in wall-lining apparatus 210, then braces may be installed in a manner similar to that of block 130 and reinforcement bars may be installed in a manner similar to that of block 140. Form members 76 may be assembled in a manner similar to that of block 150 and concrete may be poured in a manner similar to that of block 160. In some applications, using wall-lining apparatus 210 may involve only a single layer of concrete, in which case the use of wall-lining apparatus 210 may skip directly to a tilting up procedure similar to block 200. In other applications, using wall-lining apparatus 210 may involve installing multiple layers of concrete and insulation prior to tilting up the wall segment. For example, using wall-lining apparatus 210 may comprise installing a proximate layer of concrete (similar to block 160), installing a layer of insulation (similar to block 170) and installing a distal layer of concrete (similar to block 190). Each layer of concrete and insulation may be thinner in the inward/outward direction 24 when compared to the layers of wall-lining apparatus 10.

Any of the above-described variations or modifications to method 100 may also be incorporated into the method for using wall-lining apparatus 210 to line wall segments during fabrication. By way of non-limiting example, a layer of insulation may be applied directly adjacent to panels 212 (i.e. prior to pouring liquid concrete atop wall-lining apparatus 210) and then concrete may be poured atop the insulation. Concrete-anchoring features 219 on connectors 214 may then bond wall-lining apparatus 210 to the resultant concrete layer that is spaced apart from panels 212.

Figure 4A:
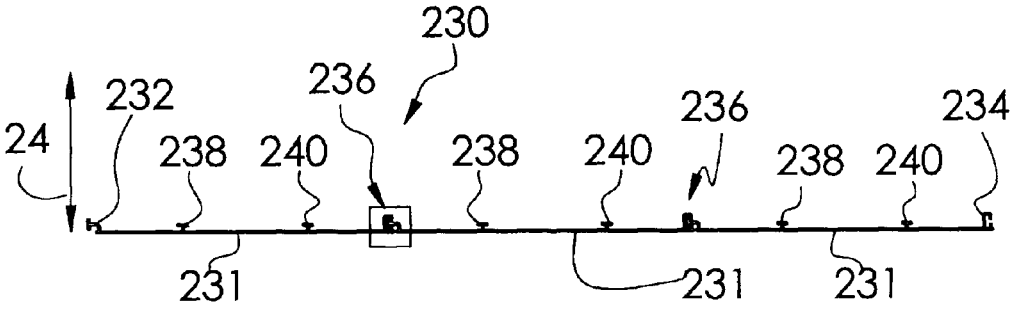
FIGS. 4A, 4B and 4C respectively depict a front plan view, an isometric view and an enlarged partial front plan view of a structure-lining apparatus suitable for use in lining a wall segment during fabrication according to a particular embodiment of the invention.
Figure 4B:
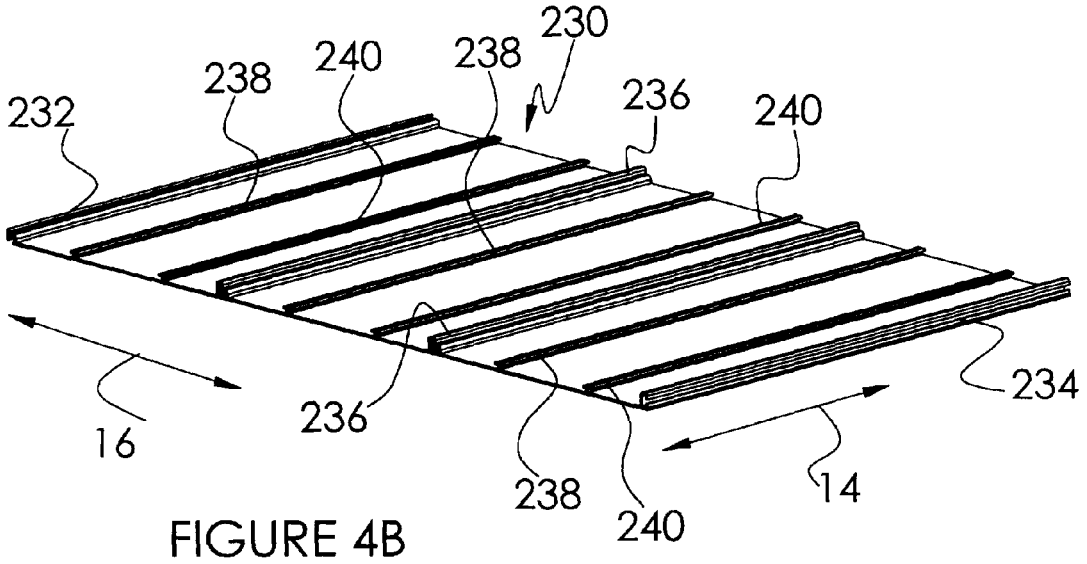
Figure 4C:
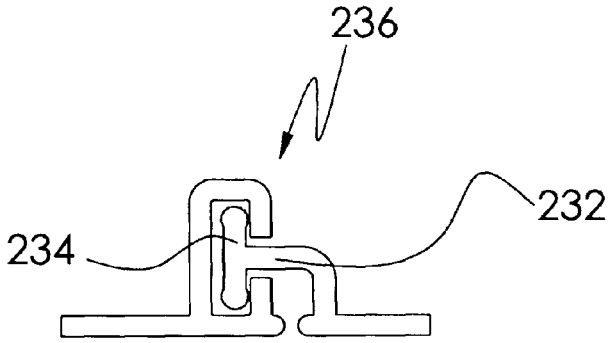

FIGS. 4A, 4B and 4C respectively depict a side plan view, an isometric view and an enlarged partial side plan view of a wall-lining apparatus 230 suitable for use to line wall segments during fabrication according to another embodiment of the invention. Wall-lining apparatus 230 comprises panels 231. Wall-lining apparatus 230 does not include connector-type anchoring components or braces. Transversely adjacent panels 231 are directly connected to one another at their transversely adjacent edges by connections 236. As shown best in FIG. 4C, in the illustrated embodiment, connections 236 are formed by T-shaped male connector components 232 and female C-shaped connector components 234 on opposing transverse edges of panels 231. Transversely adjacent panels 231 are connected to one another by sliding panels 231 relative to one another in the longitudinal direction 14 such that male connector components 232 extend into female connector components 234 to form connections 236. It will be appreciated that connector components 232, 234 represent only one set of suitable connector components which could be used to connect panels 231 in edge-adjacent relationship and that many other types of connector components could be used in place of connector components 232, 234.

Panels 231 comprise a plurality of transversely spaced apart integral-type anchoring components 238, 240. Concrete-anchoring components 238, 240 may be substantially similar to integral-type concrete-anchoring components 220, 222 of wall-lining apparatus 210 described above and may incorporate similar features, variations and modifications.

The use of wall-lining apparatus 230 to line a wall segment during fabrication is similar in some respects to method 100 for wall-lining apparatus 10. Panels 231 are laid into a form-work 70 (so as to line form-work 70) and are slidably connected to one another as discussed above. Although wall-lining apparatus 230 does not have any specific features for accommodating reinforcement bars, reinforcement bars may be used in accordance with conventional wall forming techniques. Form members 76 may be assembled in a manner similar to that of block 150 and concrete may be poured in a manner similar to that of block 160. The illustrated embodiment of wall-lining apparatus 230 is typically used with a single layer of concrete, in which case the use of wall-lining apparatus 230 may skip directly to a tilting up procedure similar to block 200. In other applications, using wall-lining apparatus 230 may involve installing multiple layers of concrete and insulation prior to tilting up the wall segment. For example, using wall-lining apparatus 230 may comprise installing a proximate layer of concrete (similar to block 160), installing a layer of insulation (similar to block 170) and installing a distal layer of concrete (similar to block 190). In such applications, it may be desirable to provide one or more connectable-type concrete-anchoring components (described in more detail below) to extend in inward/outward direction 24 between panels 231 and the distal concrete layer(s) and/or to provide one or more connectable-type insulation-anchoring components (described in more detail below) to connect panels 231 to the insulation layer. Any of the variations or modification to method 100 described herein may also be incorporated into the method for using wall-lining apparatus 230 to line wall segments during fabrication.

Figure 5A:
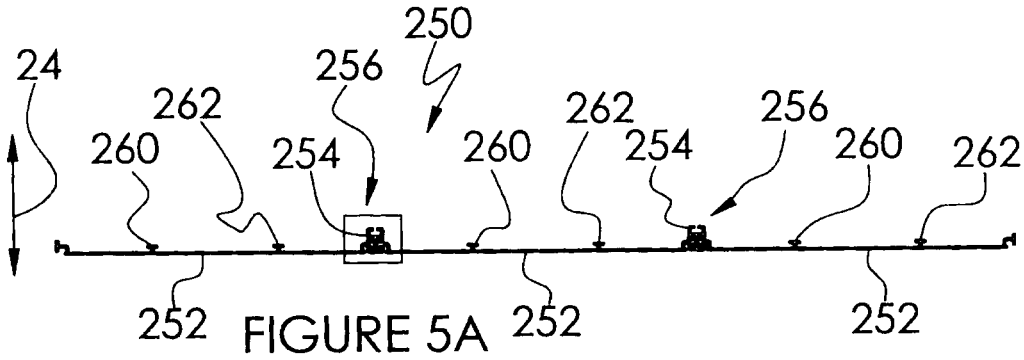
FIGS. 5A, 5B and 5C respectively depict a front plan view, an isometric view and an enlarged partial front plan view of a structure-lining apparatus suitable for use in lining a wall segment during fabrication according to a particular embodiment of the invention.
Figure 5B:
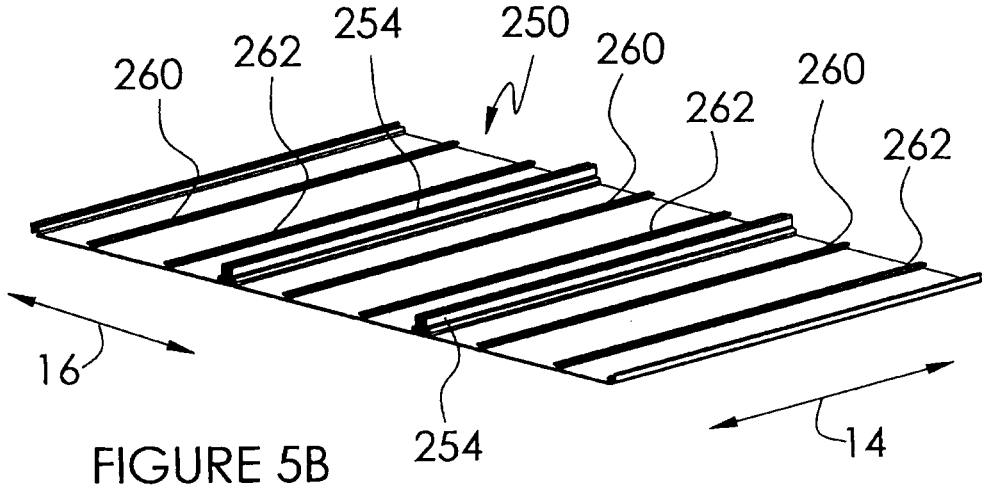
Figure 5C:
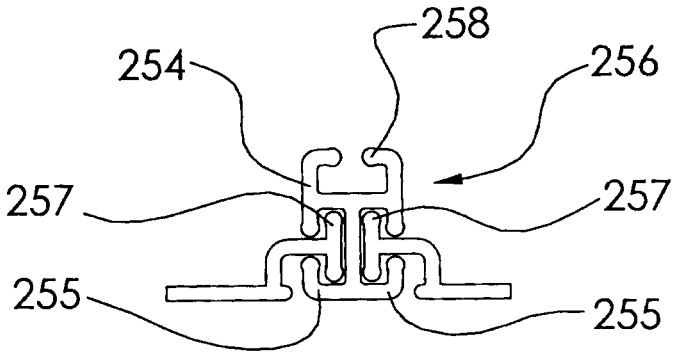

FIGS. 5A, 5B and 5C respectively depict a side plan view, an isometric view and an enlarged partial side plan view of a wall-lining apparatus 250 suitable for use to line wall segments during fabrication according to another embodiment of the invention. Wall-lining apparatus 250 comprises panels 252 and connector-type anchoring components 254 (referred to occasionally herein as connectors 254). Like wall-lining apparatus 10 discussed above, connectors 254 are used to connect transversely adjacent panels 252 in edge-to-edge relationship at connections 256. Connections 256 between panels 252 and connectors 254 are similar to connections 31 between panels 12 and connectors 18 of wall-lining apparatus 10, except that connectors 254 incorporate a pair of female connector components 255 and panels 252 incorporate male connector components 257 at each of their transverse edges. In the illustrated embodiment, female connector components 255 of connectors 254 are C-shaped and male connector components 257 of panels 252 are T-shaped. Connections 256 between panels 252 and connectors 254 may be made by sliding panels 252 and connectors 254 relative to one another in the longitudinal direction 14.

Connectors 254 also differ from connectors 18 of wall-lining apparatus 10 in that connectors 254 do not extend as far in the inward/outward direction 24. However, connectors 254 provide a connector component 258 (FIG. 5C) to which additional concrete-anchoring components and/or insulation-anchoring components (not shown) may be connected if desired to extend from connector component 258 in the inward/outward direction 24. Connectable-type concrete-anchoring components and insulation-anchoring components are described in more detail below.

Panels 252 comprise a plurality of transversely spaced apart integral-type concrete-anchoring components 260, 262. Concrete-anchoring components 260, 262 may be substantially similar to integral-type concrete-anchoring components 220, 222 of wall-lining apparatus 210 described above and may incorporate similar features, variations and modifications.

In the illustrated embodiment, wall-lining apparatus 210 does not include braces. However, if additional members were to be connected to connector components 258 of connectors 254, then it will be appreciated that braces similar to braces 28 of wall-lining apparatus 10 could be provided and could connect to anchoring components 260, 262 of panels 252 and to corresponding connector components on the additional members.

The use of wall-lining apparatus 250 to line a wall segment during fabrication is similar in many respects to method 100 for wall-lining apparatus 10. In particular, panels 252 are laid into a form-work 70 (so as to line form-work 70) and are connected to one another using connectors 254 in a manner similar to that of blocks 110 and 120. If additional connectable-type concrete-anchoring components or insulation-anchoring components are used in wall-lining apparatus 250, then such additional components are connected to connector components 258 of connectors 254 by sliding the additional members relative to connectors 254 in the longitudinal dimension 14. If braces and/or reinforcement bars are used in wall-lining apparatus 250, then braces may be installed in a manner similar to that of block 130 and reinforcement bars may be installed in a manner similar to that of block 140. Form members 76 may be assembled in a manner similar to that of block 150 and concrete may be poured in a manner similar to that of block 160. In some applications, using wall-lining apparatus 250 may involve only a single layer of concrete, in which case the use of wall-lining apparatus 250 may skip directly to a tilting up procedure similar to block 200. In other applications, using wall-lining apparatus 250 may involve installing multiple layers of concrete and insulation prior to tilting up the wall segment. For example, using wall-lining apparatus 250 may comprise installing a proximate layer of concrete (similar to block 160), installing a layer of insulation (similar to block 170) and installing a distal layer of concrete (similar to block 190). In such applications, it is desirable to have a one or more connectable-type concrete-anchoring components that extend from connectors 254 in inward/outward direction 24 between distal and proximate concrete layers. Any of the variations or modifications to method 100 described herein may also be incorporated into the method for using wall-lining apparatus 250 to line wall segments during fabrication.

Figure 6A:
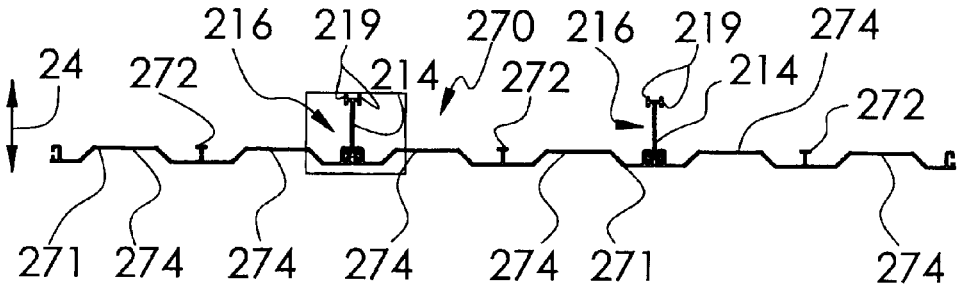
FIGS. 6A, 6B and 6C respectively depict a front plan view, an isometric view and an enlarged partial front plan view of a structure-lining apparatus suitable for use in lining a wall segment during fabrication according to a particular embodiment of the invention.
Figure 6B:
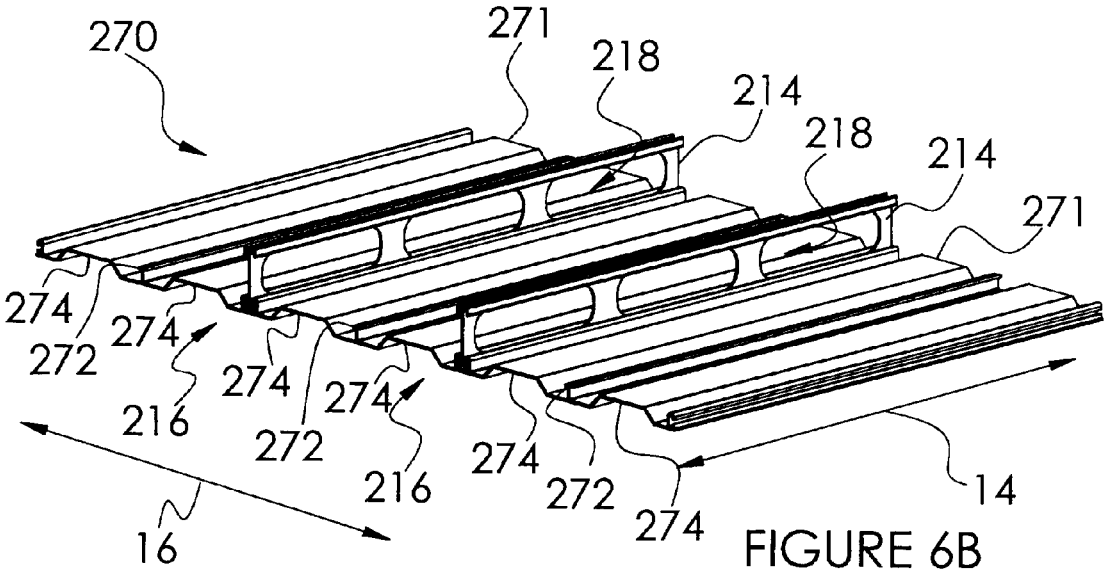
Figure 6C:
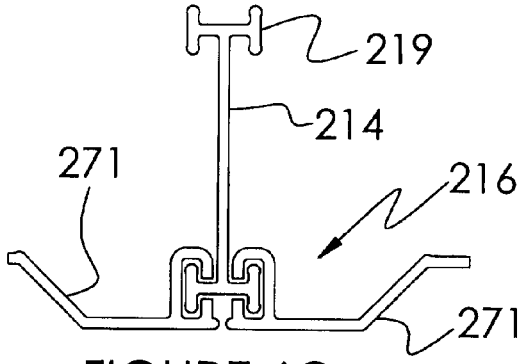

FIGS. 6A, 6B and 6C respectively depict a side plan view, an isometric view and an enlarged partial side plan view of a wall-lining apparatus 270 suitable for use to line wall segments during fabrication according to another embodiment of the invention. Wall-lining apparatus 270 comprises panels 271 and connector-type anchoring components 214. Wall-lining apparatus 270 is similar in many respects to wall-lining apparatus 210 (FIGS. 3A, 3B, 3C). In particular, connector-type anchoring components 214 are substantially similar to connector-type anchoring components 214 of wall-lining apparatus 210 and are used to connect transversely adjacent panels 271 at connections 216. Panels 271 of wall-lining apparatus 270 differ from panels 212 in that panels 271 comprise corrugations (or ribs) 274 which extend in the inward/outward direction 24 to provide the resultant wall surface with a corrugated profile. This corrugated profile may provide some structural advantages. In some alternative embodiments, corrugations 274 may be replaced with other non-flat profiles.

In the illustrated embodiment, each panel 271 of wall-lining apparatus 270 comprises a single integral-type concrete-anchoring component 272. In the illustrated embodiment, integral-type concrete-anchoring component 272 is substantially similar to integral-type concrete-anchoring component 84A (FIG. 1G). In general, integral-type concrete-anchoring component 272 may be modified or varied in any of the manners described herein for integral-type concrete-anchoring components (e.g. integral-type concrete-anchoring components 84-84K) and their corresponding concrete-anchoring features (e.g. concrete-anchoring features 89-89K of FIGS. 1F-1Q).

In other respects, wall-lining apparatus 270 and the use of wall-lining apparatus 270 to fabricate wall segments are similar to wall-lining apparatus 210 and the use of wall-lining apparatus 210 to fabricate wall segments.

Figure 7A:
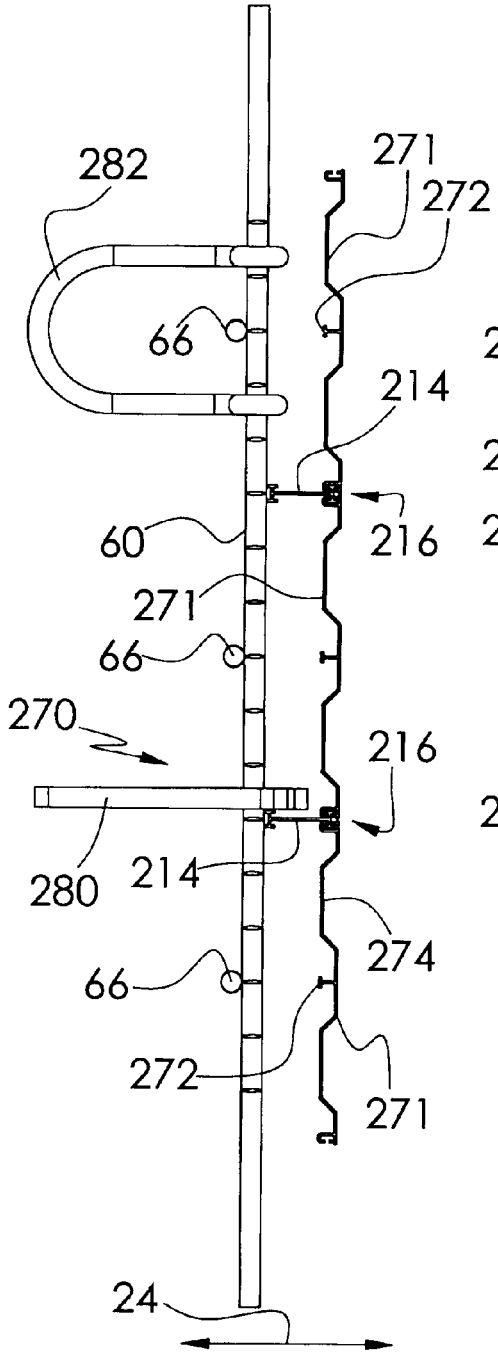
FIGS. 7A, 7B respectively depict front plan and isometric views of a structure-lining apparatus which incorporates a number of different lifting components which may be used to tilt up wall segments in particular embodiments of the invention.
Figure 7B:
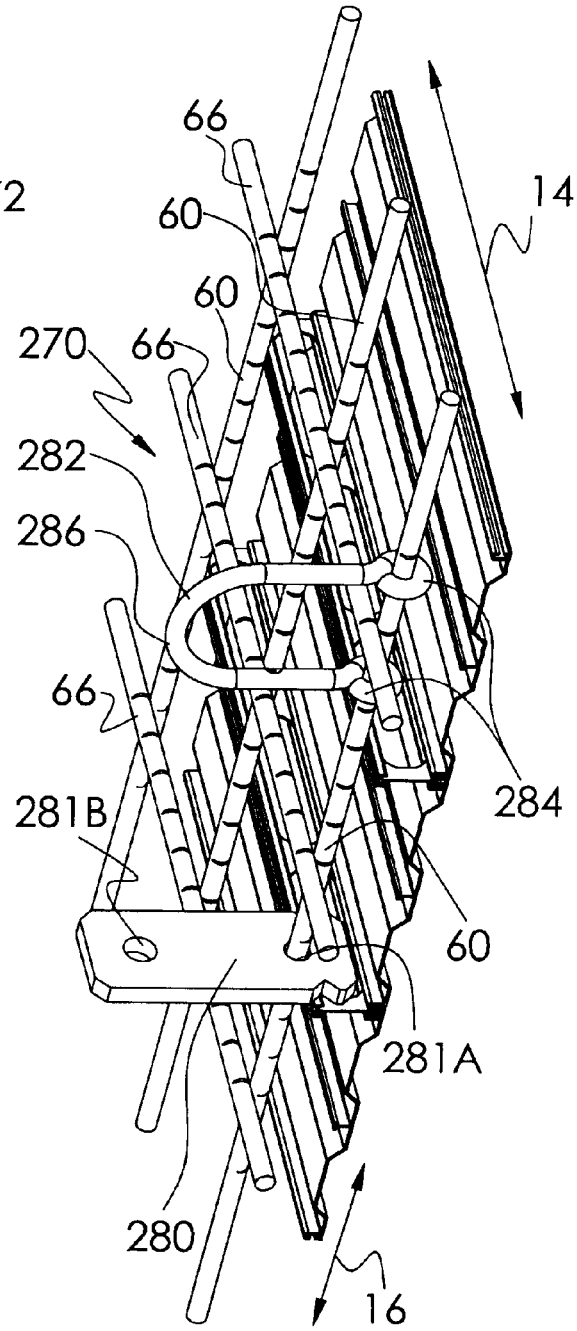

FIGS. 7A, 7B respective depict front plan and isometric views of wall-lining apparatus 270 which includes a plurality of longitudinally spaced apart, transversely extending reinforcement bars 60 and a plurality of transversely spaced apart, longitudinally extending reinforcement bars 66. In the illustrated embodiment, transversely extending reinforcement bars 60 lie atop connectors 214 during fabrication of the wall segment. Longitudinally extending reinforcement bars 66 may be laid atop transversely extending reinforcement bars 66 and may be connected thereto by suitable fastening techniques as discussed above. In the illustrated embodiment, a number of lifting components 280 and 282 are provided. Lifting components 280, 282 may be used to help move the wall segments (e.g. tilt the wall segments into place) once the concrete has solidified (i.e. to perform block 200 of method 100). Two different lifting components 280, 282 are shown in FIGS. 7A, 7B for the purposes of explanation.

Lifting component 280 may be fabricated from metallic alloys, fiberglass, organic or synthetic fiber or any other suitable materials. Lifting component 280 comprises a pair of apertures 281A, 281B. In the illustrated embodiment, one transversely extending reinforcement bar 60 extends through aperture 281A. In other embodiments, a longitudinally extending reinforcement bar 66 may extend through aperture 281A. When concrete is poured into wall-lining apparatus 270, a portion of lifting component 280 protrudes in the inward/outward direction 24 from the concrete, such that aperture 281B is exposed. A crane, hoist or the like can then connect to lifting component 280 through exposed aperture 281B to facilitate movement (e.g. tilting) of the resultant wall segment.

Lifting component 282 may be fabricated from metallic alloys, fiberglass, organic or synthetic fiber or any other suitable materials. Lifting component 282 is a horseshoe-shaped component with a pair of apertures 284 on its respective legs. In the illustrated embodiment, one transversely extending reinforcement bar 60 extends through apertures 284. In other embodiments, a longitudinally extending reinforcement bar 66 may extend through apertures 284. When concrete is poured into wall-lining apparatus 270, the legs of horseshoe-shaped lifting component 282 are encased in concrete, but an interior portion 286 of lifting component 284 protrudes in the inward/outward direction 24 from the concrete. A crane, hoist or the like can then connect to lifting component 282 through its exposed interior portion 286 to facilitate movement (e.g. tilting) of the resultant wall segment.

There are many variations of lifting components known to those skilled in the art of fabrication and use of tilt-up walls. Any of these lifting components may be used in accordance with the structure-lining apparatus disclosed herein.

Figure 8A:
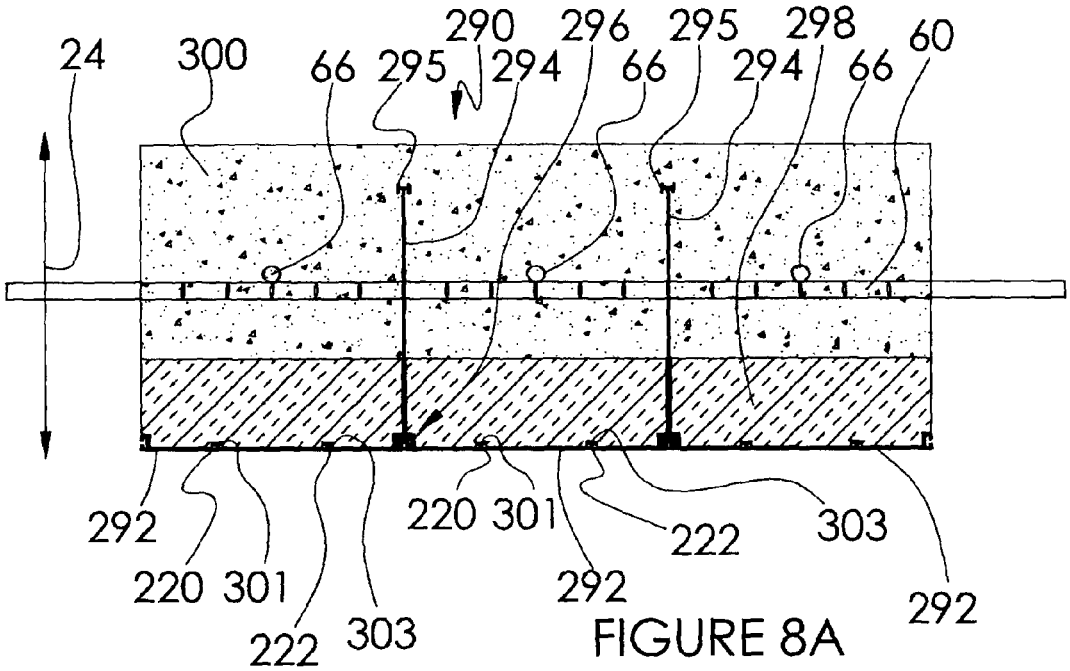
FIGS. 8A, 8B respectively depict front plan and isometric views of a structure-lining apparatus suitable for use in lining a wall segment during fabrication according to a particular embodiment of the invention.
Figure 8B:
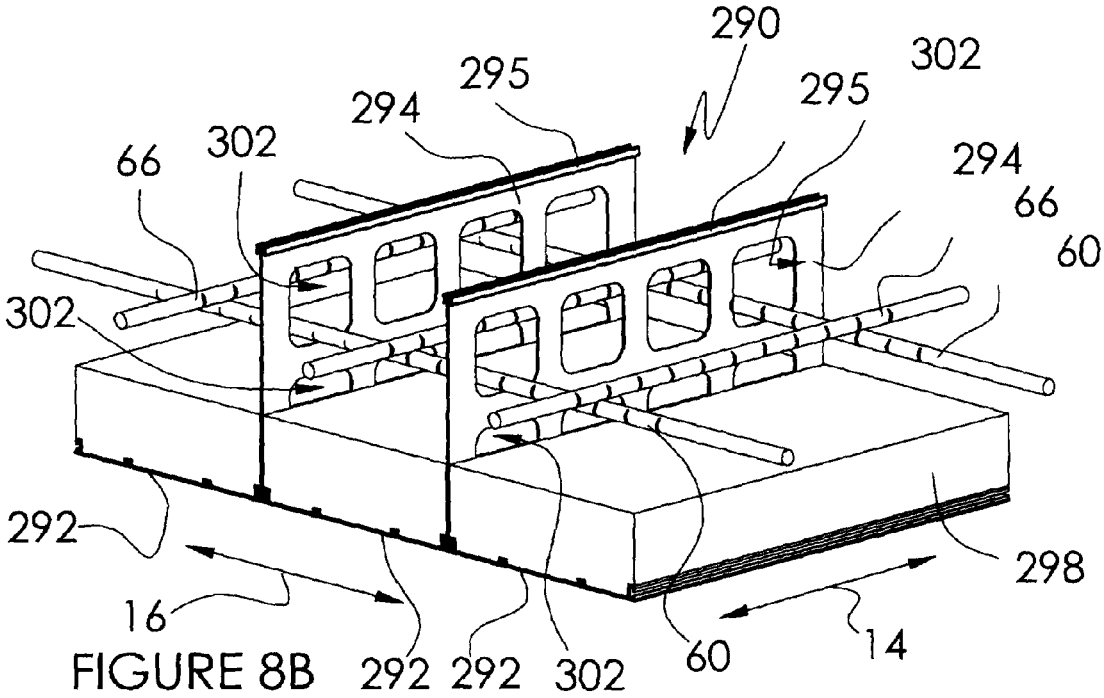

FIGS. 8A, 8B respective depict front plan and isometric views of wall-lining apparatus 290 which may be used to line wall segments during fabrication according to another embodiment of the invention. Wall-lining apparatus 290 comprises panels 292 which are substantially similar to panels 212 of wall-lining apparatus 210 (FIGS. 3A, 3B, 3C). Transversely adjacent panels 292 are connected in edge-to-edge relationship by connector-type anchoring components 294 (referred to occasionally herein as connectors 294) at connections 296 which are substantially similar to connections 216 of wall-lining apparatus 210. Connectors 294 comprise apertures 302 which allow concrete to flow therethrough. Connectors 294 also comprise concrete-anchoring features 295 that are similar to concrete-anchoring features 79, 90, 92 of wall-lining apparatus 10 (FIGS. 1A, 1B, 1C). Wall-lining apparatus 290 also includes a plurality of longitudinally spaced apart, transversely extending reinforcement bars 60 and a plurality of transversely spaced apart, longitudinally extending reinforcement bars 66.

Wall-lining apparatus 290 differs from the previously illustrated embodiments in that insulation 298 is located directly adjacent panels 292 during fabrication and then concrete 300 is poured on top of insulation 298. Channels 301, 303 may be formed in insulation to accommodate concrete-anchoring components 220, 222 on panels 292. In other embodiments, concrete-anchoring components 220, 222 may be removed from panels 292 if it is desired to have insulation 298 directly adjacent panels 292. In other embodiments, connectable-type insulation-anchoring components (explained further below) may be connected to concrete-anchoring components 220, 222 if it is desired to have insulation 298 directly adjacent panels 292. In still other embodiments, integral-type concrete-anchoring components 220, 222 may be replaced with integral-type insulation-anchoring components (explained further below) if it is desired to have insulation 298 directly adjacent panels 292. Concrete-anchoring features 295 of connector-type concrete-anchoring components 294 help to anchor connectors 294 and panels 292 to the distal concrete 300 as discussed above.

Figure 9A:
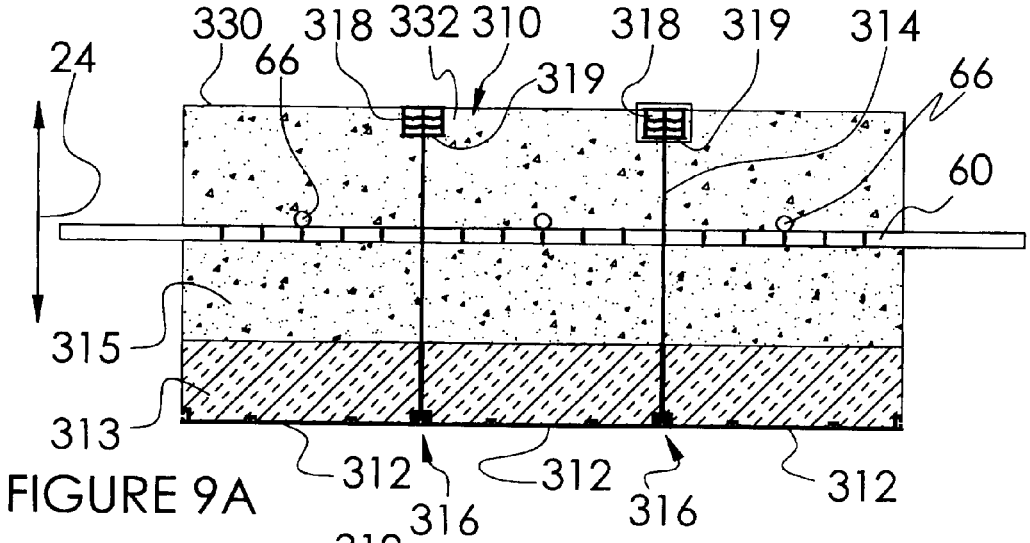
FIGS. 9A, 9B, 9C respectively depict front plan, isometric and enlarged partial front plan views of a structure-lining apparatus suitable for use in lining a wall segment during fabrication according to a particular embodiment of the invention.
Figure 9B:
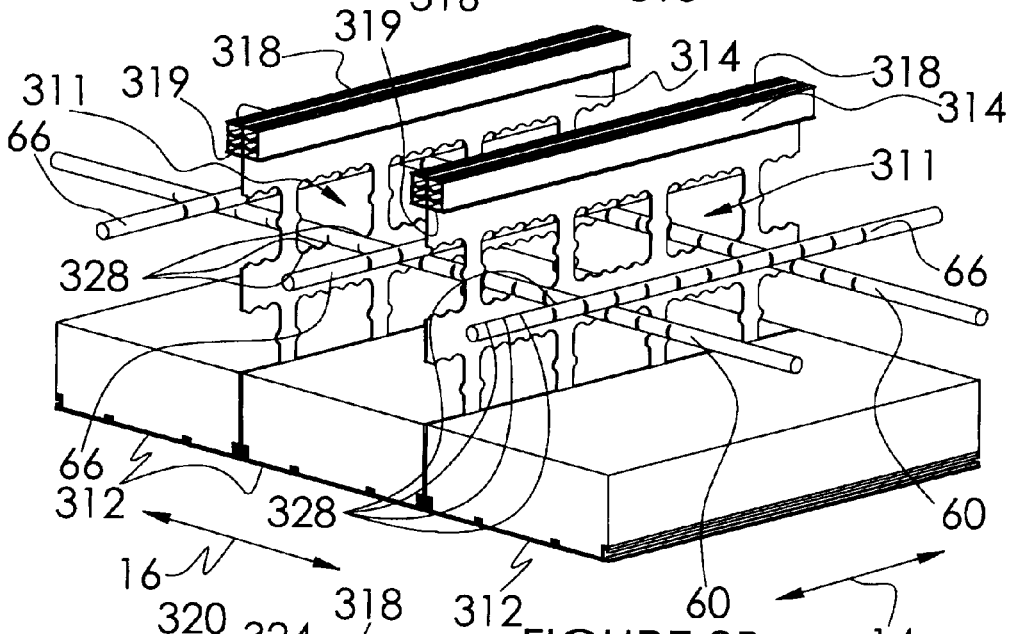
Figure 9C:
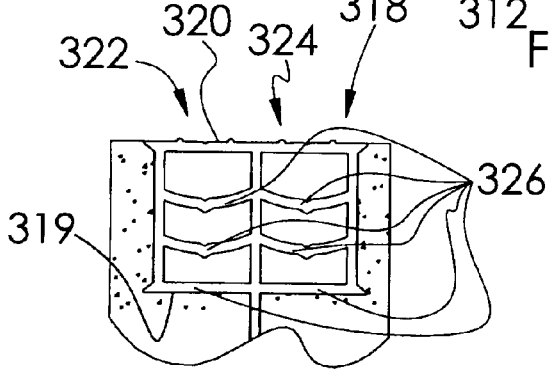

FIGS. 9A, 9B, 9C respective depict front plan, isometric and enlarged partial front plan views of a wall-lining apparatus 310 which may be used to line wall segments during fabrication according to another embodiment of the invention. Wall-lining apparatus 310 comprises panels 312 which are substantially similar to panels 212 of wall-lining apparatus 210 (FIGS. 3A, 3B, 3C). Transversely adjacent panels 312 are connected by connector-type concrete-anchoring components 314 (referred to occasionally herein as connectors 314) at connections 316 which are substantially similar to connections 216 of wall-lining apparatus 210. Connectors 314 comprise apertures 311 which allow concrete to flow therethrough. Wall-lining apparatus 310 also includes a plurality of longitudinally spaced apart, transversely extending reinforcement bars 60 and a plurality of transversely spaced apart, longitudinally extending reinforcement bars 66. Like wall-lining apparatus 290 (FIGS. 8A, 8B), in the illustrated embodiment of wall-lining apparatus 310 insulation 313 is located directly adjacent panels 312 during fabrication and then concrete 315 is poured on top of insulation 313. Insulation 313 may be similar to insulation 298 described above for wall-lining apparatus 290. Wall-lining apparatus 310 may incorporate any of the modifications described herein to accommodate insulation-anchoring components.

Wall-lining apparatus 310 differs from the previously described embodiments in that apertures 311 in connectors 314 comprise a plurality of concavities 328. In the illustrated embodiment, concavities 328 are longitudinally adjacent to one another. Concavities 328 can be used for supporting transversely extending reinforcement bars 60 and positioning reinforcement bars 60 at particular locations. In other embodiments, concavities 328 may be longitudinally spaced apart from one another. In general, connectors 314 may be provided with any suitable number of concavities 328. Those skilled in the art will appreciate that the connector-type anchoring components of the other embodiments described herein may be modified to incorporate concavities similar to concavities 328.

Wall-lining apparatus 310 also differs from the previously described embodiments in that connector-type anchoring components 314 comprise attachment units 318. Attachment units 318 represent a type of concrete-anchoring feature which provides the dual function of helping to anchor connector-type anchoring components 314 into concrete 315 and providing a location in which materials (e.g. finishing or the like) can be fastened to distal surface 330 of wall segment 332 (i.e. the surface of wall segment 332 opposing that of panels 312).

Attachment unit 318 is shown in detail in FIG. 9C. Attachment unit provides anchoring surface 319 which extends in the transverse direction 16 and the longitudinal direction 14. In the illustrated embodiment, attachment unit 318 comprises a surface 320 that extends in the longitudinal direction 14 and in the transverse direction 16 at or near the level of distal surface 330 of wall segment 332. Attachment unit 318 comprises a pair of fastener receiving channels 322, 324. Each of channels 322, 324 comprises a plurality of "break-through" elements 326. Fasteners which project into channels 322, 324 may penetrate through surface 320 and break-through elements 326 and may be retained in channels 322, 324 and prevented from moving in the opposing direction by surface 320 and/or break-through elements 326. In the illustrated embodiment, break-through elements 326 are slightly V-shaped in cross-section. With this configuration, fasteners which project through surface 320 and into channels 322, 324 through break-through elements 326, will be prevented from retracting in the opposing direction because the width of the two halves of break-through elements 326 (in combination) is wider in transverse direction 16 than channels 322, 324. Attachment unit 318 or similar attachment units may be used on the connector-type anchoring components of the other embodiments described herein.

Figure 10A:
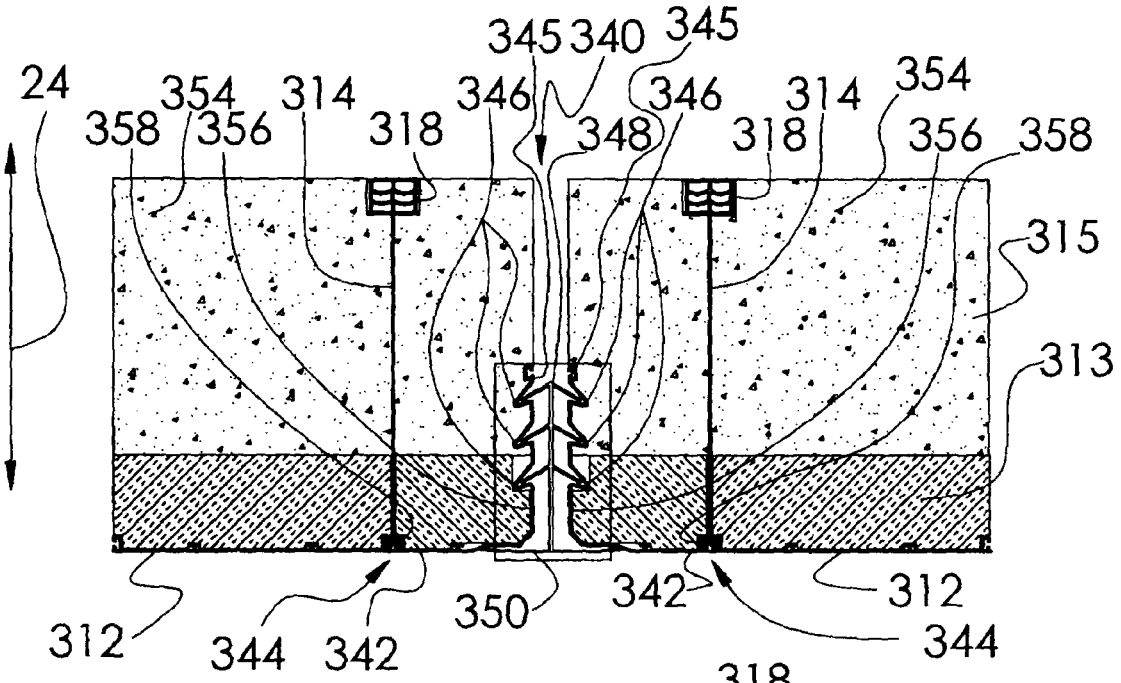
FIGS. 10A, 10B, 10C respectively depict top, isometric and enlarged partial top views of a joint between wall segments according to another embodiment of the invention.
Figure 10B:
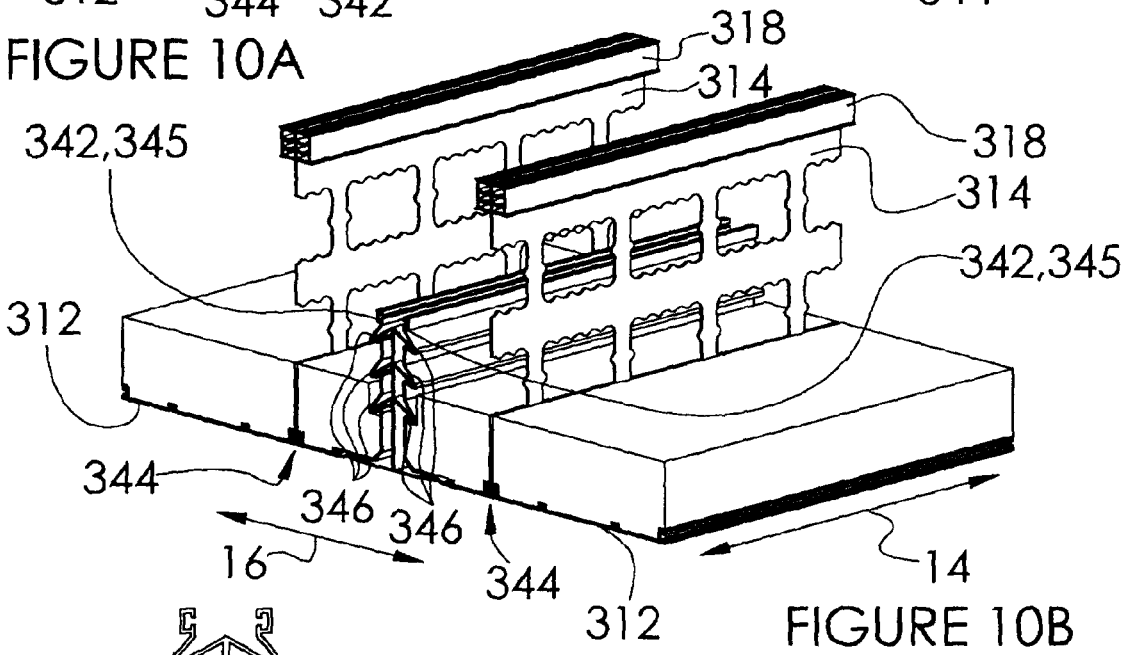
Figure 10C:
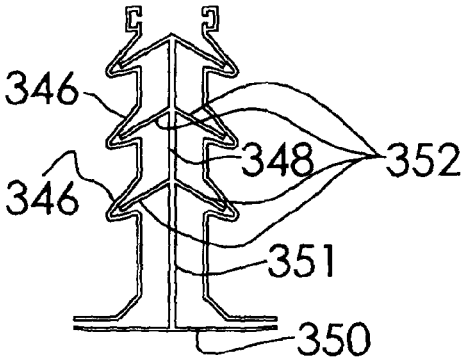

FIGS. 10A, 10B, 10C, respectively depict top, isometric and enlarged top views of a wall-lining apparatus 340 according to another embodiment of the invention. Wall-lining apparatus 340 comprises panels 312 and connector-type anchoring components 314 (referred to occasionally herein as connectors 314) which are substantially similar to panels 312 and connector-type anchoring components 314 of wall-lining apparatus 310 (FIGS. 9A-9C). Like wall-lining apparatus 310, insulation 313 is located directly adjacent panels 312 during fabrication and then concrete 315 is poured on top of insulation 313. Wall-lining apparatus 340 may incorporate any of the modifications described herein to accommodate insulation-anchoring components.

Wall-lining apparatus 340 differs from the previously described embodiments in that wall-lining apparatus 340 comprises corner panels 342, which line a portion of the transverse edge surfaces 356 of wall segments 354. Corner panels 342 may comprise connector components 358 at one of their transverse edges. In the illustrated embodiment, connector components 358 are female C-shaped connector components and connectors 314 connect the transverse edge of a panel 312 to the transverse edge of an corner panel 342 at connection 344 which is substantially similar to connection 316 of wall-lining apparatus 310. Portions 345 of corner panels 342 also extend in the inward/outward direction 24 to line a portion of the transverse edge surfaces 356 of wall segments 354. In the illustrated embodiment, inward/outward extending portions 345 of corner panels 342 comprise a plurality of indents 346 which extend back into wall segment 354 in the transverse direction 16 and which are coextensive with corner panel 342 in the longitudinal direction 14. Indents 346 may help to anchor wall-lining apparatus 340 and in particular corner panels 342 to concrete 315.

Indents 346 may also provide a means for coupling transversely adjacent wall segments 354 to one another using interface plugs 348. As shown in the illustrated views, when transversely adjacent wall segments 354 are moved into place, there may be a small gap therebetween. Interface plugs 348 may be inserted into this gap to connect transversely adjacent panels 354 and help to provide an aesthetically pleasing and/or hygienic surface. Interface plugs 348 may also provide resistance to flow of moisture and/or gases between adjacent wall segments 354. In the illustrated embodiment, interface plugs 348 comprise wall surface 350 which extends in the transverse direction 16 and the longitudinal direction 14 and a plug stem 351 that extends from wall surface 350 in the inward/outward direction 24 and in the longitudinal direction 14. A number of deformable leaf members 352 extend in the transverse directions 16 from plug stem 351. As shown best in FIG. 10C, plug stem 351 is inserted in the gap between transversely adjacent panels 354 such that leaf members 352 extend transversely into indents 346. Interface plug 348 is thereby retained between wall segments 354.

Figure 11A:
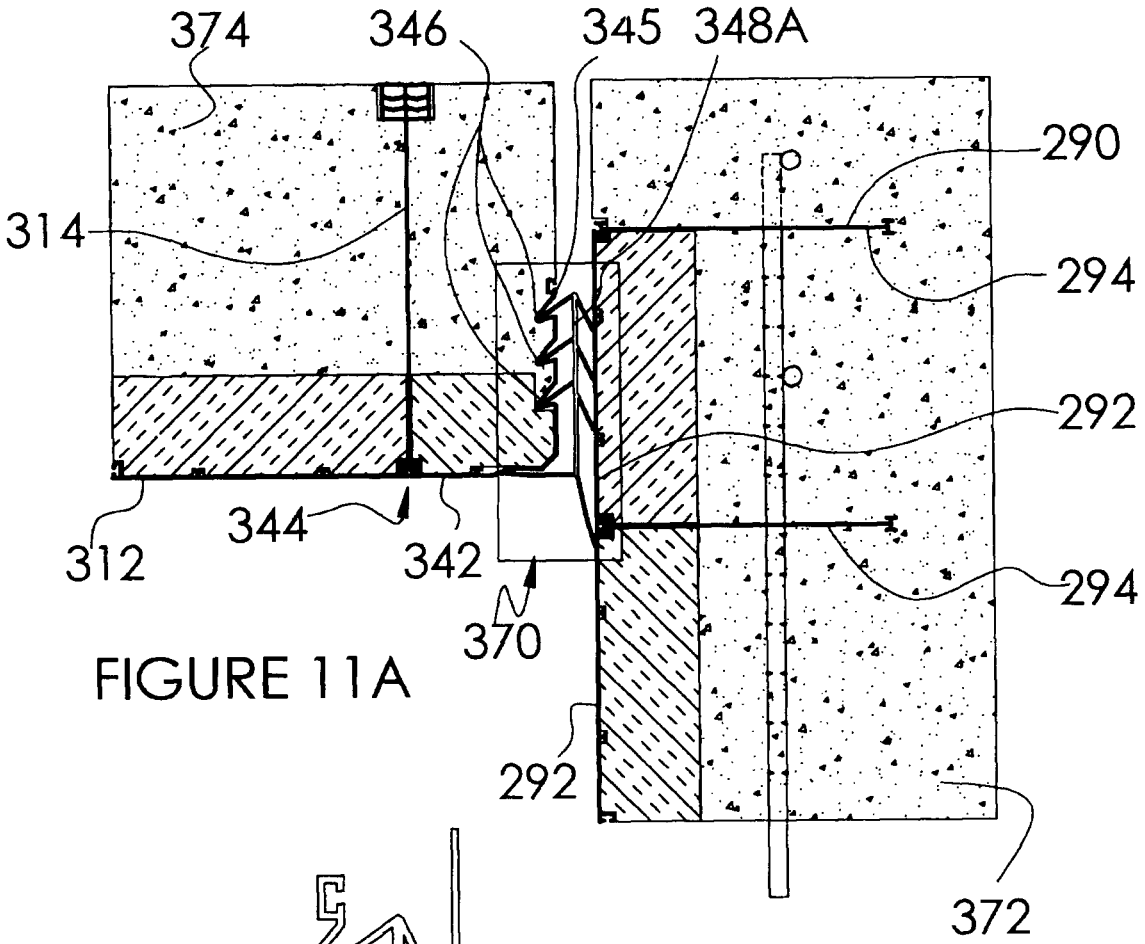
FIGS. 11A and 11B respectively depict a top view and an enlarged partial top view of a joint between wall segments lined with wall-lining apparatus according to particular embodiments of the invention.
Figure 11B:
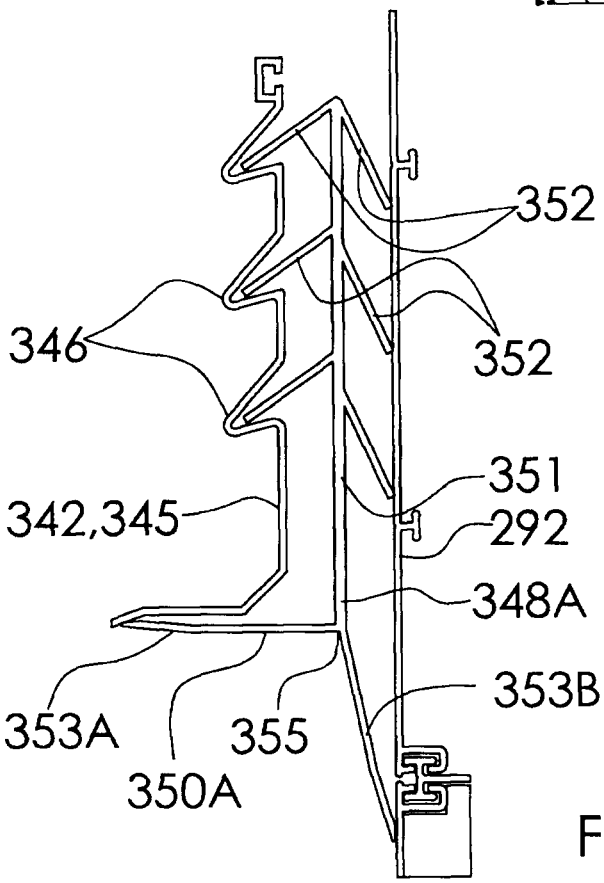

FIG. 11A depicts a top view of a joint 370 between wall segments 372, 374 fabricated and lined using wall-lining apparatus according to particular embodiments of the invention. FIG. 11B is a magnified partial view of joint 370. Wall segment 372 is formed using a wall-lining apparatus 290 similar to wall-lining apparatus 290 of FIGS. 8A, 8B including panels 292 and connector-type anchoring components 294. Wall segment 374 is formed using a wall-lining apparatus 340 similar to wall-lining apparatus 340 of FIGS. 10A-10C including panels 312, connector-type anchoring components 314 and corner panel 342. As described above, corner panel 342 comprises transversely extending channels 46 on its inward/outward extending portion 345. Joint 370 formed between wall segments 372, 374 includes a corner interface plug 348A, which covers the gap between wall segments 372, 374 to provide an aesthetic appearance and hygienic surface. Corner interface plug 348A is similar to interface plug described above and includes a stem 351 and a plurality of deformable leaf members 352. Corner interface plug 348A differs from interface plug 348 in that wall surface 350A of corner interface plug 348A comprises bend 355 to provide corner surface portions 353A, 353B. In operation, when corner interface 348A is pushed into the gap between wall segments 372, 374, wall surface 350A may deform at bend 355 (i.e. by wall segments 372, 374 exerting pressure on corner surface portions 353A, 353B) to accommodate various orientations of wall segments 372, 374. Corner interface 348A may also deform at the joints between leaves 352 and stem 351.

Figure 12A:
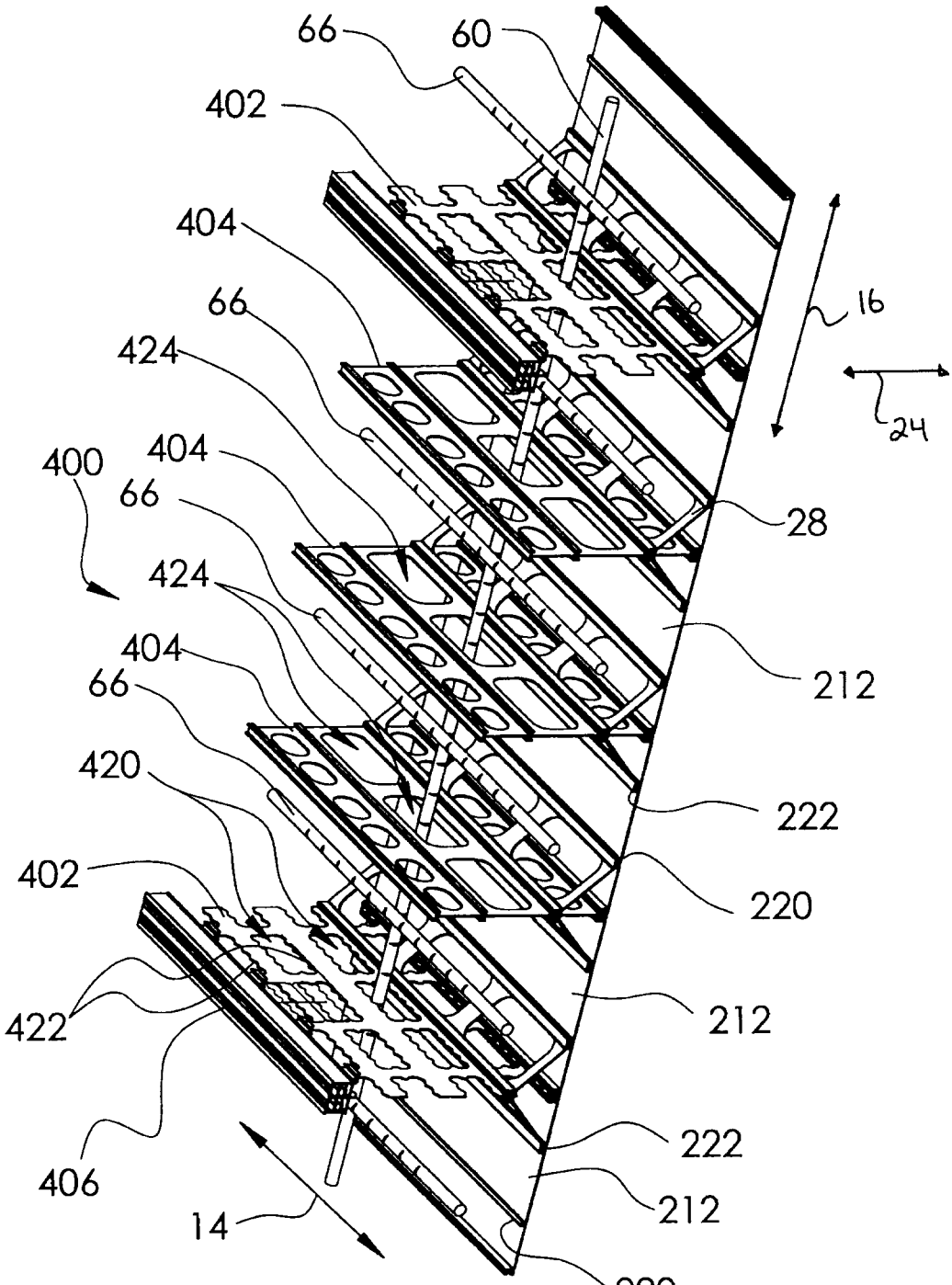
FIGS. 12A and 12B are respectively isometric and side views of a structure-lining apparatus suitable for use in lining a wall segment during fabrication according to a particular embodiment of the invention.
Figure 12B:
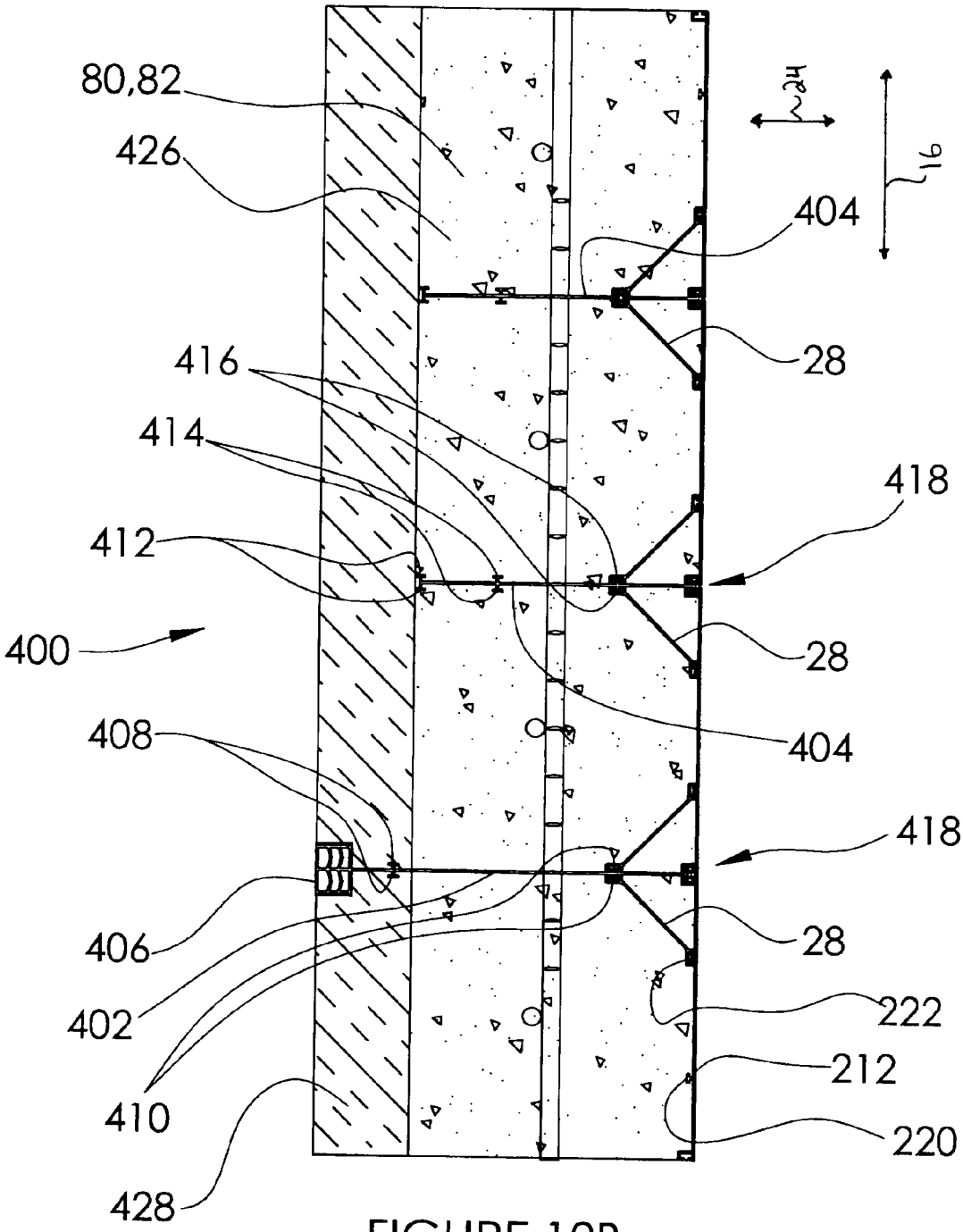

FIGS. 12A and 12B respectively depict isometric and side plan views of a wall-lining apparatus 400 suitable for use to line wall segments during fabrication according to another embodiment of the invention. In many respects, wall-lining apparatus 400 is similar to the wall-lining apparatus described above. Wall-lining apparatus 400 comprises structure-lining panels 212 which are similar to those described above in wall-lining apparatus 210 (FIGS. 3A-3C). Wall-lining apparatus 400 differs from the previously described embodiments in that wall-lining apparatus 400 includes two different types of connector-type concrete-anchoring components (connector-type concrete-anchoring components 402 (also referred to as connectors 402) and connector-type concrete-anchoring components 404 (also referred to as connectors 404)). Connectors 402, 404 are used to connect the transversely adjacent edges of panels 212 at connectors 418 in a manner substantially similar to connections 216 (FIGS. 3A-3C). Wall-lining apparatus 400 is not limited to the particular types of connector-type concrete-anchoring components 402, 404 shown in the illustrated embodiment. In addition to or in the alternative to connectors 402, 404, wall-lining apparatus 400 may incorporate different types of connector-type concrete-anchoring components of the type described herein or any of the alternatives or variations described herein.

In the illustrated embodiment, connectors 402 differ from connectors 404 in that: connectors 402 extend further in the inward/outward direction 24 than connectors 404; connectors 402 comprise attachment units 406 (similar to attachment units 318 of connectors 314 (FIGS. 9A-9C)) which also function as concrete-anchoring features; connectors 402 comprise two additional sets of potential concrete-anchoring features 408, 410 spaced apart from one another in inward/outward direction, whereas connectors 404 comprise three sets of concrete-anchoring features 412, 414, 416; and apertures 420 of connectors 402 incorporate concavities 422 (similar to concavities 328 of connectors 314 (FIG. 9B)), whereas apertures 424 of connectors 404 do not incorporate concavities. These differences between connectors 402 and connectors 404 are optional and, in other embodiments, any of these differences may be varied. By way of non-limiting example, connectors 402 may be modified to provide concavities on the edges of their apertures 424, the attachment units 406 may be removed from connectors 402 and/or connectors 402 may extend further in inward/outward direction 24.

Wall-lining apparatus 400 also incorporates braces 28 which are substantially similar to braces 28 of wall-lining apparatus 10 (FIGS. 1A-1D). In the illustrated embodiment, braces 28 are connected to panels 212 at integral-type concrete-anchoring components 220 and/or 222, to connectors 402 at proximate concrete-anchoring features 410 and to connectors 404 at proximate concrete-anchoring features 416. In the illustrated embodiment, braces 28 of wall-lining apparatus 400 are used at every connector 402, 404, although this is not necessary. In some embodiments, braces 28 may be omitted, braces 28 may be provided at particular connectors 402, 404 where it is desired to reinforce the edge-adjacent connection of panels 212 or braces 28 may be provide on one transverse side of connectors 402, 404. The concrete-anchoring features of integral-type concrete-anchoring components 220, 222 and connector-type concrete-anchoring components 402, 404 may be modified or varied in any of the manners described herein.

The use of wall-lining apparatus 400 to line a wall segment during fabrication is similar in many respects to method 100 for wall-lining apparatus 10. In particular, panels 212 are laid into a form-work 70 and are connected to one another using connectors 402, 404 in a manner similar to that of blocks 110 and 120. Braces 28 and reinforcement bars 60, 66 may be installed in a manner similar to that of blocks 130 and 140. Form members 76 may be assembled in a manner similar to that of block 150 and concrete may be poured in a manner similar to that of block 160. A useful feature of wall-lining apparatus 400 is that the tops of connectors 404 may be used as a level guide for the block 160 pouring of liquid concrete. In the illustrated embodiment, wall segment 426 formed using wall-lining apparatus 400 comprises only a single proximate layer 80 of concrete 82. Accordingly, once concrete 82 installed in block 160 solidifies, insulation 428 may be installed over proximate concrete layer 82 in a manner similar to that of block 170 and block 180, 190 of method 100 are not required. Wall segment 426 may then be tilted up in place in a procedure similar to that of block 200 described above.

Since wall-lining apparatus 400 incorporates attachment units 406 on connectors 402, wall finishing (not shown) may be fixed to attachment units 406 as described above for attachment units 318 of connectors 314 (FIGS. 9A-9C). The spacing of connectors 402 (as opposed to connectors 404) may be selected to provide attachment units 406 at suitable locations for fixing siding material to wall segment 426. In some embodiments, wall finishing is fixed prior to tilting up wall segment 426 and in other embodiments, wall finishing is fixed after wall segment 426 has been tilted up into its vertical configuration. Any of the above-described variations or modification to method 100 may also be incorporated into the method for using wall-lining apparatus 400 to form tilt-up wall segments.

Structure-lining apparatus according to the invention are not limited to lining walls during fabrication. In general, structure-lining apparatus according to the invention may be used to line any structure formed from concrete or similar curable materials during fabrication of the structure (e.g. before the liquid concrete is permitted to solidity). Various exemplary applications of the invention to such generalized structures are now described.

Structure-lining apparatus according to particular embodiments of the invention comprise one or more panels which are used to line at least a portion of a structural form and one or more concrete-anchoring components which anchor the panels to the structure as the concrete solidifies. The structure-lining panels may extend in longitudinal and transverse directions and are interconnected with one another in edge-to-edge relationship at their transverse edges to line at least a portion of the interior of the structural form (e.g. a structure-lining surface formed by the longitudinal and transverse extension of the panels may abut against an interior surface of the form). The concrete-anchoring components may extend in an inward/outward direction from the panels. The concrete-anchoring components may comprise: (i) integral-type concrete-anchoring components which are integrally formed with the panels; (ii) connectable-type concrete-anchoring components which connect to the panels (or to other components of the structure-lining apparatus) via suitably configured connector components; and (iii) connector-type concrete-anchoring components—a sub-category of connectable-type concrete-anchoring components which connect the transverse edges of panels to one another in edge-to-edge relationship.

Figure 13B:
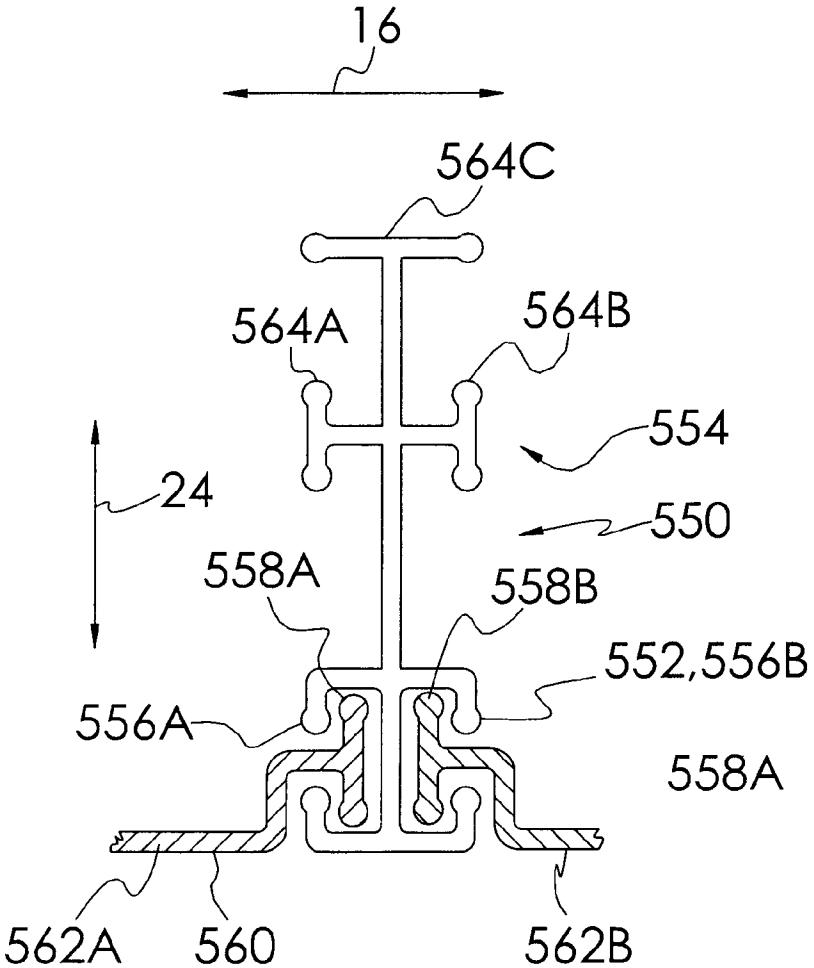
FIGS. 13A and 13B are front plan views of an exemplary connector-type concrete-anchoring components according to particular embodiments together with partial views of the panels which they connect to one another in edge-adjacent relationship.
Figure 13A:
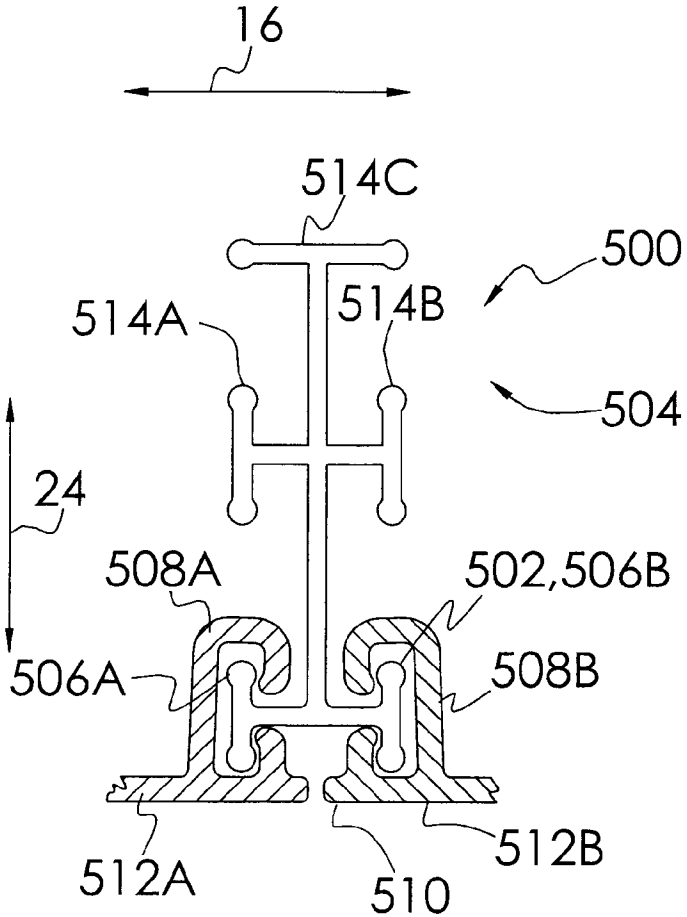

FIG. 13A is a front plan view of an exemplary connector-type concrete-anchoring component 500 (referred to occasionally as connector 500) together with partial views of panels 512A, 512B (collectively, panels 512) which are connected in edge-to-edge relationship by connector 500 according to a particular embodiment of the invention. Connector-type concrete-anchoring component 500 comprises a connection portion 502 and a concrete-anchoring portion 504. Connection portion 502 connects panels 512 to one another in edge-to-edge relationship such that panels 512 form a structure-lining surface 510. Concrete-anchoring portion 504 bonds connector 500 and panels 512 to the concrete.

Connection portion 502 may comprise a pair of connector components 506A, 506B (collectively, connector components 506) for connecting to corresponding connector components 508A, 508B (collectively, connector components 508) of panels 512 and thereby connecting structure-lining panels 512 to one another in edge-adjacent relationship. In the illustrated embodiment of FIG. 13A, connector components 506 of component 500 are T-shaped male slidable connector components which slide together with corresponding C-shaped female slidable connector components 508 of panels 512. It will be appreciated that connector components 506 and 508 represent only one type of connection between connection portion 502 of connector-type concrete-anchoring component 500 and panels 512.

Concrete-anchoring portion 504 of connector-type concrete-anchoring component 500 comprises at least one concrete-anchoring feature. In the illustrated embodiment, concrete-anchoring portion 504 comprises three concrete-anchoring features 514A, 514B, 514C (collectively, concrete-anchoring features 514). In the illustrated embodiment, concrete-anchoring features 514 are T-shaped features similar to concrete-anchoring feature 89A (FIG. 1G) and to concrete-anchoring features 79, 90, 92 of wall-lining apparatus 10 (FIGS. 1B and 1C). In the illustrated embodiment, concrete-anchoring features 514A, 514B are located on the transverse sides of component 500 and are rotated 90° relative to concrete-anchoring feature 514C which is located at the innermost end of component 500 in inward/outward direction 24. In general, concrete-anchoring portion 504 of connector-type concrete-anchoring component 500 may comprise any number of concrete-anchoring features 514 and each concrete-anchoring feature may be similar to any of the concrete-anchoring features described herein (e.g. concrete-anchoring features 89-89K of FIGS. 1F-1Q) and may incorporate any of the features, modifications and/or variations of these concrete-anchoring features.

For many applications, the extension of concrete-anchoring component 500 in inward/outward direction 24 may be relatively small in comparison to the inward/outward dimension of the resultant concrete structure (not shown in FIG. 13A) lined by panels 512. This relatively small inward-outward extension minimizes the cost of materials used for concrete-anchoring components 500. In particular embodiments, the ratio of the extension of concrete-anchoring component 500 in inward/outward direction 24 to the inward/outward dimension of the concrete structure is in a range of 0.05-0.50. In some embodiments, this ratio is in a range of 0.10-0.25. While not shown in the illustrated view, concrete-anchoring component 500 may comprise apertures which extend in longitudinal direction 14 (i.e. into and out of the page in the FIG. 13B view) and in inward/outward direction 24 and which permit concrete to flow therethrough in a manner similar to apertures 218 of connector-type concrete-anchoring components 216 (see FIG. 3B).

FIG. 13B is a partial schematic view of a connector-type concrete-anchoring component 550 (occasionally referred to as connector 550) which connects a pair of edge-adjacent structure-lining panels 562A, 562B (collectively, panels 562) to one another to form structure-lining surface 560 according to another embodiment of the invention. Connector-type concrete-anchoring component 550 comprises a connection portion 552 and a concrete-anchoring portion 554. In the illustrated embodiment of FIG. 13B, concrete-anchoring portion 554 is substantially similar to concrete-anchoring portion 504 of connector-type concrete-anchoring component 500 (FIG. 13A) and comprises concrete-anchoring features 564A, 564B, 564C (collectively, concrete-anchoring features 564).

Connection portion 552 of connector-type concrete-anchoring component 550 differs from connection portion 502 of connector-type concrete-anchoring component 500. Connection portion 552 comprises a pair of C-shaped female slidable connector components 556A, 556B (collectively, connector components 556), each of which receives a corresponding T-shaped male slidable connector component 558A, 558B (collectively, connector components 558) from a corresponding one of edge-adjacent structure-lining panels 562. In other respects, connector-type concrete-anchoring component 550 is similar to connector-type concrete-anchoring component 500 and may be modified or varied in accordance with any of the modifications or variations described herein for concrete-anchoring component 500.

Figure 14B:
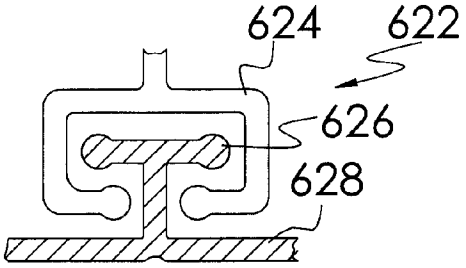
FIGS. 14B, 14C, 14D are partial front plan views of the connection portions of a number of exemplary connectable-type concrete-anchoring components together with partial views of the panels to which the concrete-anchoring components are connected.
Figure 14C:
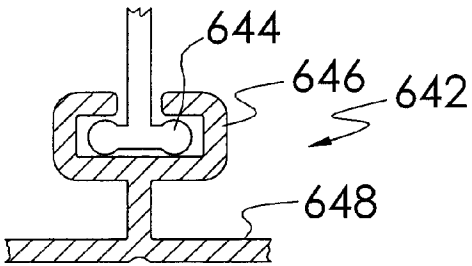
Figure 14D:
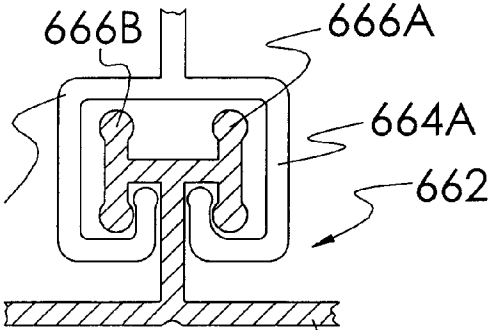
Figure 14A:
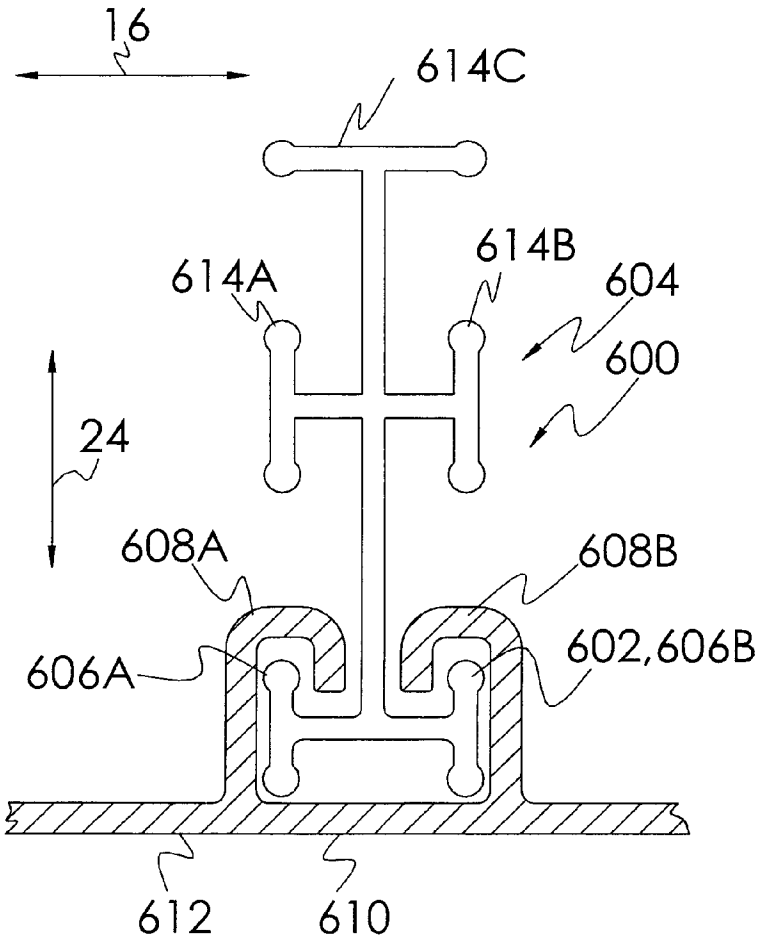
FIG. 14A is a front plan view of an exemplary connectable-type concrete-anchoring component according to particular embodiment together with a partial view of the panel to which the concrete-anchoring component is connected.

FIG. 14A is a front plan view of an exemplary connectable-type concrete-anchoring component 600 connected to a panel 612 to form a structure-lining surface 610 according to a particular embodiment of the invention. In the FIG. 14A embodiment, connectable-type concrete-anchoring component 600 connects to a single panel 612, but is otherwise substantially similar to connector-type concrete-anchoring component 500 (FIG. 13A) and may incorporate any of the features, variations or modifications described herein for connector-type concrete-anchoring component 500. The components of connectable-type concrete-anchoring component 600 are assigned reference numbers similar to those used above for connector-type concrete-anchoring component 500, except that the reference numbers used for connectable-type concrete-anchoring component 600 have a leading numeral "6" rather than "5".

Connectable-type concrete-anchoring component 600 comprises a connection portion 602 and a concrete-anchoring portion 604. In the FIG. 14A embodiment, concrete-anchoring portion 604 is substantially similar to concrete-anchoring portion 504 of connector-type concrete-anchoring component 500 and comprises concrete-anchoring features 614A, 614B, 614C (collectively, concrete-anchoring features 614). Concrete-anchoring portion 604 may be varied or modified in accordance with any of the variations or modifications described herein for concrete-anchoring portion 504. Connectable-type concrete-anchoring component 600 may be apertured in a manner similar to that of connector-type concrete-anchoring component 500. Connection portion 602 of the FIG. 14A embodiment is substantially similar to connection portion 502 of connector-type concrete-anchoring component 500 and comprises a pair of slidable male T-shaped connector components 606A, 606B (collectively, connector components 606) which connect to a corresponding pair of female J-shaped connector components 608A, 608B (collectively, connector components 608) on a single panel 612.

It will be appreciated that connector components 606 and 608 represent only one type of connection between connection portion 602 and panel 612. Slidable connector components 606, 608 could be provided with other shapes. By way of non-limiting example, FIGS. 14B, 14C and 14D show a variety of connection portions 622, 642, 662 which may be used in the place of connection portion 602 of connectable-type concrete-anchoring component 600. Connection portion 622 (FIG. 14B) comprises a female C-shaped connector component 624 which slidably connects to a corresponding male T-shaped connector component 626 on panel 628. Connection portion 642 (FIG. 14C) comprises a male T-shaped connector component 644 which slidably connects to a corresponding female C-shaped connector component 646 on panel 648. Connection portion 662 (FIG. 14D) comprises a pair of female J-shaped connector components 664A, 664B (collectively, connector components 664) which slidably connector to a corresponding pair of male T-shaped connector components 666A, 666B (collectively, connector components 666) on panel 668. Many other types of connector components could be used in place of the slidable connector components described above.

Figure 14F:
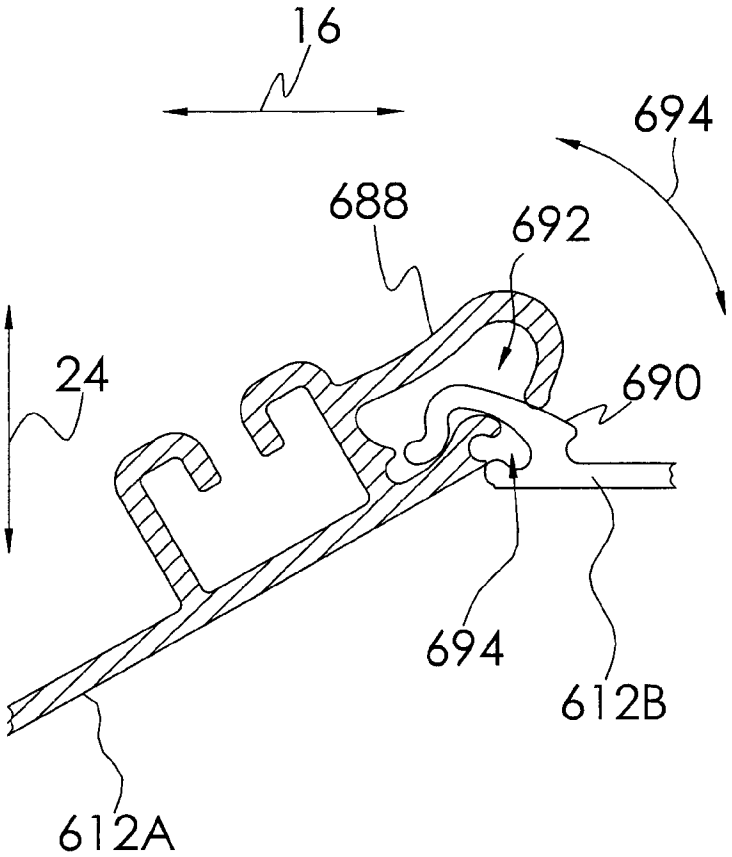
FIG. 14F is a front plan view showing how the FIG. 14E edge-adjacent panels are connected to one another using the slidable and pivotable snap-together connection.
Figure 14E:
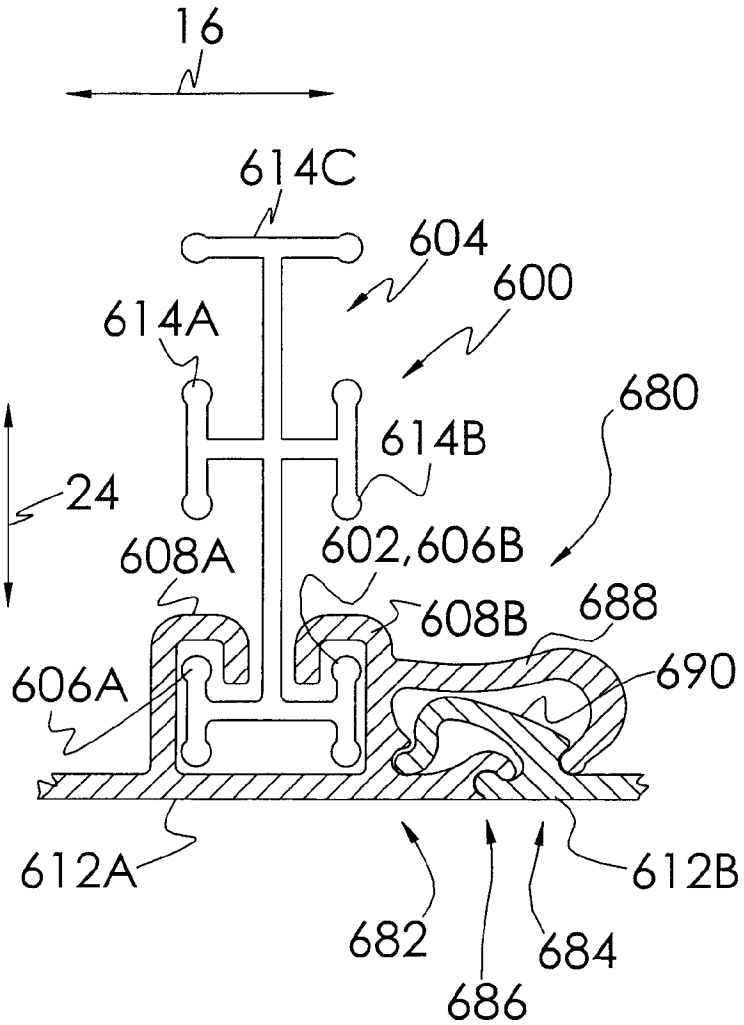
FIG. 14E is a front plan view of the FIG. 14A connectable-type concrete-anchoring component connected to a panel adjacent to one of its edges and showing the panel directly connected to an edge-adjacent panel using a slidable and pivotable snap-together connection according to a particular embodiment of the invention.

As discussed above, for example in relation to structure-lining apparatus 230 (FIGS. 4A-4C), some embodiments of the invention incorporate direct connections between the transverse edges of edge-adjacent panels (i.e. without connectors or connector-type concrete-anchoring components). FIG. 14E depicts a partial front plan view of a structure-lining apparatus 680 according to such an embodiment. Structure-lining apparatus 680 comprises a connectable-type concrete-anchoring component 600 which is substantially similar to that of FIG. 14A and which connects to panel 612A in a manner similar to the connection to of concrete-anchoring component 600 to panel 612 (FIG. 14A). In the FIG. 14E embodiment, connector components 608 of panel 612A are located relatively proximate to transverse edge 682 of panel 612A, although this is not necessary.

Panel 612A is directly connected at its transverse edge 682 to transverse edge 684 of an edge-adjacent panel 612B at connection 686 (i.e. without connectors or connector-type concrete-anchoring components). Connection 686 is a slidable and pivotable "snap-together" connection of the type described in detail in co-owned U.S. application No. 61/022,505 filed 21 Jan. 2008 which has been incorporated herein by reference. Connection 686 is made between connector component 688 on transverse edge 682 of panel 612A and connector component 690 on transverse edge 684 of panel 612B. To make connection 686, connector component 690 may be partially inserted into concavity 692 of connector component 688 and connector component 688 may be partially inserted into concavity 694 of connector component 690 as shown in FIG. 14F and then panels 612A, 612B may be slid relative to one another in longitudinal direction 14 (i.e. into and out of the page in the illustrated view of FIG. 14F) to provide a loose-fit connection between connector components 688, 690. In particular embodiments, when connector components 688, 690 are partially inserted into one another's concavities 692, 694 (e.g. in the loose fit connection shown in FIG. 14F), connector components 688, 690 need not be deformed.

To make connection 686, panels 612A, 612B or, in particular, connector components 688, 690 may then be pivoted with respect to one another in one of the directions shown by double-headed arrow 694 such that one or both of connector components 688, 690 are caused to deform and then to resiliently "snap" back to a less deformed state and to thereby make connection 686 as shown in FIG. 14E. Because of the deformation of one or both of connector components 688, 690 and the subsequent resilient "snap" back to a less deformed state, connection 686 may be referred to as a deformable "snap-together" connection.

It will be appreciated that connection 686 and its connector components 688, 690 represent only one type of direct connection between edge-adjacent panels and that other types of connections having other types of connector components could also be used. By way of non-limiting example, such connector components may be used to form slidable connections (e.g. the slidable connections 236 shown in FIGS. 4A-4C), deformable "snap-together" connections, pivotable connections, or connections incorporating any combination of these actions.

Figure 15B:
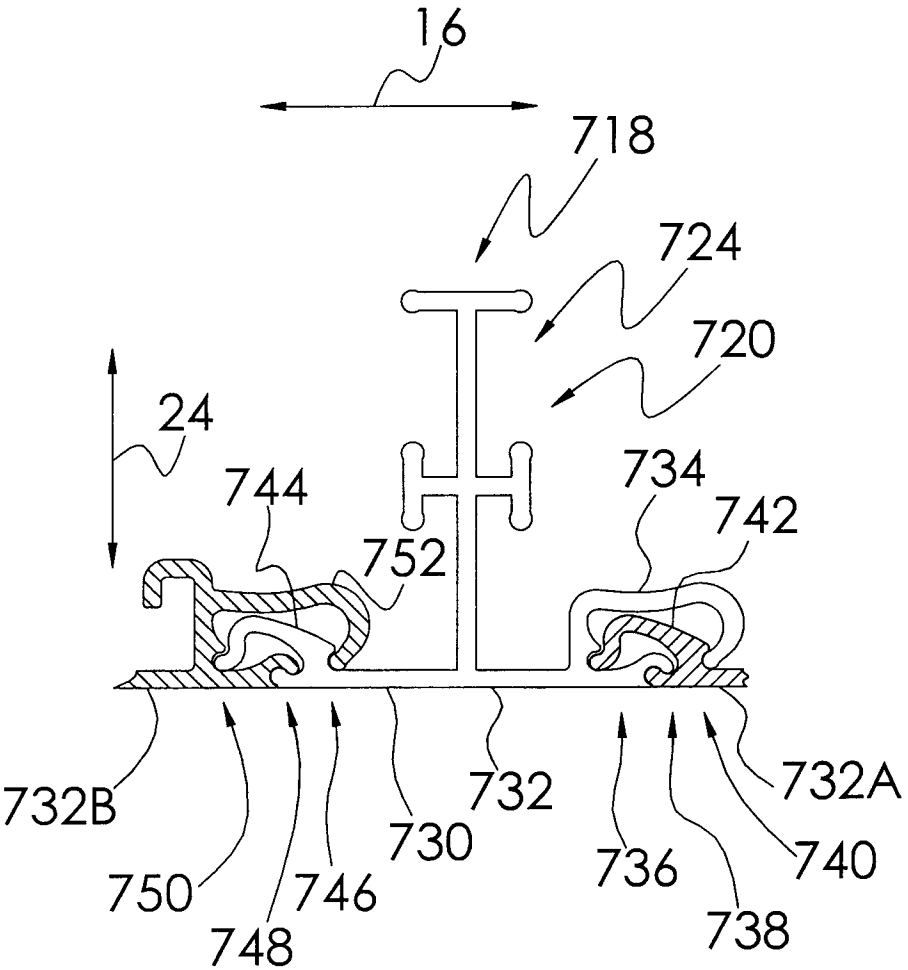
FIG. 15B is a partial front plan view of a panel incorporating an integral-type concrete-anchoring component together with partial views of the edge-adjacent panels to which the panel is connected using slidable and pivotable snap-together connections.
Figure 15A:
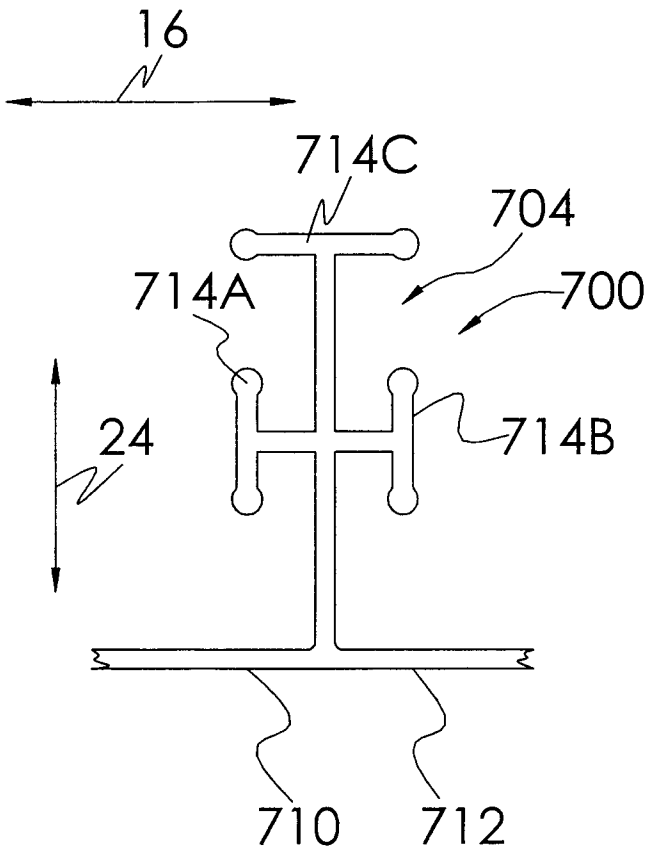
FIG. 15A is a partial front plan view of a panel incorporating an integral-type concrete-anchoring component according to a particular embodiment of the invention.

FIG. 15A is a partial front plan view of an exemplary integral-type concrete-anchoring component 700 integrally formed with panel 712 to form a structure-lining surface 710 according to a particular embodiment of the invention. In the FIG. 15A embodiment, integral-type concrete-anchoring component 700 comprises a concrete-anchoring portion 704 which is substantially similar to concrete-anchoring portion 504 of connector-type concrete-anchoring component 500 (FIG. 13A) and comprises concrete-anchoring features 714A, 714B, 714C (collectively, concrete-anchoring features 714). Concrete-anchoring portion 704 may be varied or modified in accordance with any of the variations or modifications described herein for concrete-anchoring portion 504 (FIG. 13A). Integral-type concrete-anchoring component 700 may be apertured in a manner similar to connector-type concrete-anchoring component 500.

FIG. 15B is a partial front plan view of a structure-lining apparatus 718 according to a particular embodiment of the invention. Structure-lining apparatus 718 provides a structure-lining surface 730 formed in part by panel 732 which comprises an integral-type concrete-anchoring component 720. In the illustrated embodiment, integral-type concrete-anchoring component 720 comprises a concrete-anchoring portion 724 that is substantially similar to concrete-anchoring portion 704 of integral-type concrete-anchoring component 700 (FIG. 15A). Panel 732 of FIG. 15B is relatively small in transverse dimension 16 in comparison to other panels described above. Panel 732 may be referred to as a unit panel and may have a transverse size that is the smallest transverse size for a particular application. The actual transverse size of a unit panel may depend on the scale of the structure to be lined. By way of non-limiting example, for structures on the scale of a building wall, a unit panel having a transverse dimension of 1 inch may be suitable, whereas for larger structures a larger sized unit panel may be suitable and for smaller structures a smaller sized unit structure may be suitable. Unit panels may be useful to provide structure-lining surfaces to fit precisely against corresponding interior surfaces of structural forms.

In the illustrated embodiment, panel 732 comprises connector component 734 at one of its transverse edges 736 and connector component 744 at is opposing transverse edge 746. Connector components 734, 744 are substantially similar to the slidable and pivotal snap-together connector components 688, 690 (FIG. 14E). In the FIG. 15B embodiment, connector component 734 connects to corresponding connector component 742 at transverse edge 740 of transversely adjacent panel 732A to form connection 738 between transversely adjacent panels 732, 732A and connector component connects to corresponding connector component 752 at transverse edge 750 of transversely adjacent panel 732B to form connection 748 between transversely adjacent panels 732, 732B.

Figure 18:
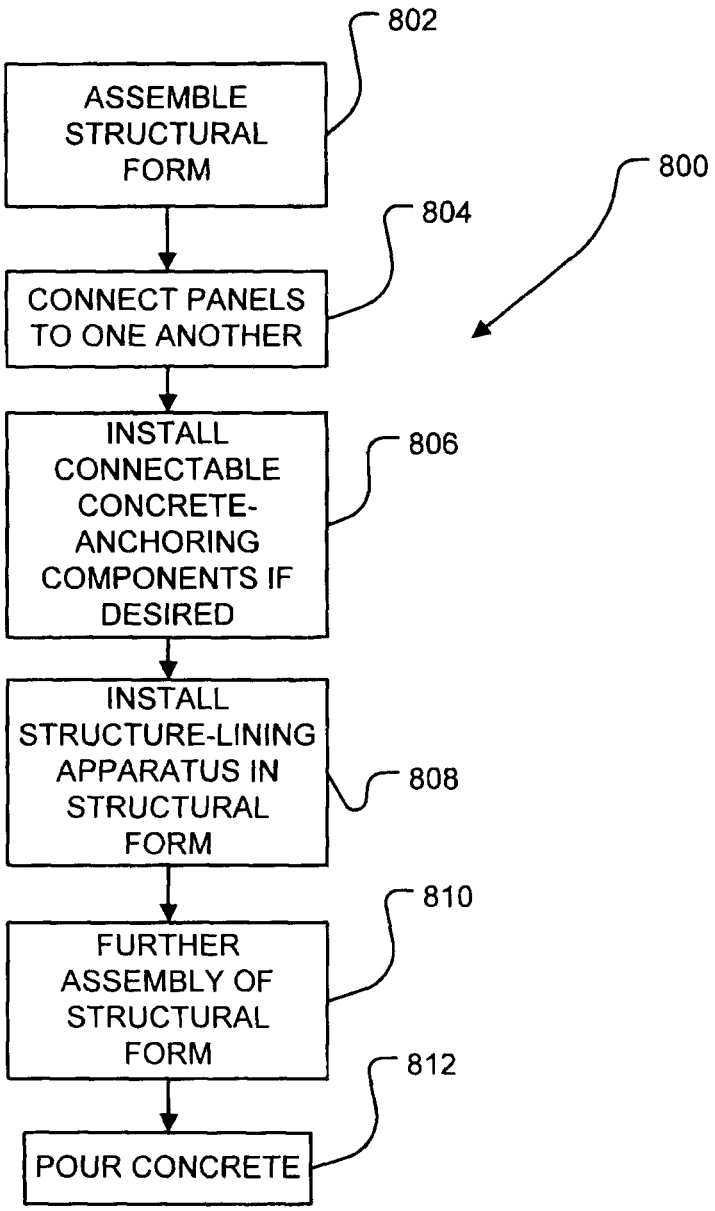
FIG. 18 is a method for fabricating a concrete-structure having at least one surface lined with a structure-lining apparatus according to a particular embodiment of the invention.

FIG. 18 schematically depicts a method 800 of lining a structure during fabrication using a structure-lining apparatus according to a particular embodiment of the invention. Method 800 begins in block 802 which involves assembling a structural form. The structural form assembled in block 802 may be any type of structural form desired to fabricate the resulting structure. By way of non-limiting example, such forms may be made of wood, suitable metals or alloys or other suitable materials. Such forms may comprise so called "cast-in-place" forms, in which structures are cast in the location, or in close proximity to the location, of the place where they are intended to be used or so called "pre-cast" forms, in which structures are cast in a casting location and subsequently moved to the place where they are intended to be used. Tilt-up walls described above are one non-limiting example of structures fabricated in pre-cast forms. In some embodiments, block 802 may comprise partial assembly of the structural form to more easily facilitate insertion of a structure-lining apparatus into an interior of the structural form.

Method 800 then proceeds to block 804 which involves connecting structure-lining panels to one another in edge-adjacent relation to form at least one structure-lining surface. Transversely adjacent panels may be connected to one other using connector-type concrete-anchoring components or may be connected to one another directly at their transverse edges (e.g. in a manner similar to connections 236 (FIGS. 4A-4C) or connections 686 (FIG. 14E)). In some embodiments, transversely adjacent panels may be connected to one another using connectors that have connection portions similar to the connection portions of the connector-type concrete-anchoring components described herein, but which do not have concrete-anchoring components. In such embodiments, concrete-anchoring components may be integral-type or connectable-type concrete-anchoring components.

In block 806, connectable-type concrete-anchoring components are optionally connected to the panels if connectable-type concrete anchoring components are desired in the structure-lining apparatus. In block 808, the structure-lining apparatus is installed in the structural form. In some embodiments, when the structure-lining apparatus is installed in the form, one or more of the structure-lining surfaces of the apparatus abuts (at least in part) against one or more corresponding interior surfaces of the form. Block 810 optionally involves further assembly of the structural form in embodiments where the form is only partially assembled in block 802.

It will be appreciated by those skilled in the art that some of the steps involved in blocks 802, 804, 806, 808 and 810 may be performed in orders other than the one schematically depicted in method 800 of FIG. 18. By way of non-limiting example, method 800 may involve installing the structure-lining apparatus in the form (block 808) at the same time as the panels are being connected to one another (block 804) and connectable-type concrete-anchoring components may be connected to the panels (block 806) before or after the panels are connected to one another (block 804) and/or before or after the panels are installed in the form (block 808). Although not shown in the illustrated embodiment of FIG. 18, in some embodiments, it may be desirable to insert reinforcement bars and/or insulation materials into the form at some stage prior to pouring concrete in block 812. At the conclusion of block 810, a structure-lining apparatus comprising panels together with concrete-anchoring components (connector-type, connectable-type and/or integral-type) may be installed in a completed form such that one or more of the structure-lining surfaces of the apparatus abuts (at least in part) against one or more corresponding interior surfaces of the form.

Block 412 involves pouring concrete. Liquid concrete at least partially fills the form and surrounds the concrete-anchoring features of the concrete-anchoring components (integral-type, connector-type and/or connectable-type) of the structure-lining apparatus. When the concrete solidifies, the structure-lining apparatus is anchored to the resultant concrete structure and forms a lining on one or more surfaces of the resultant concrete structure. The resultant concrete structure may then be removed from the form and moved into the desired location (e.g. in the case of pre-cast structures including tilt-up walls) or the form may be removed from the resultant concrete structure to leave the resultant concrete structure in place (e.g. in the case of cast-in-place structures). In some embodiments, it may be desirable to pour concrete into the form in multiple layers. In such embodiments, some of the blocks of method 800 (including modifications and variations thereof) may be repeated as desired to fabricate the desired structure.

Figure 16B:
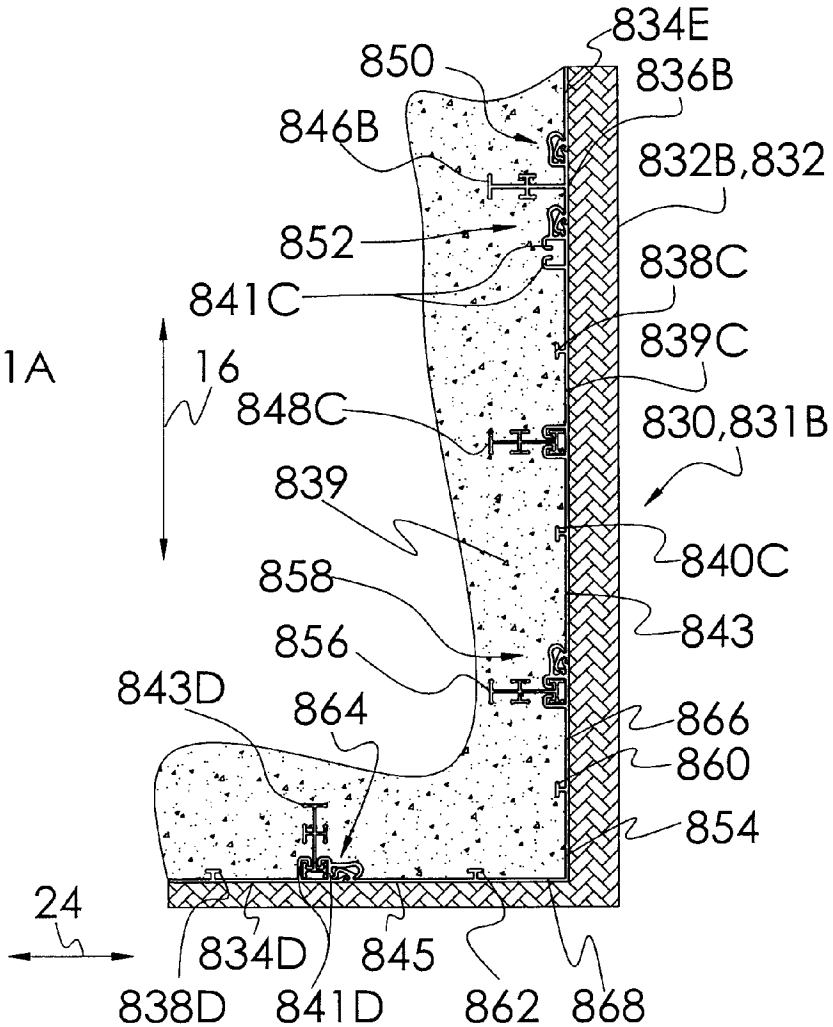
FIGS. 16A-16C are various cross-sectional views of a structure-lining apparatus according to a particular embodiment of the invention.
Figure 16A:
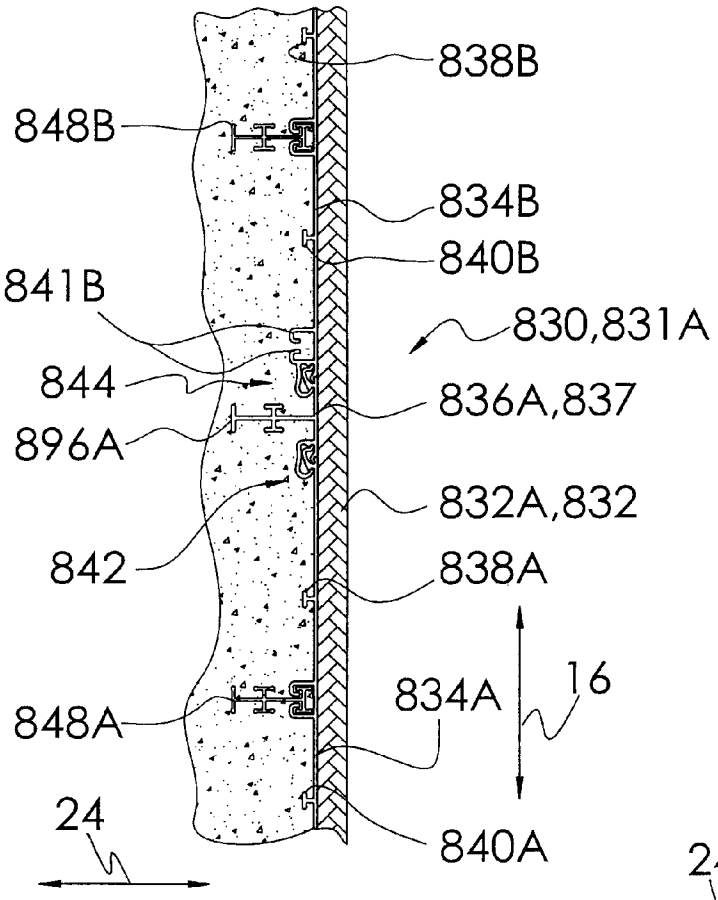
Figure 16C:
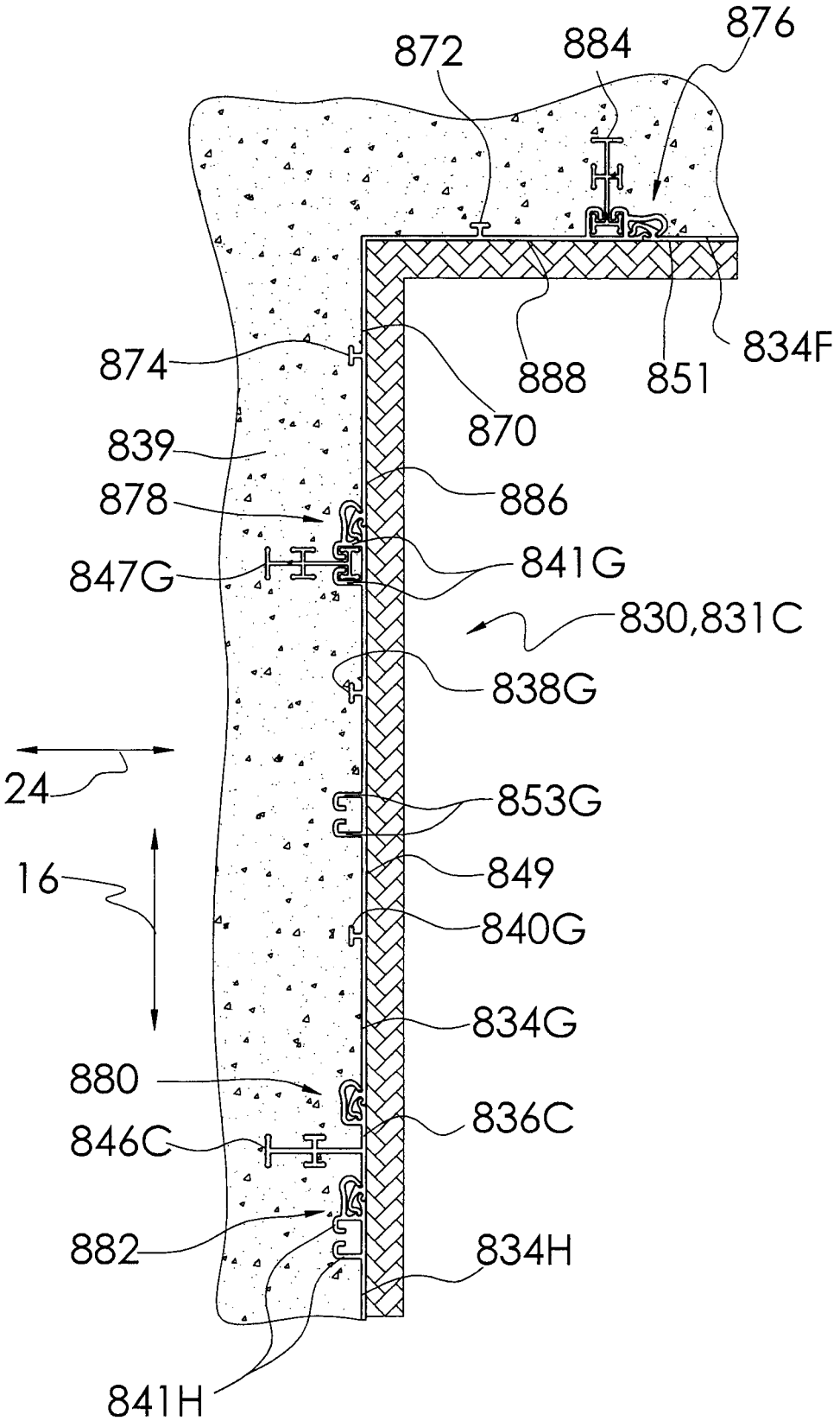

FIGS. 16A-16C show a number of partial views of an exemplary structure-lining apparatus 830 which may be used in accordance with method 800 and which may incorporate panels and connector-type, connectable-type and/or integral-type concrete-anchoring components similar to those shown in FIGS. 13A-13B, 14A-14F and 15A-15B. The particular structure-lining apparatus 830 shown in FIGS. 16A-16C is exemplary in nature. It should be appreciated that methods the same or similar to method 800 could be used to assemble a wide variety of other structure-lining apparatus using the panels and concrete-anchoring components described herein or variations and/or modifications of such panels and concrete-anchoring components.

FIG. 16A is a partial cross-sectional view of a portion 831A of an exemplary structure-lining apparatus 830 according to a particular embodiment of the invention. The illustrated portion 831A of structure-lining apparatus 830 shown in FIG. 16A includes a pair of identical panels 834A, 834B and third panel 836A. Panels 834A, 834B, 836A extend in transverse direction 16 and in longitudinal direction 14 (into and out of the page in FIG. 16A) to provide a structure-lining surface 837 that abuts against an interior surface of a corresponding portion 832A of form 832. In the illustrated view, panel 834A is connected in edge-to-edge relationship with transversely adjacent panel 836A at connection 842 and panel 836A is connected in edge-to-edge relationship with transversely adjacent panel 834B at connection 844. Connections 842, 844 between panels 834A, 836A, 834B may be similar to slidable and pivotable deformable snap-together connection 686, 738, 748 described above (see FIGS. 14E, 14F and 15B).

In the illustrated embodiment, panels 834A, 834B each comprise a plurality of integral-type concrete-anchoring components 838A, 838B and 840A, 840B. Integral-type concrete-anchoring components 838A, 838B and 840A, 840B are similar to integral-type concrete-anchoring components 220, 222 of structure-lining apparatus 210 (FIGS. 3A-3C) and incorporate concrete-anchoring features that are similar to concrete-anchoring features 89A (FIG. 1G). Panel 836A is substantially similar to panel 732 and incorporates an integral-type concrete-anchoring component 846A that is substantially similar to concrete-anchoring component 720 of panel 732 (see FIG. 15B).

Portion 831A of structure-lining apparatus 830 also comprises connectable-type concrete-anchoring components 848A, 848B which are respectively connected to panels 834A, 834B. In the illustrated embodiment, connectable-type concrete-anchoring components 848A, 848B are substantially similar to connectable-type concrete-anchoring component 600 and are connected to panels 834A, 834B using similar slidable connector components to those of concrete-anchoring component 600 (see FIG. 14A).

The FIG. 16A view shows that panel 834B incorporates a pair of unused connector components 841B. In some embodiments, connector components 841B may be used to connect to a connectable-type concrete-anchoring component similar to connectable-type concrete-anchoring component 848B. Such a concrete-anchoring component may be similar to concrete-anchoring component 600 of FIG. 14E. However, since panel 834B is connected to panel 836A and panel 836A incorporates integral-type concrete-anchoring component 846A which is in close proximity to connector components 841B, connector components 841B are unused in the illustrated embodiment. In other embodiments (e.g. where more anchoring strength may be required or where panel 834B is connected to another panel without a proximate concrete-anchoring component), a connectable-type concrete-anchoring component may be connected to connector components 841B.

In use, panels 834A, 834B, 836A are connected to one-another in edge-to-edge relationship and are inserted into form 832 such that structure-lining surface 837 provided by panels 834A, 834B, 836A abuts against an interior surface of a corresponding portion 832A of form 832. Connectable-type concrete-anchoring components 848A, 848B may be connected to panels 834A, 834B before or after panels 834A, 834B, 836A are connected to one-another. Concrete 839 is then poured into form 832. Liquid concrete 839 flows around the concrete-anchoring features of the concrete-anchoring components. As discussed above, connectable-type concrete-anchoring components 848A, 848B may be apertured to permit flow of concrete 839 therethrough.

Liquid concrete 839 may flow into spaces between panels 834A, 834B, 836A and the concrete-anchoring features of the concrete-anchoring components 838A, 838B, 840A, 840B, 846A, 848A, 848B. When concrete 839 solidifies, form 832 may be removed and concrete 839 located in these spaces anchors panels 834A, 834B, 836A and structure-lining surface 837 to at least a portion of the exterior surface of the resultant concrete structure.

FIG. 16B is a partial cross-sectional view of a second portion 831B of exemplary structure-lining apparatus 830. Portion 831B differs from portion 831A (FIG. 16A) in that portion 831B includes an outside corner panel 854 for lining an outside corner surface of a corresponding concrete-structure. Portion 631B includes panels 834C, 834D, 834E which are substantially similar to panels 834A, 834B (FIG. 16A) and panel 836B which is substantially similar to panel 836A (FIG. 16A). The components of panels 834C, 834D, 834E and panel 836B are assigned reference numerals similar to those of corresponding components of panels 834A, 834B and panel 836A described above, except that they are indexed by a corresponding trailing letter. In the illustrated view, panel 834E is connected in edge-to-edge relationship with adjacent panel 836B at connection 850, panel 836B is connected in edge-to-edge relationship with adjacent panel 834C at connection 852, panel 834C is connected to adjacent outside corner panel 854 at connection 858 and outside corner panel 854 is connected to adjacent panel 834D at connection 864.

In the illustrated embodiment, outside corner panel 854 comprises integral-type concrete-anchoring components 860, 862 and is connected to connectable-type concrete-anchoring component 856. In the illustrated embodiment, integral-type concrete-anchoring components 860, 862 are substantially similar to integral-type concrete-anchoring components 838A, 840A of panel 834A and connectable-type concrete-anchoring component 856 is substantially similar to connectable-type concrete-anchoring component 848A connected to panel 834A.

Outside corner panel 854 comprises a 90° outside corner in the illustrated view, but this is not necessary. In other embodiments, outside corner panels may be provided with other angles as desired. In the FIG. 16B view, panels 834C, 834E, 836B together with a first portion 866 of outside corner panel 854 form part of a first structure-lining surface 843 and panel 834D together with a second portion 868 of outside corner panel 854 provide a portion of a second structure-lining surface 845 that is oriented at 90° from first surface 843. It will be appreciated that because of the 90° corner provided by panel 854, inward/outward direction 24 and transverse direction 16 of first surface 843 are respectively equivalent to a transverse direction and an inward/outward direction for second surface 845.

In the illustrated embodiment, outside corner panel 854 is connected to a single connectable-type concrete-anchoring component 856. Concrete-anchoring component 856 is connected to first portion 866 of outside corner panel 854 and there are no connectable-type concrete-anchoring components connected to second portion 868 of outside corner panel 854. As such, as shown in FIG. 16B, a connectable-type concrete-anchoring component 847D may be connected to panel 834D using connector components 841D. While it is not shown in the illustrated view, a connectable-type concrete-anchoring component 848D may or may not also be connected to panel 834D at or near its center.

FIG. 16C is a partial cross-sectional view of a third portion 831C of exemplary structure-lining apparatus 830. Portion 831C differs from portions 831A, 831B (FIGS. 16A, 16B) in that portion 831C includes an inside corner panel 80 for lining an inside corner surface of a corresponding concrete-structure. Portion 831C includes panels 834F, 834G, 834H which are substantially similar to panels 834A, 834B (FIG. 16A) and panel 836C which is substantially similar to panel 836A (FIG. 16A). The components of panels 834F, 834G, 834H and panel 836C are assigned reference numerals similar to those of corresponding components of panels 834A, 834B and panel 836A described above, except that they are indexed by a corresponding trailing letter. In the illustrated view, panel 834H is connected in edge-to-edge relationship with adjacent panel 836C at connection 882, panel 836C is connected in edge-to-edge relationship with adjacent panel 834G at connection 880, panel 834G is connected to adjacent inside corner panel 870 at connection 878 and inside corner panel 870 is connected to adjacent panel 834F at connection 876.

In the illustrated embodiment, inside corner panel 870 comprises integral-type concrete-anchoring components 872, 874 and is connected to connectable-type concrete-anchoring component 884. In the illustrated embodiment, integral-type concrete-anchoring components 872, 874 are substantially similar to integral-type concrete-anchoring components 838A, 840A of panel 834A (FIG. 16A) and connectable-type concrete-anchoring component 884 is substantially similar to connectable-type concrete-anchoring component 848A connected to panel 834A (FIG. 16A).

Inside corner panel 870 may comprise a 90° inside corner, but this is not necessary. In other embodiments, inside corner panels may be provided with other angles as desired. In the FIG. 16C view, panels 834G, 834H, 836C together with a first portion 886 of inside corner panel 870 form part of a first structure-lining surface 849 and panel 834F together with a second portion 888 of inside corner panel 870 provide a portion of a second structure-lining surface 851 that is oriented at 90° from first surface 849. It will be appreciated that because of the 90° corner provided by panel 870, inward/outward direction 24 and transverse direction 16 of first surface 849 are respectively equivalent to a transverse direction and an inward/outward direction for second surface 851.

In the illustrated embodiment, inside corner panel 870 is connected to a single connectable-type concrete-anchoring component 884. Concrete-anchoring component 884 is connected to second portion 888 of inside corner panel 870 and there are no connectable-type concrete-anchoring components connected to first portion 886 of inside corner panel 870. As such, as shown in FIG. 16B, a connectable-type concrete-anchoring component 847G may be connected to panel 834G using connector components 841G. In illustrated embodiment, connector components 853G at or near the center of panel 834G are left without a corresponding connectable-type concrete-anchoring component; however, in other embodiments, a central connectable-type concrete-anchoring component 848G may be connected to connector components 853G.

FIGS. 16A-16C represent one particular embodiment of a structure-lining apparatus 830 that could be used to line a concrete-structure during fabrication thereof. Structure-lining apparatus may be used to line any one or more surfaces of any concrete structure. There may be a wide variety of variations and/or modifications to structure-lining apparatus 830 as described herein. By way of non-limiting example, such variations and/or modifications may include: structure-lining apparatus 830 may incorporate connector-type concrete-anchoring components or different types of integral-type and/or connectable-type concrete-anchoring components; any of the connector components of the panels or concrete-anchoring components of structure-lining apparatus 830 may be modified to provide any of the different types of connector components described herein; the concrete-anchoring portions and concrete-anchoring features of the concrete-anchoring components of structure-lining apparatus may be modified to provide any of the different types of concrete-anchoring portions and concrete-anchoring features described herein; or the like.

Use of structure-lining apparatus 830 to line a concrete structure during fabrication may be similar to method 800 (FIG. 18). However, the use of structure-lining apparatus 830 to line a concrete structure may be varied and/or modified in accordance with any of the variations and/or modifications described herein for method 800 or in accordance with a wide variety of other variations and/or modifications which will be appreciated by those skilled in the art.

As described above, in some applications, it is desirable to include insulation material in a concrete-structure. Such insulation is optional. Insulation may be provided in the form of rigid foam insulation. Non-limiting examples of suitable materials for rigid foam insulation include: expanded polystyrene, poly-urethane, poly-isocyanurate or any other suitable moisture resistant material. Particular embodiments of the invention provide insulation-anchoring components (connector-type, connectable-type and/or integral-type insulation anchoring components) which may be used to anchor a structure-lining apparatus to insulation and to thereby anchor the insulation to the resultant concrete structure. Such insulation-anchoring components may comprise an insulation-anchoring portion which projects into a channel formed in the insulation material and/or is shaped to project directly into the insulation material by deforming the insulation material during penetration. The insulation-anchoring portions may comprise insulation-anchoring features to anchor the insulation-anchoring component to the insulation after projection therein. Such insulation-anchoring features may comprise one or more barbs.

Figures 17, 17B:
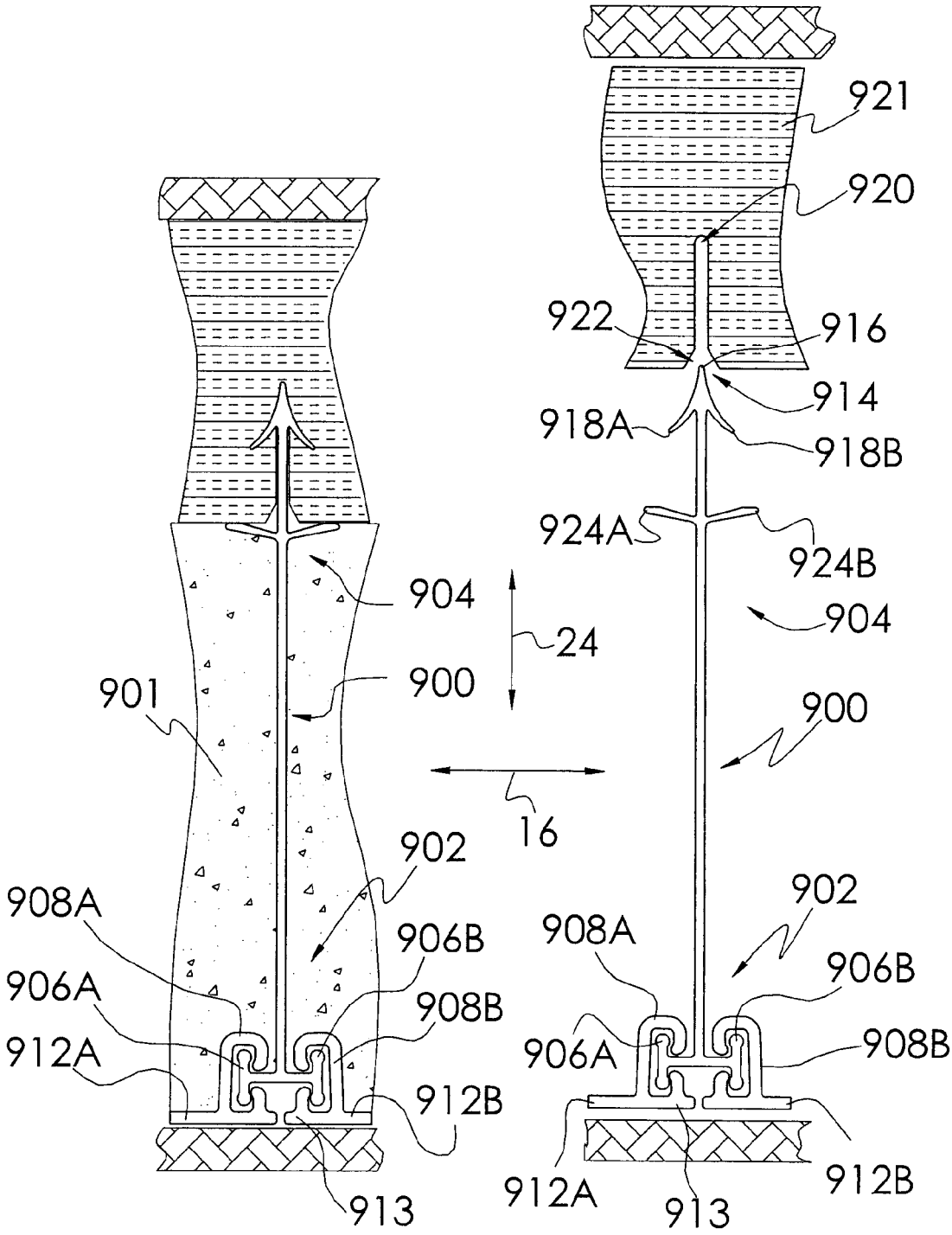

FIGS. 17A and 17B respectively depict cross-sectional and partially exploded cross-sectional views of a connector-type insulation-anchoring component 900 according to a particular embodiment of the invention together with partial views of the panels 912A, 912B (collectively, panels 912) which are connected to one another in edge-adjacent relationship by connector-type insulation-anchoring component 900 to provide structure-lining surface 913. While not shown in the illustrated view, the structure-lining apparatus shown in FIGS. 17A, 17B may comprise concrete-anchoring components for anchoring to concrete layer 901.

Connector-type insulation-anchoring component 900 comprises a connection portion 902 and an insulation-anchoring portion 904. In the illustrated embodiment connection portion 902 of connector-type insulation-anchoring component 900 is substantially similar to connection portion 502 of connector-type concrete-anchoring component 500 (FIG. 13A) and comprises a pair of T-shaped male slidable connector components 906A, 906B that connect to corresponding C-shaped female slidable connector components 908A, 908B to connect panels 912 to one another in edge-adjacent relationship. Connection portion 902 of connector-type insulation-anchoring component 900 may comprise any of the features, variations and/or modifications described herein for connection portion 502 of connector-type concrete-anchoring component 500.

In the illustrated embodiment, insulation-anchoring portion 904 incorporates an insulation-anchoring feature 914 which comprises a pointed portion 916 for projecting into insulation 921 and a pair of barbs 918A, 918B (collectively, barbs 918). In operation, insulation-anchoring feature 914 projects into insulation 921 and anchors insulation 921 to insulation-anchoring component 900. Pointed portion 916 helps to facilitate the projection of insulation-anchoring feature 914 into insulation 921. Insulation 921 may additionally be provided with a channel 920 into which insulation-anchoring feature 914 may project, although this is not necessary. In the illustrated embodiment, channel 920 comprises a beveled entrance 922 which helps to guide pointed portion 916 into channel 920.

Barbs 918 may be deformable toward one another in transverse directions 16 to help facilitate projection of insulation-anchoring feature 914 into insulation 921. In the illustrated embodiment, insulation-anchoring feature 914 comprises a pair of wings 924A, 924B (collectively, wings 924). Wings 924 may abut against insulation 921 (as shown in FIG. 19A) to prevent excessive penetration of insulation-anchoring feature 914 into insulation 912. Wings 924 may be resiliently deformable. Once insulation-anchoring feature 914 penetrates into insulation 921, barbs 918 may deform away from one another in transverse directions 16 to make it more difficult to separate insulation 921 from insulation-anchoring component 900. In some embodiments, insulation-anchoring feature 914 may be provided with a different number of barb(s) 918. In some embodiments, rather than projecting into insulation 921 in inward/outward direction 24, insulation-anchoring feature 914 may be slid relative to insulation 921 in longitudinal direction 24 (into and out of the page of FIGS. 9A, 9B) into a preformed channel (not shown) in insulation 921.

Figure 17C:
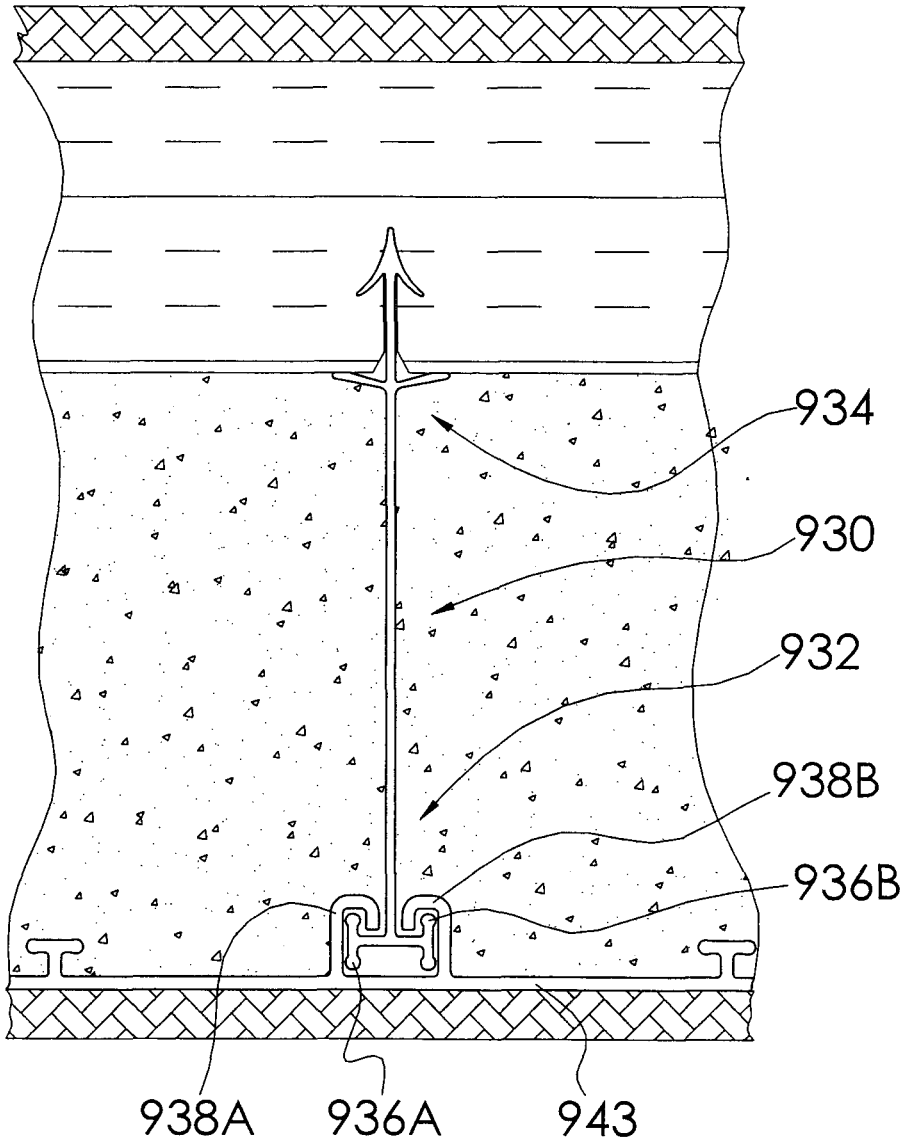
FIG. 17C is a cross-sectional view of a connectable-type insulation-anchoring component according to a particular embodiment together with a partial view of the panel to which the insulation-anchoring component is connected.

FIG. 17C is a cross-sectional view of a connectable-type insulation-anchoring component 930 according to a particular embodiment of the invention together with a partial view of the panel 942 to which insulation-anchoring component 930 is connected to provide structure-lining surface 943. Connectable-type insulation-anchoring component 930 comprises a connection portion 932 and an insulation-anchoring portion 934. In the illustrated embodiment, connection portion 932 of connectable-type insulation-anchoring component 930 is substantially similar to connection portion 602 of connectable-type concrete-anchoring component 600 (FIG. 14A) and comprises a pair of T-shaped male slidable connector components 936A, 936B that connect to corresponding J-shaped female slidable connector components 938A, 938B to connect insulation-anchoring component 930 to panel 942. Connection portion 932 of connectable-type insulation-anchoring component 930 may comprise any of the features, variations and/or modifications described herein for connector portion 602 of connectable-type concrete-anchoring component 600. Insulation-anchoring portion 934 of connectable-type insulation-anchoring component 930 may be substantially similar to insulation-anchoring portion 904 of connector-type insulation-anchoring component 900 (FIGS. 17A, 17B) and may comprises any of the features, variations and/or modifications of described herein for insulation-anchoring portion 904.

Although not explicitly shown, it will be appreciated that integral-type insulation-anchoring components could be integrally formed with structure-lining panels in particular embodiments of the invention. Any of the insulation-anchoring components described herein may be provided with apertures that extend in inward/direction 24 and in longitudinal direction 14 (into and out of the page in FIGS. 17A-17C) to facilitate the flow of liquid concrete therethrough.

Method 800 for lining a concrete structure during fabrication may be modified to accommodate the introduction of insulation and insulation-anchoring components. In particular embodiments, insulation-anchoring components may first be connected to the insulation (e.g. by projection of insulation-anchoring feature 914 into the insulation as discussed above) and then the insulation together with the insulation-anchoring components may be: connected to corresponding panels (in the case of connectable-type insulation-anchoring components); and/or connected to a pair of edge-adjacent panels to connect the pair of panels in edge-adjacent relationship (in the case of connector-type insulation anchoring components). In some embodiments, the insulation-anchoring components may be connected to corresponding panels or to corresponding pairs of edge-adjacent panels and then subsequently connected to the insulation. In embodiments incorporating integral-type insulation-anchoring components, it is not necessary to connect the insulation-anchoring components to panel(s).

In general, the addition of these steps may be accommodated anywhere in method 800 (i.e. in any order relative to the other blocks of method 800) to form the desired structure. By way of non-limiting example, it may be desirable to connect connector-type insulation-anchoring components to the insulation prior to block 804 and then to connect the structure-lining panels to one another in block 804 using the connector-type insulation-anchoring components. By way of another non-liming example, it may be desirable to connect connectable-type insulation-anchoring components to panels prior to pouring a first proximate layer of concrete in block 812 and then to subsequently connect insulation to the insulation-anchoring features of the insulation-anchoring components and then to subsequently pour a second distal layer of concrete. It will be appreciated that a large number of variations of method 800 could be provided to accommodate the steps of connecting concrete-anchoring components to insulation and, if required, to the structure-lining panel(s).

Figure 17D:
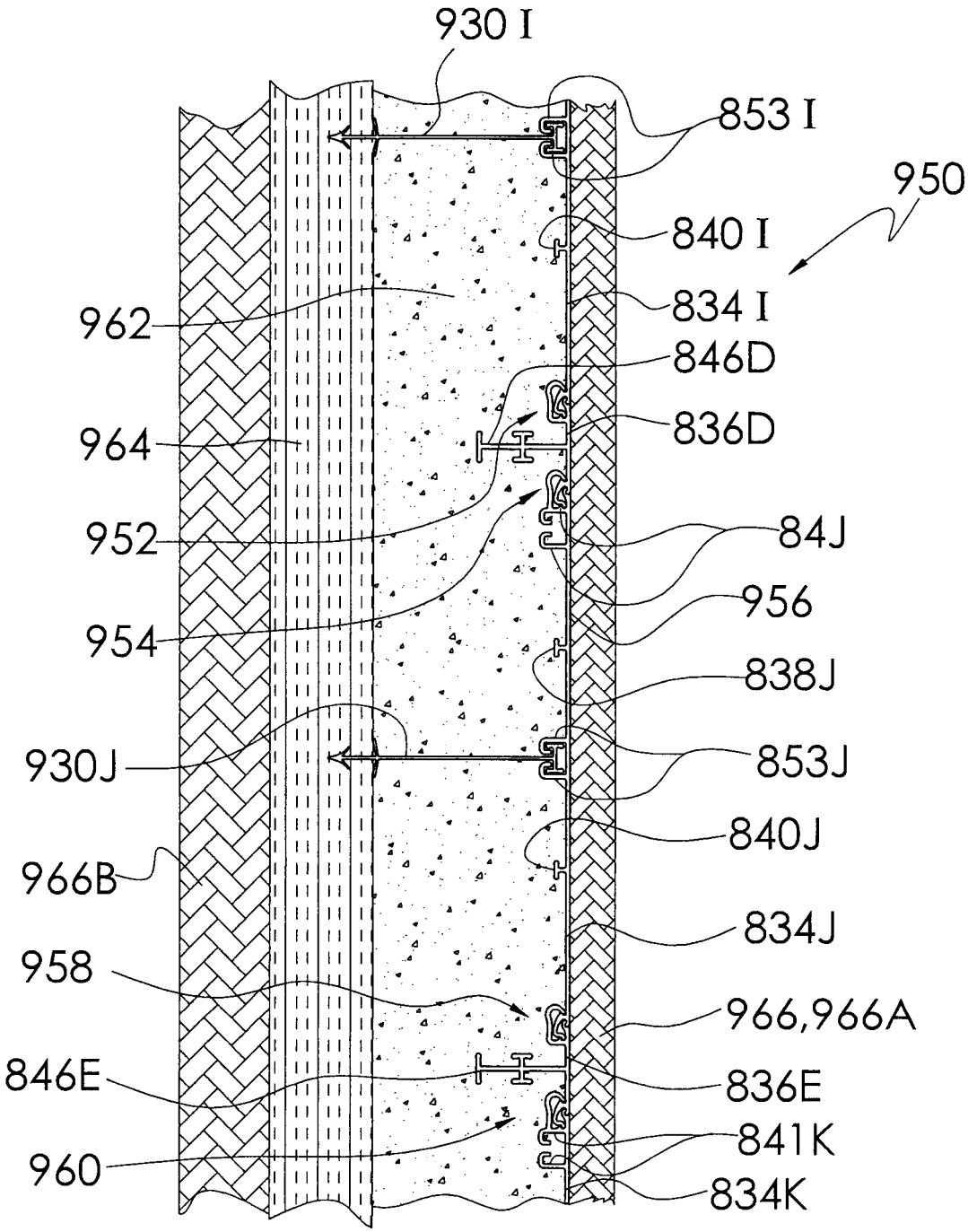
FIG. 17D is a cross-sectional view of a structure-lining apparatus comprising the FIG. 15B concrete-anchoring components and the FIG. 17A insulation-anchoring components according to a particular embodiment of the invention.

FIG. 17D shows a partial cross-sectional view of an exemplary structure-lining apparatus 950 which may be used in accordance with method 800 and which may incorporate panels, concrete-anchoring components similar to those described herein and connector-type, connectable-type and/or integral-type insulation-anchoring components similar to those shown in FIGS. 17A-17C. The particular structure-lining apparatus 950 shown in FIG. 17D is exemplary in nature. It should be appreciated that methods the same or similar to method 800 could be used to assemble a wide variety of other structure-lining apparatus using the panels, concrete-anchoring components and insulation-anchoring components described herein or variations and/or modifications of such panels, concrete-anchoring components and insulation-anchoring components.

The portion of structure-lining apparatus 950 shown in FIG. 17D includes three identical panels 834I, 834J, 834K (which are substantially similar to panels 834A, 834B (FIG. 16A)) and panels 836D, 836E (which are substantially similar to panel 836A (FIG. 16A)). The components of panels 834I, 834J, 834K and panels 836D, 836E are assigned reference numerals similar to those of corresponding components of panels 834A, 834B and panel 836A described above, except that they are indexed by a corresponding trailing letter. In the illustrated view, panel 834I is connected in edge-to-edge relationship with adjacent panel 836D at connection 952, panel 836D is connected in edge-to-edge relationship with adjacent panel 834J at connection 954, panel 834J is connected in edge-to-edge relationship with adjacent panel 836E at connection 958 and panel 836E is connected in edge-to-edge relationship with adjacent panel 834K at connection 960. Together, these panels provide structure lining surface 956 which abuts against a corresponding interior surface of a portion 966A of form 966.

In the illustrated embodiment, panels 834I, 834J, 834K each comprise a plurality of integral-type concrete-anchoring components 838I, 838J, 838K and 840I, 840J, 840K which are substantially similar to integral-type concrete-anchoring components 838A, 838B and 840A, 840B of panels 834A, 834B (FIG. 16A) and which may incorporate any of the features, modifications and/or variations thereof. Panels 836D, 836E incorporate integral-type concrete-anchoring components 846D, 846E which are substantially similar to integral-type concrete-anchoring component 846A of panel 836A (FIG. 16A) and which may incorporate any of the features, modifications and/or variations thereof. In the illustrated embodiment, these concrete-anchoring components 838I, 838J, 838K, 840I, 840J, 840K, 846D, 846E anchor structure-lining apparatus to concrete layer 962. In other embodiments, additional connectable-type concrete-anchoring components could be connected to unused connector components 841I, 841J, 841K of panels 834I, 834J, 834K, if extra concrete-anchoring strength were required, for example.

In the illustrated view, structure-lining apparatus 950 is shown to comprise connectable-type insulation-anchoring components 9301, 930J which are connected to corresponding panels 834I, 834J at central connector components 853I, 853J. Connectable-type insulation anchoring components 930I, 930J are substantially similar to connectable-type insulation-anchoring component 930 (FIG. 17C) and may incorporate any of the features, variations and/or modifications thereof. Connectable-type insulation anchoring components project into insulation 964 to anchor insulation 964 to structure-lining apparatus 950.

In use, panels 834I, 834J, 834K, 836D, 836E are connected to one-another in edge-to-edge relationship and are inserted into form 966 such that structure-lining surface 956 provided by panels 834I, 834J, 834K, 836D, 836E abuts against an interior surface of a corresponding portion 966A of form 966. Connectable-type insulation-anchoring components 930I, 930J may be connected to panels 834I, 834J before or after panels 834I, 834J, 834K, 836D, 836E are connected to one-another. In addition, connectable-type insulation-anchoring components 930I, 930J may be connected to insulation 964 before or after concrete 962 is poured and/or before or after insulation-anchoring components 930I, 930J are connected to their corresponding panels 834I, 834J.

The order of connecting the components of structure-lining apparatus 950 to one another, installing insulation and pouring concrete may be dictated by the structure desired to be formed. By way of non-limiting example, form 966 (including portions 966A and 966B) may be assembled and then panels 834I, 834J, 834K, 836D, 836E may be connected to one-another and inserted into the form such that structure-lining surface 956 abuts against portion 966A of form 966. Insulation-anchoring components 930I, 930J may then be connected to insulation 964 and then the combination of insulation 964 and insulation-anchoring components 930I, 930J may be slid into form 966 such that insulation abuts against portion 966B of form 966 and insulation-anchoring components 930I, 930J connect to connector components 853I, 853J of panels 834I, 834J. Concrete 962 may then be poured between insulation 964 and panels 834I, 834J, 834K, 836D, 836E. In another non-limiting example, where form portion 966A is horizontal, panels 834I, 834J, 834K, 836D, 836E may be connected to one-another atop form portion 966A and insulation-anchoring components 930I, 930J may be connected to panels 834I, 834J. Concrete 962 may then be poured prior to connection of insulation 964 to insulation-anchoring components 930I, 930J.

Figure 17E:
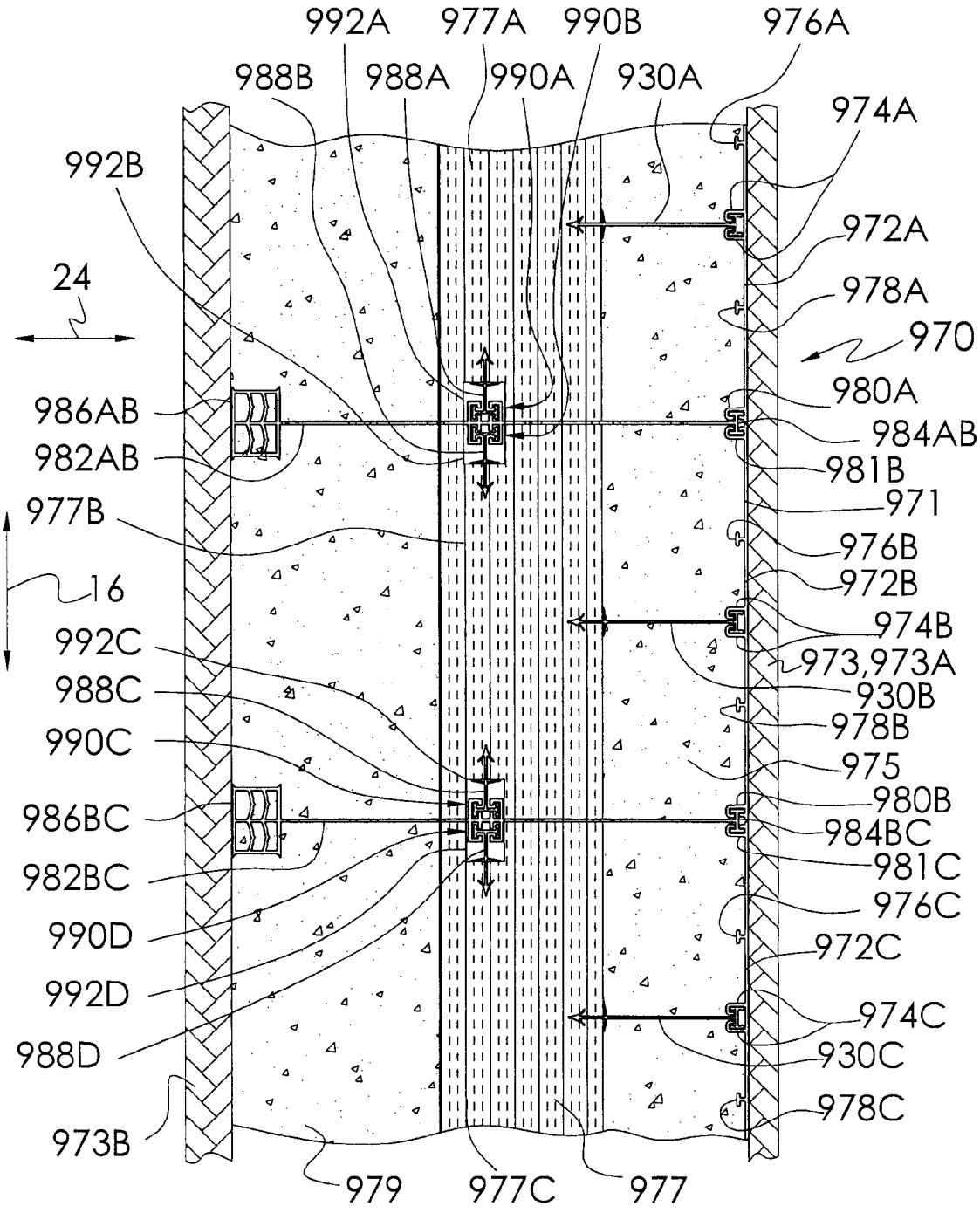
FIG. 17E is a cross-sectional view of a structure-lining apparatus comprising the FIG. 9A concrete-anchoring components, the FIG. 17A insulation-anchoring components and additional transverse insulation-anchoring components according to another embodiment of the invention.

FIG. 17E shows a partial cross-sectional view of an exemplary structure-lining apparatus 970 which may be used in accordance with method 800 and which may incorporate: panels; concrete-anchoring components similar to those described herein; connector-type, connectable-type and/or integral-type insulation-anchoring components similar to those shown in FIGS. 17A-17C; and additional transversely extending insulation-anchoring components. The particular structure-lining apparatus 970 shown in FIG. 17E is exemplary in nature. It should be appreciated that methods similar to method 800 could be used to assemble a wide variety of other structure-lining apparatus using the panels, concrete-anchoring components and insulation-anchoring components described herein or variations and/or modifications of such panels, concrete-anchoring components and insulation-anchoring components.

The illustrated portion of structure-lining apparatus 970 shown in FIG. 17E includes a three identical panels 972A, 972B, 972C (collectively, panels 972) which extend in transverse direction 16 and in longitudinal direction 14 (in and out of the page of FIG. 17E) and which are connected in edge-to-edge relationship at their transverse edges by connector-type concrete-anchoring components 982AB, 982BC (collectively, connector-type concrete-anchoring components 982) to provide a structure-lining surface 971 which abuts against an interior surface of a corresponding portion 973A or form 973. The components of panels 972 are similar to components of other panels described herein. In the illustrated view, panels 972 comprise C-shaped female slidable connector components 980A, 980B, 981B, 981C (collectively, connector components 980, 981) which connect to a pair of T-shaped male slidable connector components 984AB, 984BC (collectively, connector components 984) on connector-type concrete-anchoring components 982 so as to connect panels 972 in edge-to-edge relationship. It will be appreciated that any of the other connector components described herein could be used in the place of connector components 980, 981, 984.

In the illustrated embodiment, panels 972 comprise integral-type concrete-anchoring components 976A, 978A, 976B, 978B, 976C, 978C (collectively, integral-type concrete-anchoring components 976, 978). Integral-type concrete-anchoring components 976, 978 help to anchor panels 972 to concrete layer 975. Integral-type concrete-anchoring components 976, 978 may comprise any of the features, modifications or variations described herein for other integral-type concrete-anchoring components. Panels 972 of the illustrated embodiment also comprise connector components 974A, 974B, 974C (collectively, connector components 974) for connecting to corresponding connectable-type insulation-anchoring components 930A, 930B, 930C (collectively, connectable-type insulation-anchoring components 930). Connectable-type insulation-anchoring components 930 are substantially similar to insulation-anchoring components 930 of FIG. 17C and may comprise any features, variations and/or modifications thereof. Connectable-type insulation-anchoring components 930 help to anchor panels 972 to insulation 977.

In the illustrated embodiment, connector-type concrete-anchoring components 982 comprise attachment units 986AB, 986BC (collectively, 986) which are similar to attachment units 318 (FIGS. 9A-9C) described above and which may comprise any features, variations and/or modifications thereof. Attachment units 986 provide the dual function of accommodating fasteners (e.g. for siding) and anchoring structure-lining apparatus 970 to concrete-layer 979.

In the illustrated embodiment, structure-lining apparatus 970 also comprises transverse connectable-type insulation-anchoring components 988A, 988B, 988C, 988D (collectively, transverse insulation-anchoring components 988). Transverse insulation-anchoring components 988 of the illustrated embodiment are connectable-type insulation anchoring components which connect to concrete-anchoring components 982 (rather than to panels) but which may otherwise be similar to insulation-anchoring components 930 (FIG. 17C). Transverse insulation-anchoring components 988 may comprise connection portions similar to connection portion 932 of concrete-anchoring component 930 (FIG. 17C) which have connector components for connecting to corresponding connector components on concrete-anchoring components 982 to provide connections 990A, 990B, 990C, 990D (collectively, connections 990). Transverse insulation-anchoring components 988 also comprise insulation-anchoring portions that are similar to insulation-anchoring portion 934 of concrete-anchoring component 930 (FIG. 17C). Rather than projecting into insulation 977 in inward/outward direction 24 (like the insulation-anchoring components described above), transverse insulation anchoring components may be rotated by 90° to project into insulation 977 in transverse directions 16. To accommodate transverse insulation-anchoring components 988, insulation 977 may be provided with indentations 992A, 992B, 992C, 992D (collectively, indentations 992) as shown in FIG. 17E. Transverse insulation-anchoring components 988 may otherwise comprise any of the features, variations and/or modifications of other insulation-anchoring components described herein.

In use, panels 972 are connected to one-another in edge-to-edge relationship and are inserted into form 973 such that structure-lining surface 971 provided by panels 972 abuts against an interior surface of a corresponding portion 973A of form 973. Connector-type concrete-anchoring components 982 may be used to connect panels 972 to one another. In one particular embodiment, connectable-type insulation-anchoring components 930 and transverse insulation-anchoring components 988 are then connected to insulation 977. In particular embodiments, insulation may be provided in blocks 977A, 977B, 977C (collectively, insulation blocks 977) and one connectable-type insulation anchoring component 930 and a pair of transverse insulation-anchoring components 988 may be connected to each insulation block 977. Insulation blocks 977 may then be installed between connector-type concrete anchoring components 982 so as to connect connectable-type insulation-anchoring components 930 to their corresponding panels 972 and to connect transverse insulation-anchoring components 988 to their corresponding concrete-anchoring components 982. The second part 973B of form 973 may be assembled before or after insulation blocks 977 are installed. Concrete may then be poured in to form concrete layers 975, 979. Concrete layers 975, 979 may be formed simultaneously or one after the other.

As will be apparent to those skilled in the art in the light of the foregoing disclosure, many alterations and modifications are possible in the practice of this invention without departing from the spirit or scope thereof. For example:

Any of the connections formed by connector components described herein may be varied by reversing the connector components (e.g. replacing male connector components with female connector components and vice versa). Connections formed by slidable connector components may be implemented by providing connector components having other mating shapes which are slidable.

Any of the connector components described herein may be varied to provide other types of connector components for connecting parts of structure-lining apparatus to one another. By way of non-limiting example, such connector components may form slidable connections, deformable "snap-together" connections, pivotable connections, or connections incorporating any combination of these actions. By way of non-limiting example, a number of suitable pivotable and deformable snap-together connections are described in co-owned U.S. application No. 60/986,973 filed 9 Nov. 2007 which has been incorporated herein by reference and a number of suitable slidable, pivotable and deformable snap-together connections are described in co-owned U.S. application No. 61/022,505 filed 21 Jan. 2008 which has been incorporated herein by reference.

In particular embodiments described herein for forming tilt-up walls, wall-lining apparatus are described as being fabricated on a table. This is not necessary. In some embodiments or applications, wall-lining apparatus may be assembled at any suitable location and then transferred to a table (or any other location with a generally horizontal surface) for pouring of concrete and fabrication of the corresponding wall segment. It is not necessary that tilt-up walls be fabricated on a table. In some embodiments or applications for forming tilt-up walls, the structural form may be provided on any suitable surface that is generally horizontal. Such a surface may be referred to as a slab, for example.

In the embodiments described herein, the structural material used to fabricate the wall segments is concrete. This is not necessary. In some applications, it may be desirable to use other structural materials which may be initially be poured into forms and may subsequently solidify. As such, the description of various components and/or features as concrete-anchoring components or concrete-anchoring features or the like is merely for convenience and need not be interpreted in a limiting sense.

Structure-lining apparatus 230 (FIGS. 4A-4C) includes panels 231 having female connector components 234 on one transverse edge and male connector components 232 on the opposing transverse edge, such that transversely adjacent panels may be connected directly to one another without the use of connector-type concrete or insulation-anchoring components. Similarly, FIGS. 14E and 14F show a similar direct connection between connector components 688, 690 of panels 612A, 612B. Any of the other embodiments described herein may be modified to provide these types of direct connections between transversely adjacent panels.

In some embodiments, sound-proofing materials may be layered into the structures described above or may be connected to attachment units (e.g. attachment unit 318 of FIGS. 9A-9C). Suitable sound-proofing-anchoring components (connector-type, connectable-type or integral type) may be provided for the structure-lining apparatus described herein.

Attachment units similar to attachment units 318 described herein may be placed at other locations within a structure to be formed. In some embodiments, it is not necessary for such attachments units to be connected to other components of the structure-lining apparatus, as such attachment units could be maintained in place by the concrete itself.

Plugs like interface plugs 350, 350A can also be used between wall segments of tilt-up walls formed using other technology.

Braces similar to braces 28 may be used to connect inward/outward portions 345 of corner panels 342 to other parts of the structure-lining apparatus described herein (e.g. to panels or to transversely extending portions of corner panels 342 themselves). Similarly, braces similar to braces 28 may be used to connect portions 866, 868 of outside corner panel 854 to other parts of the structure-lining apparatus described herein (e.g. to panels or to the other portion of outside corner panel 854).

In many of the embodiments described above, some of the concrete-anchoring features on panels and/or on concrete-anchoring components can also function as connector components for connecting other form-work components (e.g. braces similar to braces 28).

In the embodiments described above, connectable-type concrete and insulation-anchoring components are described as connecting to a single panel. In other embodiments, such connectable-type anchoring components can connect to other components of the structure-lining apparatus (e.g. to connectors which connect-edge adjacent panels to one another). By way of non-limiting example, connectable-type concrete-anchoring components could be connected to connector component 258 of concrete-anchoring component 254 (FIGS. 5A-5C) or to concrete-anchoring feature 614C of concrete-anchoring component 600 (FIG. 14A).

In particular embodiments described herein, the structure-lining panels extend in a longitudinal direction 14 and in a transverse direction 16 to provide generally planar structure-lining surfaces. This is not necessary. In some embodiments, the panels may be fabricated with some curvature to line a correspondingly curved structural form or may be deformed to line a correspondingly curved structural form and to thereby provide a curved structure-lining surface. In particular embodiments, this curvature will be in the transverse direction such that panels remain substantially unchanged in the longitudinal direction. In such embodiments, it will be appreciated that both the precise transverse direction 16 (now a tangential direction) and the precise inward/outward direction (now a radial direction) depend on where (i.e. the point on the panel) such directions are being assessed. In other embodiments, this curvature may be in the longitudinal direction such that panels remain substantially unchanged in the transverse direction.

In some embodiments where structures are fabricated on a horizontal surface (e.g. tilt-up walls), it is not necessary that there be structural form-work to form the upper surface of the structure—i.e. gravity can be used to ensure that liquid concrete is formed to have the desired shape. In such embodiments, it may be possible to place structure-lining apparatus according to particular embodiments described herein atop the liquid concrete, such that the panels of the structure-lining apparatus form a structure-lining surface and the concrete-anchoring components project downwardly into the liquid concrete.

Many embodiments and variations are described above. Those skilled in the art will appreciate that various aspects of any of the above-described embodiments may be incorporated into any of the other ones of the above-described embodiments by suitable modification.

It will be appreciated that for lining general structures as described herein, the longitudinal, transverse and inward/outward directions described herein may have any particular orientations depending on the orientation of the form in which the structure is cast.

Accordingly, the scope of the invention should be defined in accordance with the substance defined by the following claims.

What is claimed is:

1. A method for lining one or more surfaces of a structure formed from material that is cast as a liquid and subsequently solidifies, the method comprising:

providing a structural form in which to cast the material;

connecting a plurality of panels which extend in substantially orthogonal transverse and longitudinal directions in edge-adjacent relationship at their respective transverse edges to provide an open-ended structure-lining surface comprising a first unconnected transverse edge of a first edge panel at a first transverse edge of the structure lining surface and a second unconnected transverse edge of a second edge panel at a second transverse edge of the structure lining surface, the first and second transverse edges of the structure lining surface opposed from one another;

inserting the plurality of panels into the structural form such that at least a portion of the structure-lining surface abuts against a corresponding portion of the structural form;

projecting a plurality of anchoring components from the panels in an inward/outward direction orthogonal to both the transverse and longitudinal directions, the anchoring components each comprising one or more anchoring features which extend in at least one of the longitudinal and transverse directions; and inserting liquid material into the structural form to encase the one or more anchoring features as the material solidifies and to thereby bond the anchoring components to the structure;

wherein:

the plurality of anchoring components comprises one or more connectable anchoring components;

projecting the plurality of anchoring components in the inward/outward direction comprises connecting a connector component on the connectable anchoring component to a corresponding connector component on a corresponding panel; and the corresponding portion of the structural form is separated from the material by the structure-lining surface.

2. A method according to claim 1 wherein the plurality of anchoring components comprises one or more connector anchoring components and wherein connecting the plurality of panels at their respective transverse edges comprises, for each pair of edge-adjacent panels, connecting a pair of connector components on the connector anchoring component to corresponding connector components on adjacent transverse edges of the pair of edge-adjacent panels to connect the pair of edge-adjacent panels in edge-adjacent relationship.

3. A method according to claim 1 wherein the plurality of anchoring components comprises one or more integral anchoring components, each integral anchoring component integrally formed with a corresponding panel.

4. A method according to claim 1 comprising providing one or more of the anchoring components with apertures which extend in the longitudinal and inward/outward directions for permitting flow of the material therethrough when the material is a liquid.

5. A method according to claim 1 wherein inserting liquid material into the form comprises inserting a proximate material layer that is located relatively close to the panels and inserting a distal material layer which is located relatively far from the panels and which is spaced apart from the proximate material layer in the inward/outward direction and wherein the anchoring features are located in the distal material layer.

6. A method according to claim 1 comprising inserting an insulation layer into the form in a location adjacent to the panels and wherein inserting liquid material into the form comprises inserting at least one layer of material spaced apart from the panels in the inward/outward direction and wherein the anchoring features are located in the at least one layer of material.

7. A method according to claim 1 comprising: inserting insulation into the form; providing a plurality of insulation-anchoring components which project from the panels in the inward/outward direction, the insulation-anchoring components each comprising one or more insulation-anchoring features; and projecting the one or more insulation-anchoring features into the insulation to thereby bond the insulation to the insulation-anchoring components.

8. A method according to claim 7 wherein the plurality of insulation-anchoring components comprises one or more connectable insulation-anchoring components, and wherein projecting the one or more insulation-anchoring features into the insulation comprises connecting a connector component on the connectable anchoring component to a corresponding connector component on a corresponding panel.

9. A method according to claim 7 wherein inserting insulation into the form comprises locating an insulation layer adjacent to the panels and wherein inserting liquid material into the form comprises inserting at least one layer of material in a location spaced apart from the panels in the inward/outward direction.

10. A method according to claim 1 wherein connecting the plurality of panels in edge-adjacent relationship comprises making at least one direct connection between a first connector component on a first transverse edge of a first panel and a second connector component on a second transverse edge of a second panel.

11. A method according to claim 10 wherein making the at least one direct connection between the first and second connector components comprises deforming at least one of the first and second connector components, such that when the connection is made, restorative forces associated with the deformation cause the at least one of the first and second connector components to snap back to a less deformed state.

12. A method according to claim 11 wherein deforming the at least one of the first and second connector components comprises effecting relative pivotal movement between the first and second panels.

13. A structure-lining apparatus for lining one or more surfaces of a structure formed from material that is cast as a liquid in a structural form and subsequently solidifies, the apparatus comprising:

a structural form for retaining the liquid material in an interior thereof until the material subsequently solidifies;

a plurality of panels which extend in substantially orthogonal transverse and longitudinal directions, the panels connected at their respective transverse edges in edge-adjacent relationship to provide an open-ended structure-lining surface comprising a first unconnected transverse edge of a first edge panel at a first transverse edge of the structure-lining surface and a second unconnected transverse edge of a second edge panel at a second transverse edge of the structure-lining surface, the first and second transverse edges of the structure-lining surface opposed from one another, at least a portion of the structure-lining surface abutting against a corresponding portion of the interior of the structural form during fabrication of the structure;

a plurality of anchoring components which project from the panels in an inward/outward direction orthogonal to both the transverse and longitudinal directions and into the material during fabrication of the structure when the material is a liquid, the anchoring components each comprising one or more anchoring features which extend in at least one of the longitudinal and transverse directions and which are encased in the material as the material solidifies to thereby bond the anchoring components to the structure;

wherein:

the plurality of anchoring components comprises one or more connectable anchoring components, each connectable anchoring component comprising a connector component for connecting to a corresponding connector component on a corresponding panel; and the corresponding portion of the interior of the structural form is separated from the material by the structure-lining surface.

14. An apparatus according to claim 13 wherein the plurality of anchoring components comprises one or more connector anchoring components, each connector anchoring component comprising a pair of connector components for connecting to corresponding connector components on adjacent transverse edges of a corresponding pair of edge-adjacent panels to connect the pair of edge-adjacent panels in edge-adjacent relationship.

15. An apparatus according to claim 13 wherein the plurality of anchoring components comprises one or more integral anchoring components, each integral anchoring component integrally formed with a corresponding panel.

16. An apparatus according to claim 13 comprising a plurality of braces, each brace connected at one end to a corresponding panel and at its opposing end to a corresponding anchoring component for reinforcing the connection between the corresponding panel and the corresponding anchoring component.

17. An apparatus according to claim 13 wherein one or more of the anchoring features comprises: a stem extending in the longitudinal direction and in the inward/outward direction; and one or more leaves extending in the longitudinal and transverse directions at one or more locations spaced apart from the panels in the inward/outward direction.

18. An apparatus according to claim 13 wherein one or more of the anchoring features comprises a rotated anchoring feature, the rotated anchoring feature comprising: a stem extending in the longitudinal direction and in the transverse direction from a first portion of the anchoring component which extends in the inward/outward direction; and one or more leaves extending in the longitudinal and inward/outward directions at one or more locations spaced apart from the first portion of the anchoring component in the transverse direction.

19. An apparatus according to claim 13 wherein one or more of the anchoring components are apertured with apertures which extend in the longitudinal and inward/outward directions for permitting flow of the liquid material therethrough.

20. An apparatus according to claim 13 wherein the structure comprises a plurality of layers of the material, the plurality of layers comprising a proximate material layer that is located relatively close to the panels and a distal material layer which is located relatively far from the panels and which is spaced apart from the proximate material layer in the inward/outward direction and wherein the anchoring features are located in the distal material layer.

21. An apparatus according to claim 13 wherein the structure comprises at least one layer of insulation located adjacent to the panels and at least one layer of material spaced apart from the panels in the inward/outward direction and wherein the anchoring features are located in the at least one layer of material.

22. An apparatus according to claim 13 wherein the structure comprises insulation and the apparatus comprises a plurality of insulation-anchoring components which project from the panels in the inward/outward direction, the insulation-anchoring components each comprising one or more insulation-anchoring features which project into the insulation to thereby bond the insulation to the insulation-anchoring components.

23. An apparatus according to claim 22 wherein the plurality of insulation-anchoring components comprises one or more connectable insulation-anchoring components, each connectable insulation-anchoring component comprising a connector component for connecting to a corresponding connector component on a corresponding panel.

24. An apparatus according to claim 22 wherein one or more of the insulation-anchoring features comprises a pointed portion and one or more barbs.

25. An apparatus according to claim 22 wherein one or more of the insulation-anchoring components are apertured with apertures which extend in the longitudinal and inward/outward directions for permitting flow of the liquid material therethrough.

26. An apparatus according to claim 13 wherein one or more of the anchoring features comprise attachment units, each attachment unit comprising: an attachment surface which is located at or near a surface of the structure opposing the panels; and one or more fastener-receiving channels which extend away from the attachment surface and into the structure for receiving fasteners which project through the attachment surface and into the fastener-receiving channels.

27. An apparatus according to claim 26 wherein each fastener-receiving channel comprises one or more break-through elements which span the channel at one or more corresponding locations spaced apart from the attachment surface and wherein fasteners which project sufficiently far into the fastener-receiving channels project through the one or more break-through elements.

28. An apparatus according to claim 27 wherein one or more break-through elements are V-shaped in one or more of: a transverse cross-section; and a longitudinal cross-section.

29. An apparatus according to claim 13 comprising one or more corner panels, each corner panel having a first portion which extends in the longitudinal and transverse directions and a second portion which extends in the longitudinal and inward/outward directions.

30. An apparatus according to claim 29 wherein the second portion of at least one corner panel comprises a plurality of indents into the structure in the transverse direction.

31. An apparatus according to claim 30 wherein the structure comprises a plurality of segments and the apparatus comprises an interface plug connected between corresponding pairs of segments, the interface plug comprising:

an outer surface which extends in the longitudinal and transverse directions;

a plug stem which extends in the longitudinal and inward-outward directions into a space between the corresponding pair of segments; and a plurality of plug leaves which extend in opposing transverse directions and project into the indents of the corner panels of each of the corresponding pair of segments.

32. An apparatus according to claim 13 wherein at least one connection between the transverse edges of the panels comprises a direct connection between a first connector component on a first transverse edge of a first panel and a second connector component on a second transverse edge of a second panel.

33. An apparatus according to claim 32 wherein the first and second connector components are shaped such that effecting the connection between the first and second connector components comprises deformation of at least one of the first and second connector components, such that when the connection is made, restorative forces associated with the deformation cause the at least one of the first and second connector components to snap back to a less deformed state.

34. An apparatus according to claim 33 wherein the first and second connector components are shaped such that effecting the connection between the first and second connector components comprises relative pivotal movement between the first and second panels.

35. A structure-lining apparatus for lining one or more surfaces of a structure formed from material that is cast as a liquid in a structural form and subsequently solidifies, the apparatus comprising:

a structural form for retaining the liquid material in an interior therefor until the material subsequently solidifies;

a plurality of panels which extend in substantially orthogonal transverse and longitudinal directions, the panels connected at their respective transverse edges in edge-adjacent relationship to provide an open-ended structure-lining surface comprising a first unconnected transverse edge of a first edge panel at a first transverse edge of the structure-lining surface and a second unconnected transverse edge of a second edge panel at a second transverse edge of the structure-lining surface, the first and second transverse edges of the structure-lining surface opposed from one another, at least a portion of the structure-lining surface abutting against a corresponding portion of the interior of the form during fabrication the structure;

a plurality of anchoring components which project from the panels in an inward/outward direction orthogonal to both the transverse and longitudinal directions and into the material during fabrication of the structure when the material is a liquid, the anchoring components each comprising one or more anchoring features which extend in at least one of the longitudinal and transverse directions and which are encased in the material as the material solidifies to thereby bond the anchoring components to the structure;

wherein:

one or more of the anchoring features comprises: a stem extending in the longitudinal direction and in the inward/outward direction; and one or more leaves extending in the longitudinal and transverse directions at one or more locations spaced apart from the panels in the inward/outward direction; and the corresponding portion of the interior of the structural form is separated from the material by the structure-lining surface.

* * * * *